US011725838B2

(12) United States Patent
Hall, Jr. et al.

(10) Patent No.: US 11,725,838 B2
(45) Date of Patent: Aug. 15, 2023

46
(54) ENVIRONMENTAL CONTROL SYSTEM FOR REDUCED POWER CONSUMPTION THROUGH UTILIZATION OF WAKE-UP RADIOS

(71) Applicant: Johnson Controls Technology Company, Auburn Hills, MI (US)

(72) Inventors: Robert C. Hall, Jr., Brown Deer, WI (US); Timothy C. Gamroth, Dousman, WI (US); Nicholas J. Schaf, Hartland, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 132 days.

(21) Appl. No.: 16/838,803

(22) Filed: Apr. 2, 2020

(65) Prior Publication Data

US 2020/0318842 A1 Oct. 8, 2020

Related U.S. Application Data

(60) Provisional application No. 62/829,833, filed on Apr. 5, 2019, provisional application No. 62/829,809, filed
(Continued)

(51) Int. Cl.
*F24F 11/46* (2018.01)
*F24F 11/54* (2018.01)
*F24F 11/88* (2018.01)

(52) U.S. Cl.
CPC ..... *F24F 11/46* (2018.01); *F24F 11/54* (2018.01); *F24F 11/88* (2018.01)

(58) Field of Classification Search
CPC . B65B 31/025; B65B 31/04; B67C 2007/006; B67C 2007/0066; B67C 3/00;
(Continued)

(56) References Cited

U.S. PATENT DOCUMENTS

2013/0229273 A1* 9/2013 Nodar Cortizo ..... G06F 1/3203 340/407.2
2015/0373753 A1* 12/2015 Turon ..... H04W 4/80 370/254
(Continued)

OTHER PUBLICATIONS

Piyare et al., Ultra Low Power Wake-Up Radios: A Hardware and Networking Survey, 2017, IEEE Communications Surveys & Tutorials, vol. 19, No. 4, Fourth Quarter 2017, pp. 2117-2157. (Year: 2017).*
(Continued)

*Primary Examiner* — Kidest Bahta
(74) *Attorney, Agent, or Firm* — Foley & Lardner LLP

(57) ABSTRACT

A building system for a building includes an environmental controller including a controller radio. The environmental controller is configured to communicate a wake-up message. The building system includes an environmental sensor including a wake-up radio and a main radio. The environmental sensor is configured to operate the main radio in a low power state. The environmental sensor is configured to receive the wake-up message from the controller radio via the wake-up radio. The environmental sensor is configured to operate the main radio in a high power state in response to a reception of the wake-up message via the wake-up radio. The environmental sensor is configured to communicate sensor data of the environmental sensor to the controller radio via the main radio in response to the main radio operating in the high power state.

20 Claims, 46 Drawing Sheets

Related U.S. Application Data on Apr. 5, 2019, provisional application No. 62/829,816, filed on Apr. 5, 2019, provisional application No. 62/829,818, filed on Apr. 5, 2019, provisional application No. 62/829,822, filed on Apr. 5, 2019.

(58) Field of Classification Search
CPC . B67C 3/10; B67C 3/24; B67C 7/0013; F24F 11/46; F24F 11/54; F24F 11/88; F24F 2110/00
See application file for complete search history.

(56) References Cited

U.S. PATENT DOCUMENTS

| | | | | |
|---|---|---|---|---|
| 2017/0070959 | A1* | 3/2017 | Khazanov | H04W 52/0235 |
| 2019/0053155 | A1* | 2/2019 | Kneckt | H04W 72/1289 |
| 2019/0146575 | A1* | 5/2019 | Turon | H04L 12/4035 713/323 |

OTHER PUBLICATIONS

IEEE Innovation at work, "Wake Up Radio Resources," https://innovationatwork.ieee.org/wake-radio-resources/, retrieved from the Internet Mar. 13, 2023 (14 pages).
Wilhelmsson, "Wake-Up Radio—A key component ofIoT?" Ericsson Blog, Dec. 18, 2017, https://www.ericsson.com/en/blog/2017/12/wake-up-radio--a-key-component-of-iot; retrieved from the internet Mar. 13, 2023 (8 pages).

* cited by examiner

ENVIRONMENTAL CONTROL SYSTEM FOR REDUCED POWER CONSUMPTION THROUGH UTILIZATION OF WAKE-UP RADIOS

CROSS-REFERENCE TO RELATED PATENT APPLICATIONS

This application claims the benefit of and priority to U.S. Provisional Patent Application No. 62/829,809, filed Apr. 5, 2019, U.S. Provisional Patent Application No. 62/829,816 filed Apr. 5, 2019, U.S. Provisional Patent Application No. 62/829,818 filed Apr. 5, 2019, U.S. Provisional Patent Application No. 62/829,822 filed Apr. 5, 2019, and U.S. Provisional Patent Application No. 62/829,833 filed Apr. 5, 2019, the entire disclosures of which are incorporated by reference herein.

BACKGROUND

The present disclosure relates generally to building devices of building systems that operate a building. The present disclosure relates more particularly to power consumption of the building devices of the building system.

Building devices frequently consume large amounts of power from a building system to perform normal operations. Building devices may run off of batteries which have to be replaced frequently. In other instances, building devices may be directly connected to a power grid, thus sapping power from the power grid directly. If a building system fails, building devices may continue to consume power even if they can have no impact on the building system. It would be beneficial to occasionally operate building devices with little to no power. If a building device is operating with little to no power and the building device needs to urgently perform an operation, it may have no way of doing so. The lack of quick building device response can leave a building system vulnerable because the building system may not be responded to in an adequate amount of time to negative changes. Therefore, building systems often operate using excessive power consumption or risk long response time.

SUMMARY

One implementation of the present disclosure is a building system for a building, according to some embodiments. The building system includes an environmental control including a controller radio, according to some embodiments. The environmental controller is configured to communicate a wake-up message, according to some embodiments. The building system includes an environmental sensor including a wake-up radio and a main radio, according to some embodiments. The environmental sensor is configured to operate the main radio in a low power state, according to some embodiments. The environmental sensor is configured to receive the wake-up message from the controller radio via the wake-up radio, according to some embodiments. The environmental sensor is configured to operate the main radio in a high power state in response to a reception of the wake-up message via the wake-up radio, according to some embodiments. The environmental sensor is configured to communicate sensor data of the environmental sensor to the controller radio via the main radio in response to the main radio operating in the high power state, according to some embodiments.

In some embodiments, the controller radio is a single radio configured to communicate the wake-up message to the environmental sensor and receive the sensor data from the main radio of the environmental sensor.

In some embodiments, the wake-up radio is only a receiver radio.

In some embodiments, the controller radio includes a wake-up controller radio and a main controller radio. The wake-up controller radio is configured to communicate the wake-up message to the wake-up radio and the main controller radio is configured to receive the sensor data from the main radio, according to some embodiments.

In some embodiments, the wake-up controller radio is only a transmitter radio.

In some embodiments, the wake-up radio is configured to operate in one of a low wake-up radio power state and a high wake-up radio power state. The environmental sensor is configured to receive a time parameter indicating a future time at which the wake-up message may be communicated to the environmental sensor, according to some embodiments. The environmental sensor is configured to operate the wake-up radio in the low wake-up radio power state, according to some embodiments. The environmental sensor is configured to determine whether a current time is the future time, according to some embodiments. The environmental sensor is configured to operate the wake-up radio in the high wake-up radio power state in response to a determination that the current time is the future time, according to some embodiments.

In some embodiments, the time parameter indicating the future time includes a low time interval indicating a first amount of time the wake-up radio should operate at the low wake-up radio power state and a high time interval indicating a second amount of time the wake-up radio should operate at the high wake-up radio power state. The wake-up radio is configured to operate in the low wake-up radio power state for the first amount of time indicated by the low time interval, according to some embodiments. The wake-up radio is configured to operate in the high wake-up radio power state for the second amount of time indicated by the high time interval in response to the wake-up radio operating in the low wake-up radio power state for the first amount of time specified by the low time interval, according to some embodiments. The wake-up radio is configured to operate in the low wake-up radio power state in response to the wake-up radio operating in the high wake-up radio power state for the second amount of time specified by the high time interval, according to some embodiments.

In some embodiments, the high time interval and the low time interval is a single master time interval. The single master time interval indicates the low time interval and the high time interval are the same, according to some embodiments.

In some embodiments, the sensor data includes a current value of one or more environmental conditions in the building.

Another implementation of the present disclosure is an environmental sensor of a building, according to some embodiments. The environmental sensor is configured to operate in a low power state, according to some embodiments. The environmental sensor is configured to receive a wake-up message indicating the environmental sensor should operate in a high power state, according to some embodiments. The environmental sensor is configured to operate in the high power state in response to a reception of the wake-up message, according to some embodiments. The environmental sensor is configured to communicate sensor data of the environmental sensor in response to operating in the high power state, according to some embodiments.

In some embodiments, the sensor data includes a current value of one or more environmental conditions in the building.

In some embodiments, the environmental sensor is configured to receive a time parameter indicating a future time at which the wake-up message may be communicated to the environmental sensor. The environmental sensor is configured to operate in the low power state, according to some embodiments. The environmental sensor is configured to determine whether a current time is the future time, according to some embodiments. The environmental sensor is configured to operate in the high power state in response to a determination that the current time is the future time, according to some embodiments.

In some embodiments, the time parameter indicating the future time includes a low time interval indicating a first amount of time the environmental sensor should operate at the low power state and a high time interval indicating a second amount of time the environmental sensor should operate at the high power state. The environmental sensor is configured to operate in the low power state for the first amount of time indicated by the low time interval, according to some embodiments. The environmental sensor is configured to operate in the high power state for the second amount of time indicated by the high time interval in response to the environmental sensor operating in the low power state for the first amount of time specified by the low time interval, according to some embodiments. The environmental sensor is configured to operate in the low power state in response to the environmental sensor operating in the high power state for the second amount of time specified by the high time interval, according to some embodiments.

In some embodiments, the high time interval and the low time interval is a single master time interval, according to some embodiments. The single master time interval indicates the low time interval and the high time interval are the same, according to some embodiments.

Another implementation of the present disclosure is a method for operating an environmental sensor of a building, according to some embodiments. The method includes receiving a wake-up message at the environmental sensor indicating the environmental sensor should operate in a high power state, according to some embodiments. The method includes operating the environmental sensor in the high power state in response to receiving the wake-up message, according to some embodiments. The method includes communicating sensor data of the environmental sensor in response to operating in the high power state, according to some embodiments.

In some embodiments, the sensor data includes a current value of one or more environmental conditions in the building.

In some embodiments, the method includes receiving a time parameter indicating a future time at which the wake-up message may be communicated to the environmental sensor. The method includes operating the environmental sensor in a low power state, according to some embodiments. The method includes determining whether a current time is the future time, according to some embodiments. The method includes operating the environmental sensor in the high power state in response to a determination that the current time is the future time, according to some embodiments.

In some embodiments, the time parameter indicating the future time includes a low time interval indicating a first amount of time the environmental sensor should operate at the low power state and a high time interval indicating a second amount of time the environmental sensor should operate at the high power state. The method includes operating the environmental sensor in the low power state for the first amount of time indicated by the low time interval, according to some embodiments. The method includes operating the environmental sensor in the high power state for the second amount of time indicated by the high time interval in response to the environmental sensor operating in the low power state for the first amount of time specified by the low time interval, according to some embodiments. The method includes operating the environmental sensor in the low power state in response to the environmental sensor operating in the high power state for the second amount of time specified by the high time interval, according to some embodiments.

In some embodiments, the high time interval and the low time interval is a single master time interval. The single master time interval indicates the low time interval and the high time interval are the same, according to some embodiments.

In some embodiments, the wake-up message and the sensor data are communicated wirelessly.

Another implementation of the present disclosure is an asset tracking control system, according to some embodiments. The asset tracking control system includes an asset tracking controller including a controller radio, according to some embodiments. The asset tracking controller is configured to communicate a wake-up message to an asset tag, according to some embodiments. The asset tag includes a wake-up radio and a main radio, according to some embodiments. The asset tag is configured to receive the wake-up message via the wake-up radio from the controller radio of the asset tracking controller, according to some embodiments. The asset tag is configured to operate the main radio in a high main radio power state in response to the wake-up message via the wake-up radio, according to some embodiments. The asset tag is configured to communicate asset data to the controller radio via the main radio in response to the main radio operating in the high main radio power state, according to some embodiments.

In some embodiments, the controller radio is a single radio configured to communicate the wake-up message to the asset tag and to receive the asset data from the main radio of the asset tag.

In some embodiments, the wake-up radio is only a receiver radio.

In some embodiments, the wake-up radio is configured to operate in one of a low wake-up radio power state and a high wake-up radio power state. The asset tag is configured to receive a parameter of a future time at which time the wake-up message may be communicated to the asset tag, according to some embodiments. The asset tag is configured to operate the wake-up radio in the low wake-up radio power state, according to some embodiments. The asset tag is configured to determine if a current time is the future time, according to some embodiments. The asset tag is configured to operate the wake-up radio in the high wake-up radio power state in response to a determination that the current time is the future time, according to some embodiments.

In some embodiments, the low wake-up radio power state indicates the wake-up radio is not able to receive the wake-up message.

In some embodiments, the asset data includes a current position of the asset tag.

In some embodiments, the controller radio includes a wake-up controller radio and a main controller radio. The wake-up controller radio is configured to communicate to the wake-up radio of the asset tag, according to some embodiments. The main controller radio is configured to receive data from the main radio, according to some embodiments.

In some embodiments, the wake-up controller radio is only a transmitter radio.

Another implementation of the present disclosure is a wake-up radio of an asset tag, according to some embodiments. The wake-up radio is configured to operate in a high wake-up radio power state, the high wake-up radio power state indicating the wake-up radio can receive a wake-up message, according to some embodiments. The wake-up radio is configured to receive the wake-up message, the wake-up message indicating the asset tag should operate in a high asset tag power state, according to some embodiments. The wake-up radio is configured to operate the asset tag in the high asset tag power state in response to receiving the wake-up message, according to some embodiments. The wake-up radio is configured to operate in the high wake-up radio power state to receive a next wake-up message, according to some embodiments.

In some embodiments, the wake-up radio is only a receiver radio.

In some embodiments, the wake-up radio is configured to operate in a low wake-up radio power state. The wake-up radio is configured to operate in the high wake-up radio power state in response to a determination that a current time is a future time indicated by a time parameter, according to some embodiments. The future time indicates a time when the wake-up radio should operate in the high wake-up radio power state, according to some embodiments.

In some embodiments, the low wake-up radio power state indicates the wake-up radio is not able to receive the wake-up message.

In some embodiments, the wake-up radio is configured to operate in the low wake-up radio power state at a time after the wake-up message is received.

Another implementation of the present disclosure is a method for operating an asset tag in an asset tracking control system, according to some embodiments. The method includes communicating a wake-up message to a wake-up radio of the asset tag, according to some embodiments. The method includes receiving the wake-up message, according to some embodiments. The method includes operating a main radio of the asset tag in a high main radio power state in response to the wake-up message, according to some embodiments. The method includes communicating asset data in response to the main radio operating in the high main radio power state, according to some embodiments.

In some embodiments, the wake-up radio is only a receiver radio.

In some embodiments, the method includes receiving a parameter of a future time at which time the wake-up message may be communicated to the asset tag. The method includes operating the wake-up radio in a low wake-up radio power state, according to some embodiments. The method includes determining if a current time is the future time, according to some embodiments. The method includes operating the wake-up radio in a high wake-up radio power state in response to a determination that the current time is the future time, according to some embodiments.

In some embodiments, the low wake-up radio power state indicates the wake-up radio is not able to receive the wake-up message.

In some embodiments, the high wake-up radio power state indicates the wake-up radio is able to receive the wake-up message.

In some embodiments, the method includes operating the wake-up radio in the low wake-up radio power state at a time after the wake-up message is received.

In some embodiments, the asset data includes a current position of the asset tag.

Another implementation of the present disclosure is a building system for a building, according to some embodiments. The building system includes a master controller including a controller transceiver, according to some embodiments. The master controller is configured to determine a fault status of a slave device, according to some embodiments. The master controller is configured to determine if a recovery message should be communicated to the slave device based on the fault status of the slave device, according to some embodiments. The master controller is configured to communicate the recovery message to the slave device, according to some embodiments. The recovery message is a wake-up message, according to some embodiments. The building system includes the slave device including a slave recovery radio, according to some embodiments. The slave device is configured to receive the recovery message via the slave recovery radio from the controller transceiver of the master controller, according to some embodiments. The slave device is configured to operate in a high power state in response to a reception of the recovery message, according to some embodiments. The slave device is configured to perform an operation to resolve the fault status of the slave device, according to some embodiments.

In some embodiments, the slave recovery radio is only a receiver radio.

In some embodiments, the operation performed to resolve the fault status of the slave device is a soft reset. The soft reset is configured to restart the slave device, according to some embodiments.

In some embodiments, the operation performed to resolve the fault status of the slave device is a hard reset. The hard reset is configured to reset a configuration of the slave device to a predefined state, according to some embodiments.

In some embodiments, the slave device includes the slave recovery radio and a slave transceiver. The slave transceiver is configured to communicate data of the slave device to the controller transceiver, according to some embodiments.

In some embodiments, the controller transceiver is a single transceiver configured to communicate the recovery message to the slave device and receive the data from the slave transceiver.

In some embodiments, the controller transceiver includes a recovery controller radio and a main controller transceiver. The recovery controller radio is configured to communicate the recovery message to the slave recovery radio, according to some embodiments. The main controller transceiver is configured to receive the data from the slave transceiver, according to some embodiments.

In some embodiments, the main controller transceiver and the slave transceiver are connected wirelessly.

Another implementation of the present disclosure is a slave device of a building, according to some embodiments. The slave device is configured to receive a recovery message, according to some embodiments. The recovery message is a wake-up message, according to some embodiments. The slave device is configured to operate the slave device in a high power state in response to the recovery message, according to some embodiments. The slave device is configured to perform an operation to resolve a fault status of the slave device, according to some embodiments. The slave device is configured to communicate slave device data indicating results of the operation to resolve the fault status, according to some embodiments.

In some embodiments, the operation performed to resolve the fault status of the slave device is a soft reset. The soft reset is configured to restart the slave device, according to some embodiments.

In some embodiments, the operation performed to resolve the fault status of the slave device is a hard reset. The hard reset is configured to reset a configuration of the slave device to a predefined state, according to some embodiments.

In some embodiments, the high power state indicates the slave device can perform the operation to resolve the fault status.

In some embodiments, the slave device is configured to recognize one or more addresses the recovery message can be sent to. The slave device is configured to associate each address with a type of reset, according to some embodiments. The slave device is configured to determine a particular address the recovery message is sent to, according to some embodiments. The slave device is configured to perform the type of reset associated with the particular address, according to some embodiments.

Another implementation of the present disclosure is a method for performing a remote reset of a slave device, according to some embodiments. The method includes determining a fault status of the slave device, according to some embodiments. The method includes determining if a recovery message should be communicated to the slave device based on the fault status of the slave device, according to some embodiments. The method includes communicating the recovery message to the slave device, wherein the recovery message is a wake-up message, according to some embodiments. The method includes receiving the recovery message, according to some embodiments. The method includes operating the slave device in a high power state in response to a reception of the recovery message, according to some embodiments. The method includes performing an operation to resolve the fault status of the slave device, according to some embodiments.

In some embodiments, the operation to resolve the fault status is a soft reset. The soft reset is configured to restart the slave device, according to some embodiments.

In some embodiments, the operation performed to resolve the fault status of the slave device is a hard reset. The hard reset is configured to reset a configuration of the slave device to a predefined state, according to some embodiments.

In some embodiments, the method includes communicating slave device data indicating results of the operation to resolve the fault status.

In some embodiments, the high power state indicates the slave device can perform the operation to resolve the fault status.

In some embodiments, the method includes recognizing one or more addresses the recovery message can be sent to. The method includes associating each address with a type of reset, according to some embodiments. The method includes determining a particular address the recovery message is sent to, according to some embodiments. The method includes performing the type of reset associated with the particular address, according to some embodiments.

In some embodiments, the recovery message is communicated to the slave device by a wireless connection.

Another implementation of the present disclosure is an environmental control system for a building, according to some embodiments. The environmental control system includes an environmental controller, according to some embodiments. The environmental controller is configured to determine a control action for an environmental control actuator to perform, according to some embodiments. The environmental controller is configured to communicate a wake-up message to the environmental control actuator, according to some embodiments. The wake-up message indicates the control action, according to some embodiments. The environmental control system includes the environmental control actuator including a wake-up radio, according to some embodiments. The environmental control actuator is configured to receive the wake-up message, according to some embodiments. The environmental control actuator is configured to operate the environmental control actuator in a high environmental control actuator power level in response to a reception of the wake-up message, according to some embodiments.

In some embodiments, the environmental control actuator can control one or more environmental conditions in response to an operation in the high environmental control actuator power level.

In some embodiments, the wake-up radio is only a receiver radio.

In some embodiments, the wake-up message includes a data payload. The data payload is configured to operate a function of the environmental control actuator, according to some embodiments.

In some embodiments, the wake-up radio is configured to operate in at least one of a low wake-up radio power state or a high wake-up radio power state. The environmental control actuator is configured to receive a time parameter indicating a future time at which the wake-up message may be communicated to the environmental control actuator, according to some embodiments. The environmental control actuator is configured to operate the wake-up radio in the low wake-up radio power state, according to some embodiments. The environmental control actuator is configured to determine if a current time is the future time, according to some embodiments. The environmental control actuator is configured to operate the wake-up radio in the high wake-up radio power state in response to a determination that the current time is the future time, according to some embodiments.

In some embodiments, the environmental control actuator includes an interface trigger. The interface trigger is configured to receive a wake-up trigger message via the wake-up radio, according to some embodiments. The interface trigger is configured to communicate a trigger message to an actuator interface in response to the wake-up trigger message, according to some embodiments. The environmental control actuator includes the actuator interface, according to some embodiments. The actuator interface is configured to receive the trigger message via the interface trigger, according to some embodiments. The actuator interface is configured to operate an environmental control apparatus in response to the trigger message, according to some embodiments. The environmental control actuator includes the environmental control apparatus, according to some embodiments. The environmental control apparatus is configured to control one or more environmental conditions in response to an operation from the actuator interface, according to some embodiments.

In some embodiments, the wake-up radio is configured to listen to one or more addresses. The wake-up radio is configured to operate a function of the environmental control actuator when the wake-up message is sent via one of the one or more addresses that the wake-up radio is listening to, according to some embodiments.

In some embodiments, the environmental controller communicates the wake-up message via a wireless access point. The wireless access point is configured to receive a message from the environmental controller, according to some embodiments. The wireless access point is configured to communicate the wake-up message to the wake-up radio of the environmental control actuator, according to some embodiments.

In some embodiments, the environmental controller and the wireless access point is a single device configured to communicate the wake-up message to the wake-up radio of the environmental control actuator.

Another implementation of the present disclosure is an environmental control actuator of a building, according to some embodiments. The environmental control actuator is configured to receive a wake-up message, according to some embodiments. The wake-up message indicates a control action for the environmental control actuator to perform, according to some embodiments. The environmental control actuator is configured to operate at a high environmental control actuator power state in response to the wake-up message, according to some embodiments. The environmental control actuator is configured to affect one or more environmental conditions in the building in response to operating in the high environmental control actuator power state, according to some embodiments.

In some embodiments, the wake-up message includes a data payload. The data payload is configured to operate a function of the environmental control actuator, according to some embodiments.

In some embodiments, the environmental control actuator is configured to receive a time parameter indicating a future time at which the wake-up message may be communicated to the environmental control actuator. The environmental control actuator is configured to operate in a low environmental control actuator power state, according to some embodiments. The environmental control actuator is configured to determine if a current time is the future time, according to some embodiments. The environmental control actuator is configured to operate in the high environmental control actuator power state in response to a determination that the current time is the future time, according to some embodiments.

In some embodiments, the low environmental control actuator power state indicates the environmental control actuator cannot receive the wake-up message.

In some embodiments, the high environmental control actuator power state indicates the environmental control actuator can receive the wake-up message.

Another implementation of the present disclosure is a method for operating an environmental control actuator in a building, according to some embodiments. The method includes determining a control action for the environmental control actuator to perform, according to some embodiments. The method includes communicating a wake-up message to the environmental control actuator, according to some embodiments. The wake-up message indicates the control action, according to some embodiments. The method includes receiving the wake-up message, according to some embodiments. The method includes operating the environmental control actuator in a high environmental control actuator power state in response to a reception of the wake-up message.

In some embodiments, the method includes affecting one or more environmental conditions in the building.

In some embodiments, the wake-up message includes a data payload. The data payload is configured to operate a function of the environmental control actuator, according to some embodiments.

In some embodiments, the method includes receiving a time parameter indicating a future time at which the wake-up message may be communicated to the environmental control actuator. The method includes operating the environmental control actuator in a low environmental control actuator power state, according to some embodiments. The method includes determining if a current time is the future time, according to some embodiments. The method includes operating the environmental control actuator in the high environmental control actuator power state in response to a determination that the current time is the future time, according to some embodiments.

In some embodiments, the low environmental control actuator power state indicates the environmental control actuator cannot receive the wake-up message.

In some embodiments, the method includes listening to one or more addresses. The method includes operating a function of the environmental control actuator based on the wake-up message being sent via one of the one or more addresses, according to some embodiments.

Another implementation of the present disclosure is a security control system for a building, according to some embodiments. The security control system includes a security controller, according to some embodiments. The security controller is configured to determine a control action for a security control actuator to perform, according to some embodiments. The security controller is configured to communicate a wake-up message to the security control actuator, according to some embodiments. The wake-up message indicates the control action, according to some embodiments. The security control system includes the security control actuator including a wake-up radio, according to some embodiments. The security control actuator is configured to receive the wake-up message, according to some embodiments. The security control actuator is configured to operate the security control actuator in a high security control actuator power level in response to a reception of the wake-up message, according to some embodiments.

In some embodiments, the security control actuator can control one or more security conditions in response to an operation in the high security control actuator power level.

In some embodiments, the wake-up radio is only a receiver radio.

In some embodiments, the wake-up message includes a data payload. The data payload is configured to operate a function of the security control actuator, according to some embodiments.

In some embodiments, the wake-up radio is configured to operate in at least one of a low wake-up radio power state or a high wake-up radio power state. The security control actuator is configured to receive a time parameter indicating a future time at which the wake-up message may be communicated to the security control actuator, according to some embodiments. The security control actuator is configured to operate the wake-up radio in the low wake-up radio power state, according to some embodiments. The security control actuator is configured to determine if a current time is the future time, according to some embodiments. The security control actuator is configured to operate the wake-up radio in the high wake-up radio power state in response to a determination that the current time is the future time, according to some embodiments.

In some embodiments, the security control actuator includes an interface trigger. The interface trigger is configured to receive a wake-up trigger message via the wake-up radio, according to some embodiments. The interface trigger is configured to communicate a trigger message to an actuator interface in response to the wake-up trigger message, according to some embodiments. The security control actuator includes the actuator interface, according to some embodiments. The actuator interface is configured to receive the trigger message via the interface trigger, according to some embodiments. The actuator interface is configured to operate an security control apparatus in response to the trigger message, according to some embodiments. The security control actuator includes the security control apparatus, according to some embodiments. The security control apparatus is configured to control one or more security conditions in response to an operation from the actuator interface, according to some embodiments.

In some embodiments, the wake-up radio is configured to listen to one or more addresses. The wake-up radio is configured to operate a function of the security control actuator when the wake-up message is sent via one of the one or more addresses that the wake-up radio is listening to, according to some embodiments.

In some embodiments, the security controller communicates the wake-up message via a wireless access point. The wireless access point is configured to receive a message from the security controller, according to some embodiments. The wireless access point is configured to communicate the wake-up message to the wake-up radio of the security control actuator, according to some embodiments.

In some embodiments, the security controller and the wireless access point is a single device configured to communicate the wake-up message to the wake-up radio of the security control actuator.

Another implementation of the present disclosure is a security control actuator of a building, according to some embodiments. The security control actuator is configured to receive a wake-up message, according to some embodiments. The wake-up message indicates a control action for the security control actuator to perform, according to some embodiments. The security control actuator is configured to operate at a high security control actuator power state in response to the wake-up message, according to some embodiments. The security control actuator is configured to affect one or more security conditions in the building in response to operating in the high security control actuator power state, according to some embodiments.

In some embodiments, the wake-up message includes a data payload. The data payload is configured to operate a function of the security control actuator, according to some embodiments.

In some embodiments, the security control actuator is configured to receive a time parameter indicating a future time at which the wake-up message may be communicated to the security control actuator. The security control actuator is configured to operate in a low security control actuator power state, according to some embodiments. The security control actuator is configured to determine if a current time is the future time, according to some embodiments. The security control actuator is configured to operate in the high security control actuator power state in response to a determination that the current time is the future time, according to some embodiments.

In some embodiments, the low security control actuator power state indicates the security control actuator cannot receive the wake-up message.

In some embodiments, the high security control actuator power state indicates the security control actuator can receive the wake-up message.

Another implementation of the present disclosure is a method for operating an security control actuator in a building, according to some embodiments. The method includes determining a control action for the security control actuator to perform, according to some embodiments. The method includes communicating a wake-up message to the security control actuator, according to some embodiments. The wake-up message indicates the control action, according to some embodiments. The method includes receiving the wake-up message, according to some embodiments. The method includes operating the security control actuator in a high security control actuator power state in response to a reception of the wake-up message.

In some embodiments, the method includes affecting one or more security conditions in the building.

In some embodiments, the wake-up message includes a data payload. The data payload is configured to operate a function of the security control actuator, according to some embodiments.

In some embodiments, the method includes receiving a time parameter indicating a future time at which the wake-up message may be communicated to the security control actuator. The method includes operating the security control actuator in a low security control actuator power state, according to some embodiments. The method includes determining if a current time is the future time, according to some embodiments. The method includes operating the security control actuator in the high security control actuator power state in response to a determination that the current time is the future time, according to some embodiments.

In some embodiments, the low security control actuator power state indicates the security control actuator cannot receive the wake-up message.

In some embodiments, the method includes listening to one or more addresses. The method includes operating a function of the security control actuator based on the wake-up message being sent via one of the one or more addresses, according to some embodiments.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Overview

Figure 1:
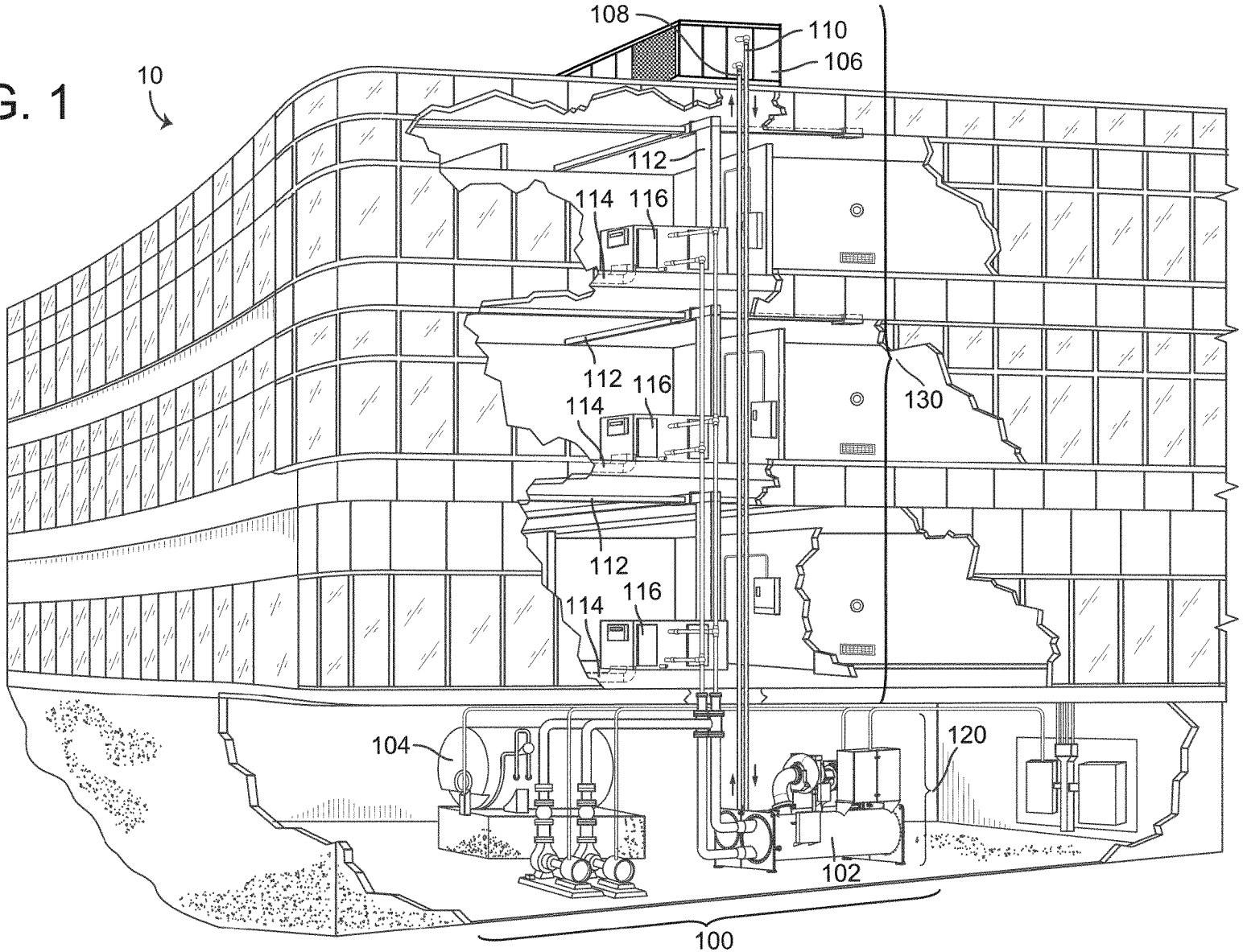
FIG. 1 is a drawing of a building equipped with a HVAC system, according to an exemplary embodiment.

Referring generally to the FIGURES, systems and methods for utilizing wake-up radios in devices communicated to by a controller is shown, according to various exemplary embodiments. The controllers and devices can include, for example, an environmental controller and one or more environmental sensors. A building system including the environmental controller and the environmental sensors can include multiple environmental sensors, each of which may receive wake-up messages from the environmental controller. The environmental controller can be configured to operate the environmental sensors by communicating a wake-up message to wake-up radios of the environmental sensors. The wake-up radios may be configured to receive a wake-up message and cause the environmental sensor to perform needed operations.

It is common within buildings today to have wireless communications between environmental sensor and environmental controller components of a building environmental control system. This system may leverage wireless communications to allow the environmental sensors to conserve battery power while idle by being woken up to an active state only when necessary by the receipt of a special directed communication message.

This system may be accomplished by embedding a second radio alongside the main radio within the battery-powered and/or direct-powered environmental sensor. In traditional environmental sensors, a single main radio capable of both receiving and transmitting must be active in order to receive any message from the environmental controller. This system includes a second radio component in the environmental sensor dedicated to receiving a "wake-up" message from the environmental controller that indicates it may be necessary for the environmental sensor to be fully active for some purpose. This dedicated wake-up message, being transmitted by the environmental controller, may be received by the dedicated wake-up receiver component of the environmental sensor and causes the environmental sensor to return to a fully active state capable of transmitting and receiving messages through its main radio component. The second "wake-up" radio could be of such a design that it may be capable of only receiving wake-up messages, thereby being much less complex than the main communications radio; this reduced complexity in the wake-up radio allows a corresponding reduction in necessary power for that radio component to be active and listening for messages in comparison to the main radio. When the battery-powered environmental sensor completes the cycle of activity, namely communicating its sensor data to the environmental controller through the facilities of the main radio, or some other purpose(s), it can go into a reduced-power idle state in which the only functionality required to be active could be the wake-up receiver; the more complex main communications radio can be put into an idle state in which it may not be receiving signals while the less-complex wake-up radio may be listening to the environmental controller for the wake-up message. In this manner, the total and average powered consumed by the environmental sensor may be reduced, thereby providing the environmental sensor with longer active life on installed batteries.

Building Management System and HVAC System

Figure 2:
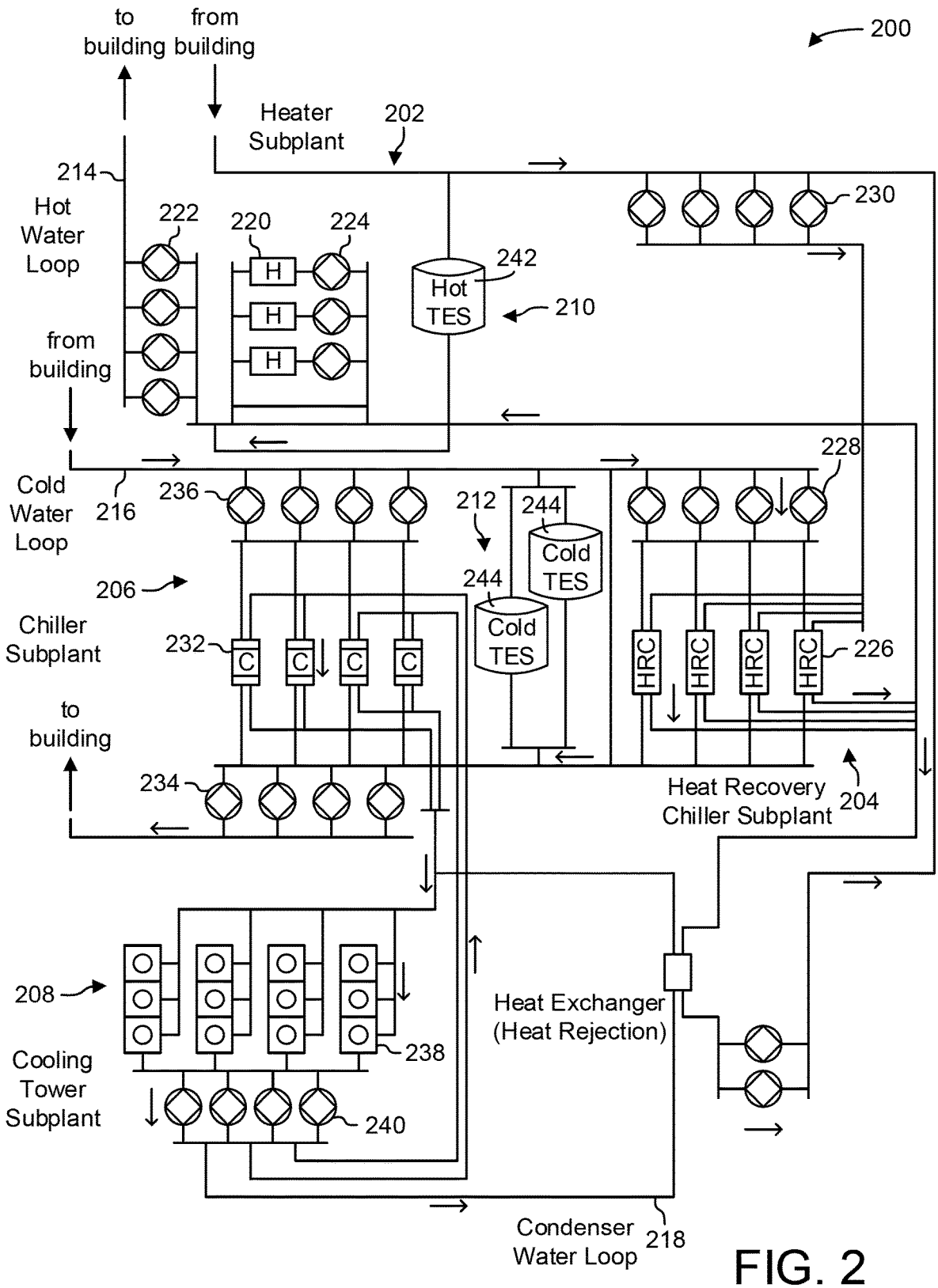
FIG. 2 is a block diagram of a waterside system that may be used in conjunction with the building of FIG. 1, according to an exemplary embodiment.
Figure 3:
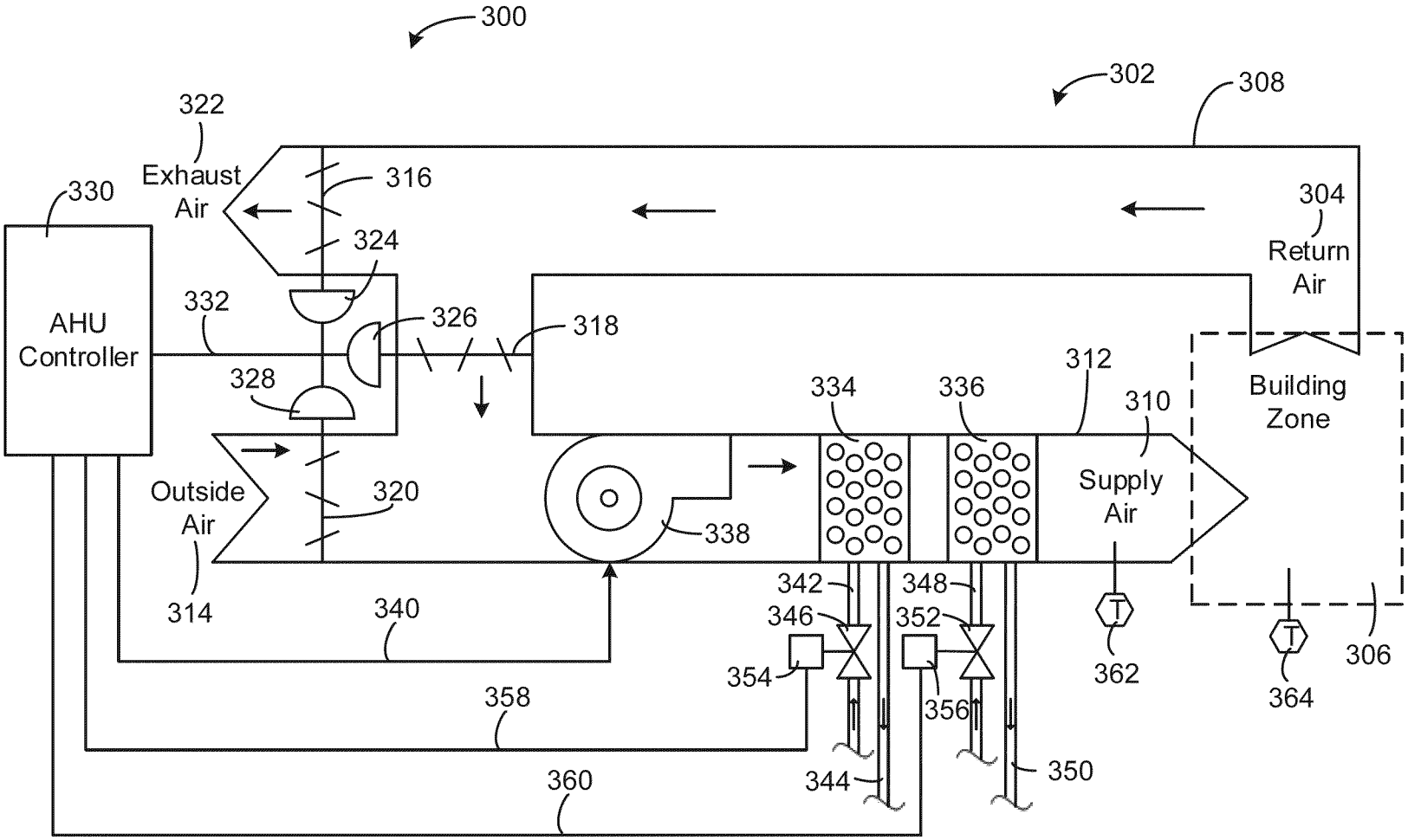
FIG. 3 is a block diagram of an airside system that may be used in conjunction with the building of FIG. 1, according to an exemplary embodiment.

Referring now to FIGS. 1-3, an exemplary building management system (BMS) and HVAC system in which the systems and methods of the present invention can be implemented are shown, according to an exemplary embodiment. Referring particularly to FIG. 1, a perspective view of a building 10 is shown. Building 10 is served by a BMS. A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10. An exemplary waterside system and airside system which can be used in HVAC system 100 are described in greater detail with reference to FIGS. 2-3.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve set-point conditions for the building zone.

Referring now to FIG. 2, a block diagram of a waterside system 200 is shown, according to an exemplary embodiment. In various embodiments, waterside system 200 can supplement or replace waterside system 120 in HVAC system 100 or can be implemented separate from HVAC system 100. When implemented in HVAC system 100, waterside system 200 can include a subset of the HVAC devices in HVAC system 100 (e.g., boiler 104, chiller 102, pumps, valves, etc.) and can operate to supply a heated or chilled fluid to AHU 106. The HVAC devices of waterside system 200 can be located within building 10 (e.g., as components of waterside system 120) or at an offsite location such as a central plant.

In FIG. 2, waterside system 200 is shown as a central plant having a plurality of subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve the thermal energy loads (e.g., hot water, cold water, heating, cooling, etc.) of a building or campus. For example, heater subplant 202 can be configured to heat water in a hot water loop 214 that circulates the hot water between heater subplant 202 and building 10. Chiller subplant 206 can be configured to chill water in a cold water loop 216 that circulates the cold water between chiller subplant 206 building 10. Heat recovery chiller subplant 204 can be configured to transfer heat from cold water loop 216 to hot water loop 214 to provide additional heating for the hot water and additional cooling for the cold water. Condenser water loop 218 can absorb heat from the cold water in chiller subplant 206 and reject the absorbed heat in cooling tower subplant 208 or transfer the absorbed heat to hot water loop 214. Hot TES subplant 210 and cold TES subplant 212 can store hot and cold thermal energy, respectively, for subsequent use.

Hot water loop 214 and cold water loop 216 can deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) can be used in place of or in addition to water to serve the thermal energy loads. In other embodiments, subplants 202-212 can provide heating and/or cooling directly to the building or campus without requiring an intermediate heat transfer fluid. These and other variations to waterside system 200 are within the teachings of the present invention.

Each of subplants 202-212 can include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 can also include one or more pumps or valves configured to control the flow rate of the hot water into or out of hot TES tank 242. Cold TES subplant 212 is shown to include cold TES tanks 244 configured to store the cold water for later use. Cold TES subplant 212 can also include one or more pumps or valves configured to control the flow rate of the cold water into or out of cold TES tanks 244.

In some embodiments, one or more of the pumps in waterside system 200 (e.g., pumps 222, 224, 228, 230, 234, 236, and/or 240) or pipelines in waterside system 200 include an isolation valve associated therewith. Isolation valves can be integrated with the pumps or positioned upstream or downstream of the pumps to control the fluid flows in waterside system 200. In various embodiments, waterside system 200 can include more, fewer, or different types of devices and/or subplants based on the particular configuration of waterside system 200 and the types of loads served by waterside system 200.

Referring now to FIG. 3, a block diagram of an airside system 300 is shown, according to an exemplary embodiment. In various embodiments, airside system 300 can supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, ducts 112-114, fans, dampers, etc.) and can be located in or around building 10. Airside system 300 can operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust air damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 200 (e.g., from cold water loop 216) via piping 342 and can return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 can receive a heated fluid from waterside system 200 (e.g., from hot water loop 214) via piping 348 and can return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a set-point temperature for supply air 310 or to maintain the temperature of supply air 310 within a set-point temperature range). The positions of valves 346 and 352 affect the amount of heating or cooling provided to supply air 310 by cooling coil 334 or heating coil 336 and may correlate with the amount of energy consumed to achieve a desired supply air temperature. AHU controller 330 can control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 can communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, set-points, operating boundaries, etc.) and provides information to BMS controller 366 (e.g., temperature measurements, valve or actuator positions, operating statuses, diagnostics, etc.). For example, AHU controller 330 can provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 can communicate with BMS controller 366 and/or AHU controller 330 via communications link 372.

Building System with Wake-Up Radio Features

Figure 4:
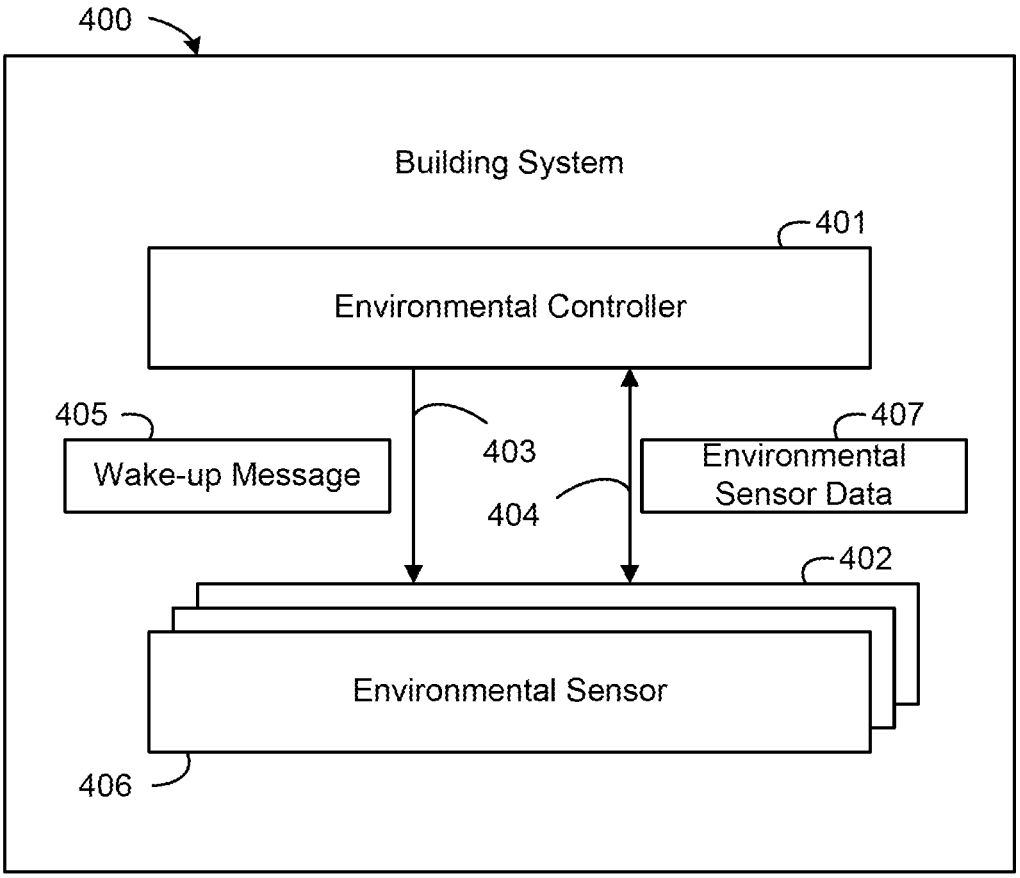
FIG. 4 is a block diagram of a building system including an environmental controller and one or more environmental sensors, according to an exemplary embodiment.

Referring now to FIG. 4, a building system 400 is shown, according to an exemplary embodiment. Building system 400 is shown to include an environmental controller 401 and a set of environmental sensors 402 to which an environmental sensor 406 belongs and can utilized with the building 10 and systems 200 and 330 discussed above. From here forward, the environmental sensor 406 may act as an exemplary embodiment of how all other environmental sensors in the set of environmental sensors 402 may operate. In some embodiments, environmental sensor 406 may be unique in its operation or may be the same in its operation in regards to the other environmental sensors in the set of environmental sensors 402. The set of environmental sensors 402 can include one or more devices that are configured to measure various environmental conditions (e.g., light intensity, temperature, humidity, air pressure, air quality, etc.). For example, a room may contain a first environmental sensor that may be configured to gather information about the current temperature of a room the first environmental sensor is located in. A second environmental sensor may also be in the same room as the first environmental sensor, but the second environmental sensor may be configured to gather data about the gas concentration in the room. In building system 400, environmental controller 401 may be configured to manage and/or gather data from the set of environmental sensors 402 via one or more communication channels. A wake-up communication channel 403 from the environmental controller 401 to the set of environmental sensors 402 and a data communication channel 404 from the set of environmental sensors 402 to environmental controller 401 can be any one or a combination of various wireless data transferring mediums (e.g., LAN, WAN, MAN, Bluetooth, Wi-Fi, Zigbee, etc.). In this regard, environmental controller 401 and the set of environmental sensors 402 can include the hardware and/or software to make wake-up communication channel 403 and data communication channel 404 possible.

The power consumption in building system 400 can be high if one or more of the environmental sensors are always operating at a high power state even if they are not actively transmitting sensor data. If an environmental sensor is directly connected to a power grid in the building system 400, it may take unnecessary amounts of power out of the power grid directly. In the case where an environmental sensor is powered by a battery, the battery may have low efficiency and may need to be replaced more frequently as more power may be drawn from the battery than necessary. In a building system where wake-up radio features are not used, all environmental sensors may constantly be at a high power state, even if there are long periods of time where data communication need not occur. Similarly, in a case where an environmental controller of a building is disabled, there may be no need for the entire set of environmental sensors to be at a high power state if they do not have the ability to communicate data in the first place.

In some embodiments, the components of the environmental sensor 406 can operate in a low power state until a wake-up message 405 is communicated via wake-up communication channel 403. Once the wake-up message 405 is received by the environmental sensor 406, environmental sensor 406 may be configured to operate in a high power state so that it can communicate an environmental sensor data 407 via data communication channel 404, according to some embodiments. Once the communication of the environmental sensor data 407 is complete, the environmental sensor 406 may be configured to return to operation in a low power state until another wake-up message 405 is received, in some embodiments.

In some embodiments, a low power state include an idle state, sleep state (e.g., sleep mode), off mode, standby mode, or any other mode that operates at a lower power level than standard operation. For example, environmental sensor 406 may operate in a low power mode prior to receiving wake-up message 405. In this embodiment of the low power mode, environmental sensor 405 is in "standby" which allows environmental sensor 406 to operate at significantly lower power levels, yet does not require a full reboot to revert back to a mode of standard operation. For example, if typical operation of environmental sensor yields a 5V supply voltage with a 1 mA (e.g., 5 mW) current draw, low power state for environmental sensor 406 yields 0.5V supply 0.1 mA (e.g., 0.05 mW).

In some embodiments, the low power state is not necessarily in a low power state that constitutes sleep mode, standby mode, or any other significantly lower power mode, and may just be at a state lower than the state of normal operation (e.g., a high power state). For example, lower power state may use 4 mW of power while high power state used 5 mW of power. In some embodiments, this lower power state may be referred to as an intermediate power state as it is not necessarily at a low power state, but when environmental sensor 406 is in the intermediate state, it still used less power than high power state.

In some embodiments, the high power state for environmental sensor 406 may include any state in which high power state uses more power than the low power state. As disclosed herein, high power state may refer to a normal state, standard operating state, or any other state that is operates at a higher power level than the low power state described herein.

Figure 5:
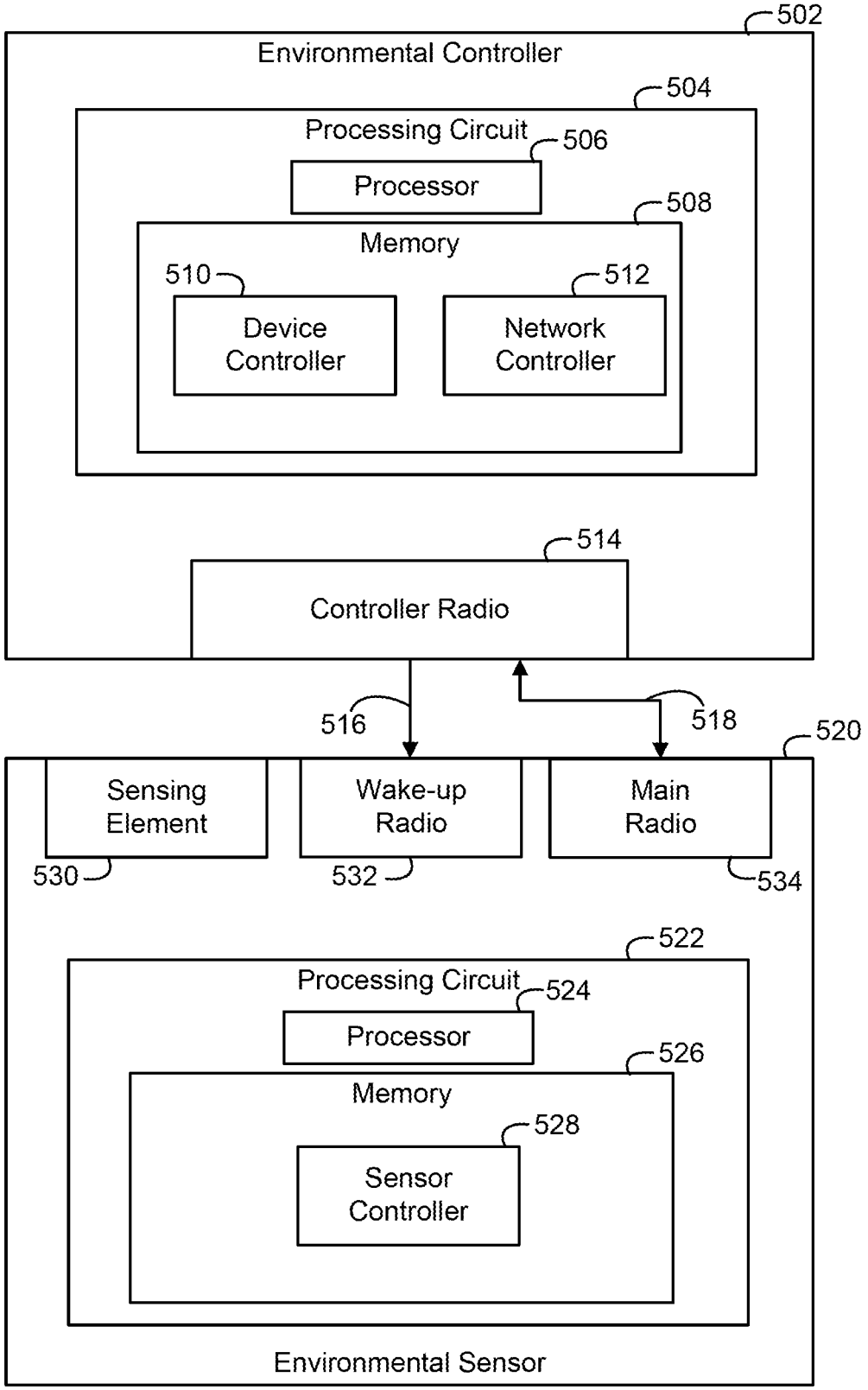
FIG. 5 is a block diagram of the communication of a wake-up message and/or environmental sensor data between the environmental controller and the environmental sensor of FIG. 1, according to an exemplary embodiment.

Referring now to FIG. 5, an environmental controller 502 is shown in greater detail in regards to environmental controller 401 of FIG. 4, according to an exemplary embodiment. In some embodiments, environmental controller 502 includes a processing circuit 504. In some embodiments, the processing circuit 504 includes a processor 506 and/or a memory 508. Processor 506 can be implemented as a general-purpose processor, an application specific integrated circuit (ASIC), one or more field programmable gate arrays (FPGAs), a group of processing components, or other suitable electronic processing components.

Memory 508 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 508 may be or include volatile memory or non-volatile memory. Memory 508 may include database components, object code components, script components, or any other type of information structure for supporting the various activities and information structures described in the present application. According to some embodiments, memory 508 may be communicably connected to processor 506 via processing circuit 504 and includes computer code for executing (e.g., by processing circuit 504 and/or processor 506) one or more processes described herein.

Still referring to FIG. 5, memory 508 is shown to include a device controller 510 and a network controller 512, in some embodiments. Network controller 512 may facilitate communication of the environmental controller 502 over one or more networks (e.g. internal building networks, an IP based network, etc.). This communication may allow the environmental controller 502 to receive remote instructions on how to operate subsidiary environmental sensors, be notified when the environmental controller 502 should gather environmental sensor data from subsidiary environmental sensors, receive software updates, etc., according to some embodiments. As an example, an administrator of the building system may need to know what the temperature in a room is. To determine the temperature of the room, the administrator can communicate a message to the environmental controller 502 over an internal building network indicating a request for temperature data. In response to the request for temperature data, the environmental controller 502 can then attempt to gather temperature data from environmental sensors and send the temperature data back to the administrator over the internal building network as facilitated by the network controller 512. In some embodiments, device controller 510 may be configured to parse environmental sensor data and/or make determinations on which environmental sensors from a set of environmental sensors should be woken up. In some embodiments, device controller 510 can provide environmental sensor data to the network controller 512 to be distributed via the one or more networks.

Environmental controller 502 is also shown to include a controller radio 514, in some embodiments. Controller radio 514 can be configured to communicate a wake-up message to an environmental sensor 520 via a wake-up communication channel 516. In some embodiments, controller radio 514 may also be configured to receive environmental sensor data (e.g., temperature, humidity, air quality, duct pressure, etc.) from the environmental sensor 520 via a data communication channel 518. In an example, the environmental controller 502 may need information regarding humidity in a room so the environmental controller 502 may instruct the controller radio 514 to communicate a wake-up message to an environmental sensor configured to gather humidity data. After the wake-up message is received by the environmental sensor and the environmental sensor is gathering humidity data, the controller radio 514 may then receive the humidity data as well.

Still referring to FIG. 5, an environmental sensor 520 is shown in greater detail in regards to the environmental sensor 406 of FIG. 4, according to an exemplary embodiment. Environmental sensor 520 is shown to include a processing circuit 522, wherein processing circuit 522 includes a processor 524 and/or a memory 526. Processor 524 can be implemented as a general-purpose processor, an application specific integrated circuit (ASIC), one or more field programmable gate arrays (FPGAs), a group of processing components, or other suitable electronic processing components.

Memory 526 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 526 may be or include volatile memory or non-volatile memory. Memory 526 may include database components, object code components, script components, or any other type of information structure for supporting the various activities and information structures described in the present application. According to an exemplary embodiment, memory 526 is communicably connected to processor 524 via processing circuit 522 and includes computer code for executing (e.g., by processing circuit 522 and/or processor 524) one or more processes described herein.

Memory 526 is shown to include a sensor controller 528. Sensor controller 528 may be configured to gather environmental sensor data from a sensing element 530, operate a main radio 534 at a high power state in response to receiving a wake-up message via a wake-up radio 532, and/or instruct the main radio 534 to communicate environmental sensor data to an environmental controller, according to some embodiments.

The environmental controller 502 and the environmental sensor 520 are shown connected by the wake-up communication channel 516 and the data communication channel 518, according to some embodiments. Wake-up communication channel 516 and data communication channel 518 may be similar to and/or the same as the wake-up communication channel 403 and the data communication channel 404 described with reference to FIG. 4 respectively, according to some embodiments.

Wake-up radio 532 may be configured to receive a wake-up message from controller radio 514 via wake-up communication channel 516, according to some embodiments. In response to receiving the wake-up message, the environmental sensor 520 may operate some and/or all of its components at a high power level. In some embodiments, the wake-up radio 532 may always be operating at the high power level in order to be able to receive the wake-up message. In some embodiments, when the sensing element 530 of the environmental sensor 520 is operating at the high power level, the sensing element 530 may be able to gather environmental data (e.g. light intensity, temperature, humidity, air quality, etc.). In response to the sensing element 530 gathering the environmental data, the sensor controller operating at the high power state may package the environmental data in such a way that may be recognizable to the environmental controller 502, according to some embodiments. Furthermore, the sensor controller 528 operating at the high power level may instruct the main radio 534 operating at the high power level to communicate the packaged environmental data to the controller radio 514 via data communication channel 518.

Figure 6:
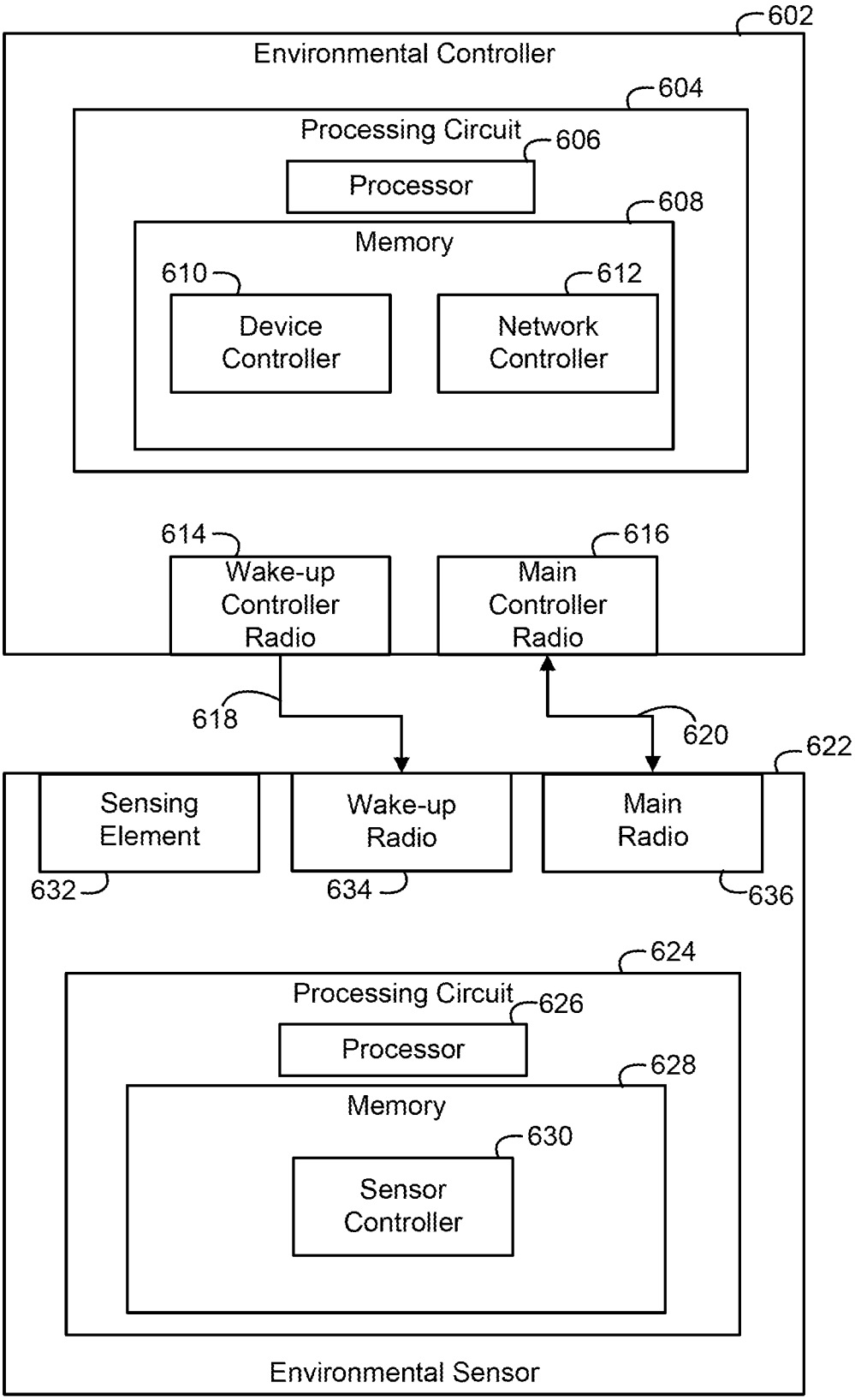
FIG. 6 is a block diagram of the communication shown in FIG. 5 wherein a controller radio of the environmental controller includes a wake-up controller radio and a main controller radio, according to an exemplary embodiment.

Referring now to FIG. 6, an environmental controller 602 and an environmental sensor 622 are shown connected by a wake-up communication channel 618 and a data communication channel 620, according to an exemplary embodiment. The wake-up communication channel 618 may be similar and/or the same as wake-up communication channel 516 as described with reference to FIG. 5, and the data communication channel 620 may be similar and/or the same as data communication channel 518 as described with reference to FIG. 5, according to some embodiments. Furthermore, the environmental sensor 622 may be similar and/or the same as environmental sensor 520 as described with reference to FIG. 5, according to some embodiments.

Environmental controller 602 is shown in greater detail in regards to the environmental controller 502 of FIG. 5, wherein the controller radio 514 of the environmental controller 502 of FIG. 5 is shown to include a wake-up controller radio 614 and a main controller radio 616, according to some embodiments. In the environmental controller 602, there exists a processing circuit 604, wherein processing circuit 604 includes a processor 606 and a memory 608. Processor 606 can be implemented as a general-purpose processor, an application specific integrated circuit (ASIC), one or more field programmable gate arrays (FPGAs), a group of processing components, or other suitable electronic processing components.

Memory 608 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 608 may be or include volatile memory or non-volatile memory. Memory 608 may include database components, object code components, script components, or any other type of information structure for supporting the various activities and information structures described in the present application. According to some embodiments, memory 608 may be communicably connected to processor 606 via processing circuit 604 and includes computer code for executing (e.g., by processing circuit 604 and/or processor 606) one or more processes described herein.

Memory 608 is shown to include a device controller 610 and a network controller 612, according to some embodiments. Network controller 612 may be similar to and/or the same as the network controller 512 as described with reference to FIG. 5, according to some embodiments. In some embodiments, device controller 610 may be configured to make determinations on which environmental sensors from a set of environmental sensors should be woken up. In some embodiments, device controller 610 may manage the communication of wake-up messages via the wake-up controller radio 614 to environmental sensors it determines should be woken up. In some embodiments, device controller 610 may manage the reception of environmental data communicated by environmental sensors via the main controller radio 616. In some embodiments, device controller 610 may be configured to parse received environmental sensor data and communicate the parsed environmental sensor data to the network controller 612.

In some embodiments, wake-up controller radio 614 may be configured to communicate a wake-up message to a wake-up radio 634 of the environmental sensor 622 via wake-up communication channel 618. In some embodiments, the main controller radio 616 may be configured to receive environmental sensor data from a main radio 636 of the environmental sensor 622 where the environmental sensor data may be similar to the environmental sensor data as described in reference to FIG. 5.

In some embodiments, wake-up controller radio 614 may be a transmitter-only radio. In such an embodiment, wake-up controller radio 614 only includes the processing circuitry to transmit signals and not receive signals. This may allow wake-up controller radio 614 to be designed in a less complex manner (e.g., compared to a transceiver radio) and reduce overall power usage in controller 602.

In some embodiments, wake-up radio 634 may be configured to receive a wake-up message from wake-up controller radio 614 via wake-up communication channel 618. In response to receiving the wake-up message, environmental sensor 622 may operate the main radio 636 and/or other components of the environmental sensor 622 at a high power level.

In some embodiments, wake-up radio 634 may be a receiver-only radio. A receiver-only wake-up radio 634 may only be configured to receive signals (e.g., signals from controller radio 602). This may allow the radio to be less complex than a traditional transceiver radio. Environmental sensor 622 may, after providing environmental data to environmental controller 602 via main radio 622, enter into a low-power mode to conserve energy. Wake-up radio 634 may remain on to receive a signal that instructs environmental sensor 622 to exit low-power mode and to return to a mode of normal operation. Advantageously, wake-up radio 634 may only be designed to act as a receiver and to not include any transmitting capabilities, thus requiring less overall power to operate wake-up radio 634.

FIG. 6 differs from FIG. 5 in that the communication channels are either directed towards the same radio in an environmental controller as is the case in FIG. 5, or are directed towards two separate radios in an environmental controller as is the case in FIG. 6. For an example, the environmental controller 602 may determine it requires lighting data for a room. In response to the determination that lighting data may be required, the environmental controller 602 may be configured to communicate a wake-up message via the wake-up controller radio 614 to an environmental sensor configured to gather lighting data. After the wake-up message is received by the environmental sensor and lighting data is being gathered, the environmental controller 602 may then receive lighting data from the environmental sensor via the main controller radio 616. In the case of FIG. 5, the controller radio 514 may have communicated the wake-up message and gathered the environmental data, but in FIG. 6 separate devices within the environmental controller 602 may handle the separate functions.

Figure 7:
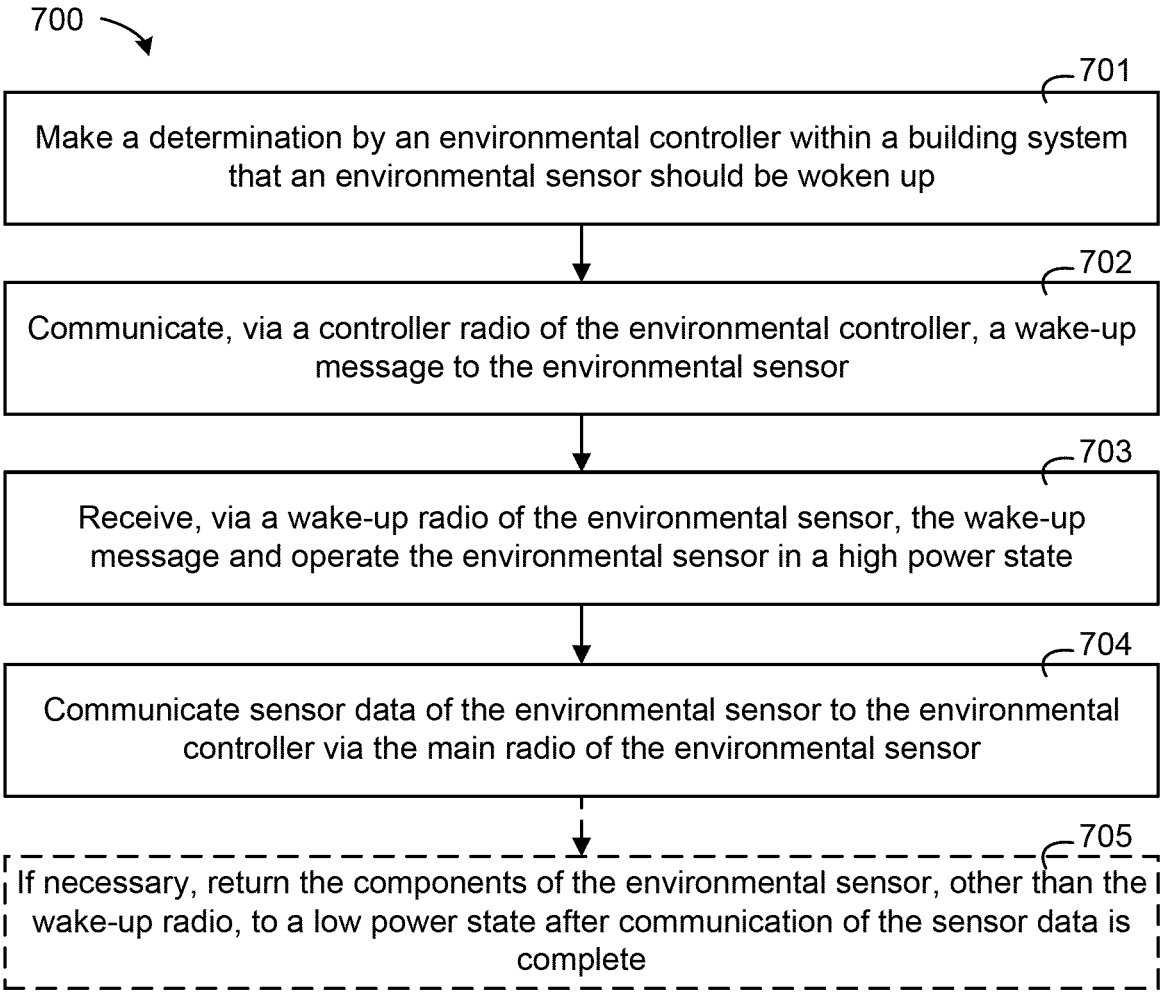
FIG. 7 is a flow diagram of a process of communication of a wake-up message from an environmental controller to an environmental sensor to operate the environmental sensor at a high power state that can be performed by the environmental controller of FIG. 4 and one of the one or more environmental sensors of FIG. 1, according to an exemplary embodiment.

Referring now to FIG. 7, a process 700 of the communication of a wake-up message from an environmental controller to an environmental sensor in order to operate the environmental sensor at a high power state is shown, according to an exemplary embodiments. In some embodiments, the environmental controller 401 and the environmental sensor 406 of FIG. 4 may be configured to perform some and/or all of the steps of process 700.

In step 701, the environmental controller can make a determination that the environmental sensor should be awoken to operate in a high power state. In some embodiments, the determination that the environmental sensor should be awoken may be made due to the environmental controller requiring environmental sensor data from the environmental sensor for use in performing an audit of environmental conditions, a user prompting the environmental controller to retrieve environmental data regarding one or more environmental conditions, periodically saving environmental data to a database, etc. In some embodiments, the determination that the wake-up message should be sent may be made periodically based on predetermined settings. In some embodiments, the determination that the wake-up message should be sent may be singular in that the determination may be in response to a one-time event occurring such as a user querying for environmental data, an emergency being determined by a building system, etc.

In step 702, the environmental controller may communicate the wake-up message via a controller radio, according to some embodiments. This communication may occur in response to the determination made at 701. In some embodiments, the wake-up message may be a specialized communication message sent via the controller radio to bring the environmental sensor operating at a low power state to a high power state. In order to conserve power in a building system, the environmental sensor may be configured to operate at the low power state where some and/or all of the components of the environmental sensor receive no power, according to some embodiments. In some embodiments, some and/or all of the components of the environmental sensor in a low power state may receive limited amounts of power that result in the environmental sensor not operating with full functionality. In some embodiments, the wake-up radio of the environmental sensor may receive enough power some and/or all times to be able to receive the wake-up message sent by the controller radio. According to some embodiments, when the environmental sensor is operating at the high power state, some and/or all of the components of the environmental sensor may receive enough power so the environmental sensor can operate at full functionality, where full functionality indicates the environmental sensor can gather and package environmental data, communicate environmental data to the environmental controller, etc. For an example, an environmental sensor operating in the low power state configured to gather and communicate data regarding temperature in a room may only be able to gather temperature data, but not communicate the temperature data. However, the same environmental sensor operating in the high power state may be able to both gather temperature data and communicate the temperature data to the environmental controller.

In step 703, the environmental sensor may initially be operating in the low power state, according to some embodiments. At some point in time after the environmental controller communicates the wake-up message in step 702, the environmental sensor may receive the wake-up message. In response to the reception of the wake-up message, the environmental sensor may operate its components, including a main radio, in the high power state as described in step 702. Once operating at the high power state, the environmental sensor may be configured to gather environmental data via a sensing element and begin to package the data in a way the environmental controller can recognize, according to some embodiments. In some embodiments, the environmental sensor may wait for further instructions from the environmental controller before performing any actions while in the high power state.

In step 704, once operating in the high power state, the environmental sensor may be able to communicate the environmental sensor data packaged in step 703 to the environmental controller via the main radio, according to some embodiments. This communication of environmental sensor data can continue to occur until the environmental controller determines it has gathered the required data from the environmental sensor, according to some embodiments. In some embodiments, the environmental controller can determine it may need environmental data from the environmental sensor for an indefinite amount of time and notify the environmental sensor to operate at the high power state until another determination is made. In step 704, the environmental sensor operating at a high power state may execute other operations other than gathering, packaging, and communicating environmental sensor data as instructed by the environmental controller, according to some embodiments. In some embodiments, any operation of the environmental sensor that can occur while the environmental sensor is operating at a high power level may occur in step 704.

In step 705, an optional step in process 700, the environmental sensor may return some and/or all of its components to the low power state once the communication of sensor data is complete. Step 705 can further conserve power in the building system 400 by not allowing environmental sensors to be idle while in the high power state. In some embodiments, once the communication of sensor data is complete, the environmental sensor may have no other operations to perform, thus operation in the high power state may be a waste of power. For example, an environmental sensor configured to sense the temperature in a room may be able to immediately return to the low power state after transmitting sensor data in the high power state as a single communication of sensor data with temperature may be all that is needed by an environmental controller.

Figure 8:
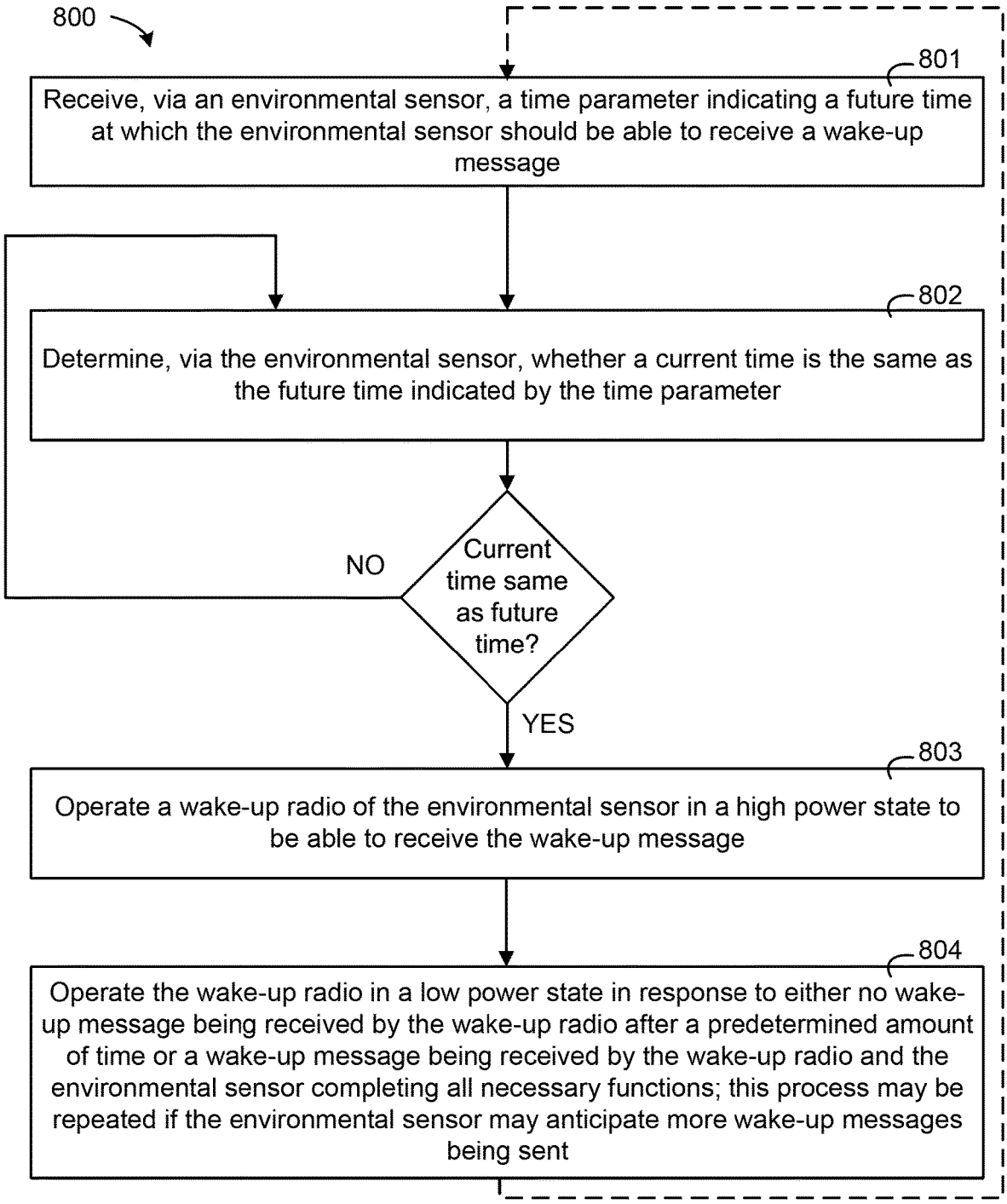
FIG. 8 is a flow diagram of a process of operating a wake-up radio of an environmental sensor in a high power state based on a provided time parameter that can be performed any of the environmental sensors of FIG. 4, according to an exemplary embodiment.

Referring now to FIG. 8, a process 800 for operating a wake-up radio of an environmental sensor in a high power state based on a provided time parameter is shown, according to an exemplary embodiment. In some embodiments, the environmental controller 401 and the environmental sensor 406 of FIG. 4 may be configured to perform some and/or all of the steps of process 800.

In step 801, the environmental sensor may receive a time parameter indicating a future time at which the environmental sensor should operate the wake-up radio in the high power state. When the environmental sensor is operating at a high power state, it may have some and/or all of the capabilities of the environmental sensor operating at the high power state as described in reference to FIG. 7. The time parameter may be received by the environmental sensor when the environmental sensor is operating at the high power state and can receive communication, according to some embodiments. In some embodiments, the time parameter may be communicated by an environmental controller. In some embodiments, the time parameter can be manually programmed into the environmental sensor.

In step 802, the environmental sensor may make a determination if the indicated future time is a current time. This determination may be made by a low power circuit of the environmental sensor that has an ability to track the current time and make a comparison if the indicated future time of the time parameter is the same as the current time, according to some embodiments. If the determination is that the current time is not the indicated future time, the environmental sensor may repeat the step 802, according to some embodiments. In some embodiments, the comparison can continue to be run by the low power circuit until the current time is the same as the indicated future time. Even though the low power circuit may make many comparisons between the current time and the indicated future time, the power consumed by the low power circuit can still be less than the wake-up radio continuously operating at a power state where it can receive a wake-up message, according to some embodiments. If the determination is that the current time is the future time, process 800 may continue to step 803, according to some embodiments.

In step 803, the environmental sensor may operate the wake-up radio in the high power state in response to the determination made in step 802 that the current time is the indicated future time, according to some embodiments. When operating at the high power state, the wake-up radio may be able to receive the wake-up message communicated by the environmental controller, according to some embodiments. In some embodiments, when the wake-up radio is operating in the high power state, the wake-up radio may only be able receive the wake-up message and operate the environmental sensor in the high power state if the wake-up message is received.

In step 804, the environmental sensor may operate the wake-up radio in a low power state if no wake-up message is received after a predetermined time period, according to some embodiments. In some embodiments, the environmental sensor may operate the wake-up radio in the low power state if the wake-up message is received and the environmental sensor has completed all necessary functions as determined by the environmental controller, such as communicating environmental sensor data to the environmental controller. Once the wake-up radio of the environmental sensor is operating at the low power state, process 800 may repeat starting in step 801. In some embodiments, process 800 may repeat if another time parameter is received by the environmental sensor and/or the environmental sensor and/or the environmental controller expect the environmental sensor to operate at the high power state at some future time.

Process 800 may further reduce power consumption of a building system by operating the wake-up radio of an environmental sensor only at particular times based on provided time parameters. As the wake-up radio may spend at least some portion of its operation in a low power state, it may be inevitable that less power will be used by the system overall. Further considering that the environmental sensor may be one of many in a set of environmental sensors, power consumption may drastically drop over the building system.

Figure 9:
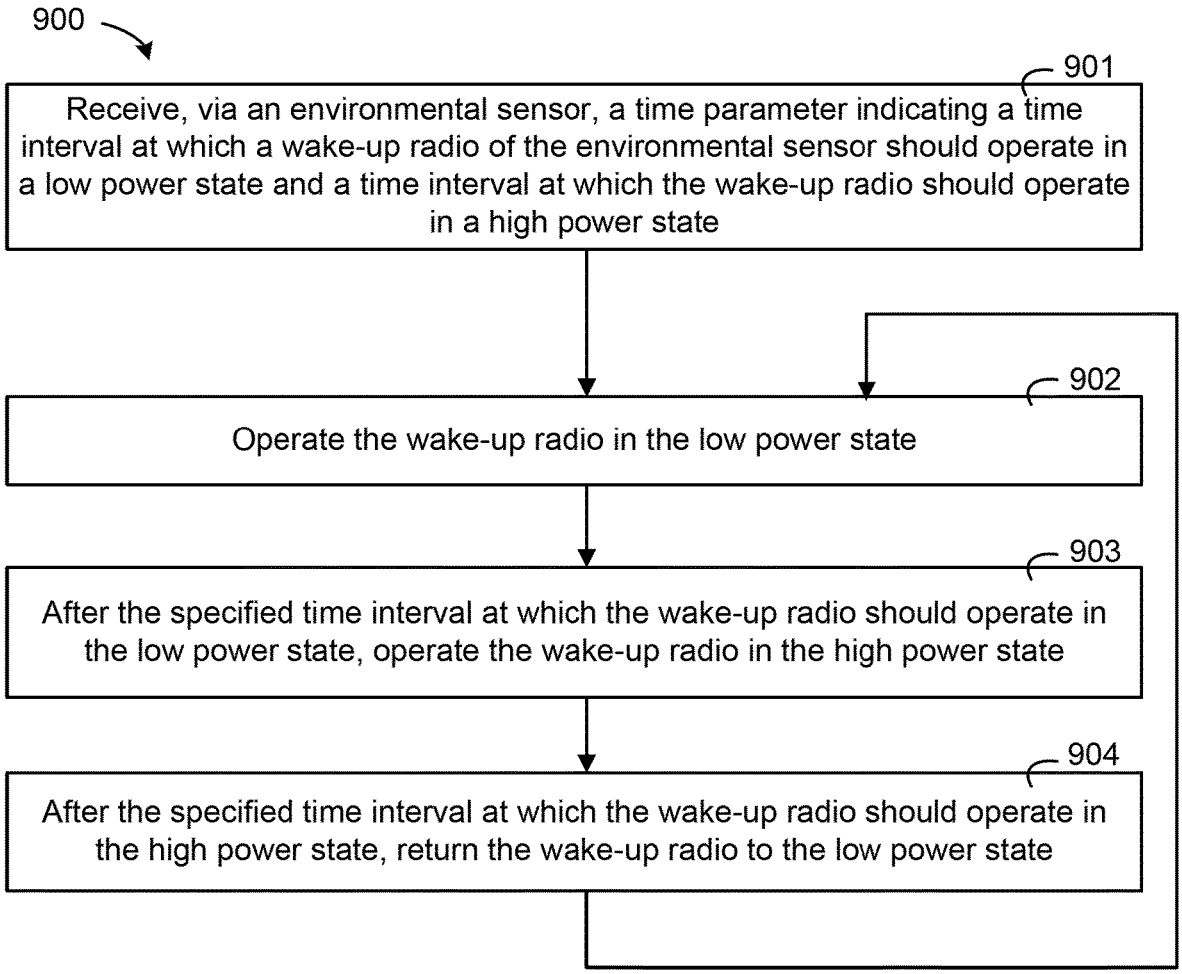
FIG. 9 is a flow diagram of a process that can be performed by an environmental sensor to operate a wake-up radio in a low power state and a high power state based on a time interval(s) of a time parameter, according to an exemplary embodiment.

Referring now to FIG. 9, a process 900 for operating a wake-up radio of an environmental sensor at a high power state during time intervals specified in a time parameter is shown, according to an exemplary embodiment. In some embodiments, the environmental controller 401 and the environmental sensor 406 of FIG. 4 may be configured to perform some and/or all of the steps of process 900.

In step 901, the environmental sensor may receive the time parameter. In some embodiments, the time parameter may be communicated by an environmental controller. In some embodiments, the time parameter can be manually configured into the environmental sensor. In some embodiments, the time parameter may include a high time interval where the environmental sensor should operate the wake-up radio in the high power state, and a low time interval which indicates an amount of time the environmental sensor should operate the wake-up radio in a low power state. In some embodiments, the high time interval and the low time interval are different amounts of time where the high time interval may be shorter than the low time interval. For an example, the low time interval may be longer than the high time interval for an environmental sensor configured to measure temperature. Temperature data measured by the environmental sensor may not be needed frequently by the environmental controller to adjust room temperature, so the environmental sensor can operate for more time in the low power state. In some embodiments, the low time interval can be shorter than the high time interval. For an example, the low time interval may be shorter than the high time interval in the case of an environmental sensor configured to measure toxic gas in a room as measurements may be more frequently required by the environmental controller to ensure safety, so the environmental sensor operates for more time in the high power state. In some embodiments, the time parameter can include a single time interval which indicates the environmental sensor should operate the wake-up radio in the low power state and the high power state for the same amount of time.

In step 902, some and/or all of the components of the environmental sensor may be operated in the low power state to conserve energy usage. When the components of the environmental sensor are operated in the low power state, the environmental sensor may operate similarly and/or the same as the environmental sensor operating in the low power state as described in reference to FIG. 7, according to some embodiments. In some embodiments, a low power circuit similar and/or the same as the low power circuit described with reference to FIG. 8 may continue operation to track a current time and make comparisons between the current time and a future time. These comparisons can determine if an amount of time has passed as indicated by the time interval(s) where the wake-up radio of the environmental sensor may need to alternate between the high power state to the low power state, or the low power state to the high power state, according to some embodiments.

In step 903, the low power circuit may make a determination that the wake-up radio has operated in the low power state for the amount of time specified by the low time interval or the single time interval, according to various embodiments. In response to the determination that the wake-up radio has operated for the specified amount of time in the low power state, the wake-up radio can operate in the high power state, according to some embodiments. The wake-up radio operating in the high power state may be similar and/or the same as the wake-up radio operating in the high power state as described with reference to FIG. 8, according to some embodiments.

In step 904, the low power circuit may make a determination that the wake-up radio has operated in the high power state for the amount of time specified by the high time interval or the single time interval, according to various embodiments. In response to the determination that the wake-up radio has operated for the specified amount of time in the high power state, the wake-up radio can operate in the low power state, according to some embodiments. The wake-up radio operating in the low power state may not receive the amount of power necessary to be able to receive the wake-up message from the environmental controller, according to some embodiments. In some embodiments, once the wake-up radio is operating in the low power state, process 900 may return to step 902 where the low power circuit can continue to make determinations to switch the wake-up radio between the high power state and the low power state.

Figure 10:
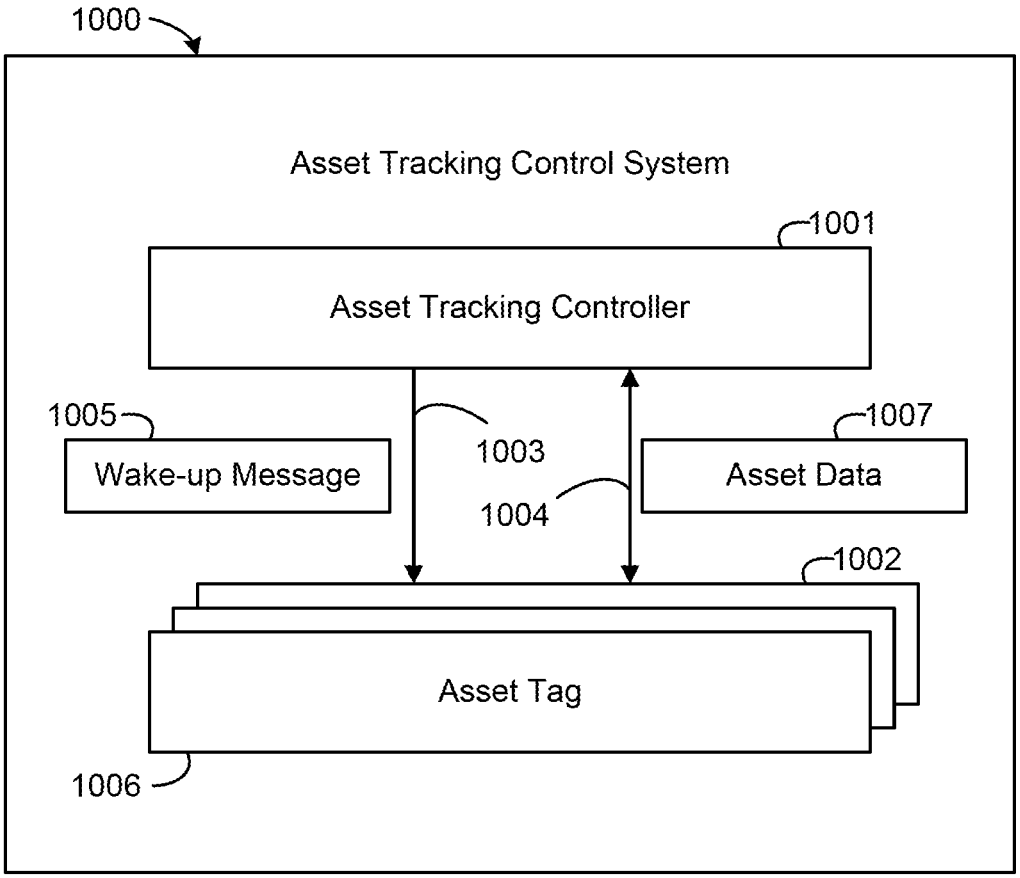
FIG. 10 is a block diagram of an asset tracking control system including an asset tracking controller and one or more asset tags, according to an exemplary embodiment.

Referring now to FIG. 10, an asset tracking control system 1000 is shown, according to an exemplary embodiment. The asset tracking control system 1000 is shown to include an asset tracking controller 1001 and a set of asset tags 1002 to which an asset tag 1006 belongs. From here forward, the asset tag 1006 may act as an exemplary embodiment of how all other asset tags in the set of asset tags 1002 may operate. In some embodiments, asset tag 1006 may be unique in its operation or may be the same in its operation in regards to the other asset tags in the set of asset tags 1002. Asset tags may be used in settings where expensive assets need to be tracked in order to know where they are located within the setting. Examples of settings an asset tracking control system may be implemented include hospitals, factories, laboratories, or other environments where expensive assets and/or equipment may be located. Asset tags may be used in conjunction with expensive asset and/or equipment such as portable X-ray machines in hospitals, incubators in laboratories, and/or robotic arms in factories, according to some embodiments. In some embodiments, asset tags may be used to track any equipment that should be able to be located if lost. The set of asset tags 1002 can include one or more asset tags that may be configured to communicate data about an asset (e.g. location, acceleration, etc.). In the asset tracking control system 1000, the asset tracking controller 1001 may be configured to manage and/or gather data from the set of asset tags 1002 via one or more communication channels. A wake-up communication channel 1003 similar to and/or the same as the wake-up communication channel 403 as described with reference to FIG. 4, and a data communication channel 1004 similar to and/or the same as the data communication channel 404 as described with reference to FIG. 4 are shown, according to some embodiments. In this regard, the asset tracking controller 1001 and the set of asset tags 1002 can include the hardware and/or software to make the wake-up communication channel 1003 and the data communication channel 1004 possible.

The power consumption in asset tracking control system 1000 can be high if one or more of the asset tags are always operating in a high power state even if they are not actively transmitting asset data. In an asset tracking control system wherein wake-up radio features are not used, all asset tags may constantly be in a high power state, even if there are long periods of time where data communication need not occur. For example, an asset tag on a portable X-ray that spends long periods of time in one room of a hospital may not need to frequently communicate asset data. Similarly, in a case where a building's asset tracking controller is disabled, there may be no need for the entire set asset tags to be in a high power state if they do not have the ability to communicate in the first place.

In some embodiments, the components of the asset tag 1006 can operate in a low power state until a wake-up message 1005 may be transmitted via wake-up communication channel 1003. In some embodiments, when asset tag 1006 is operating in a low power state, some and/or all of the components of the asset tag 1006 may have no power. When no power is being provided to a component, the component cannot perform any operations. In some embodiments, when asset tag 1006 is operating in the low power state, some and/or all of the components of asset tag 1006 may be receiving minimal amounts of power. While receiving minimal amounts of power, the components of asset tag 1006 may be able to perform limited operations, but not all the operations they could if receiving a full amount of power. For example, an asset tag controller of asset tag 1006 operating with minimal power may be able to gather accelerometer data, but not be able to instruct a main radio of the asset tag 1006 to communicate asset data, according to some embodiments. Once the wake-up message 1005 is received by the asset tag 1006, asset tag 1006 can operate in a high power state. In some embodiments, when asset tag 1006 is operating in the high power state, some and/or all of the components of asset tag 1006 may receive the full amount of power required to perform all operations of the component. In some embodiments, the asset tag 1006 can communicate an asset data 1007 to the asset tracking controller 1001 while in the high power state. Once the communication of asset data 1007 is complete, the asset tag 1006 can return to operation in the low power state until another wake-up message 1005 is received, according to some embodiments.

Figure 11:
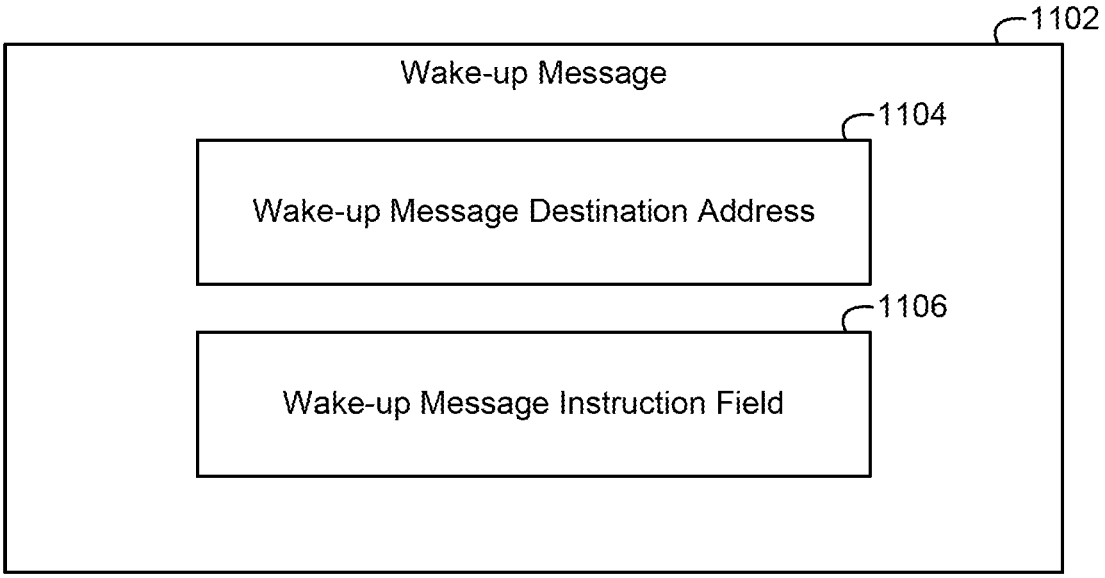
FIG. 11 is a block diagram of the wake-up message that may be communicated from the asset tracking controller to the asset tag of FIG. 10, according to an exemplary embodiment.

Referring now to FIG. 11, a wake-up message 1102 is shown, according to an exemplary embodiment. Wake-up message 1102 may be similar to and/or the same as the wake-up message 1005 described with reference to FIG. 10, according to some embodiments. Wake-up message 1102 is shown to include a wake-up message destination address 1104 and a wake-up message instruction field 1106. Wake-up message destination address 1104 may be configured to designate the address of a particular asset tag in the set of asset tags 1002 that the wake-up message 1102 is directed towards, according to some embodiments. For example, the wake-up message destination address 1104 may include an internet protocol (IP) address associated with the particular asset tag. In another example, the wake-up message destination address 1104 may include an address associated with the particular asset tag within an internal building network.

The wake-up message instruction field 1106 of the wake-up message 1102 may be configured to include instructions for the particular asset tag to execute, according to some embodiments. For example, the wake-up message instruction field 1106 may include an instruction that is configured to cause the particular asset tag to transmit asset data. In another example, the wake-up message instruction field 1106 may include an instruction that is configured to cause the particular asset tag to power off all components of the particular asset tag.

Wake-up message 1102 is shown in further detail in regards to the wake-up message 1005 described with reference to FIG. 10, according to an exemplary embodiment. In some embodiments, wake-up message 1102 may be similar to and/or the same as any wake-up message communicated from the asset tracking controller 1001 to any of the asset tags in the set of asset tags 1002.

Figure 12:
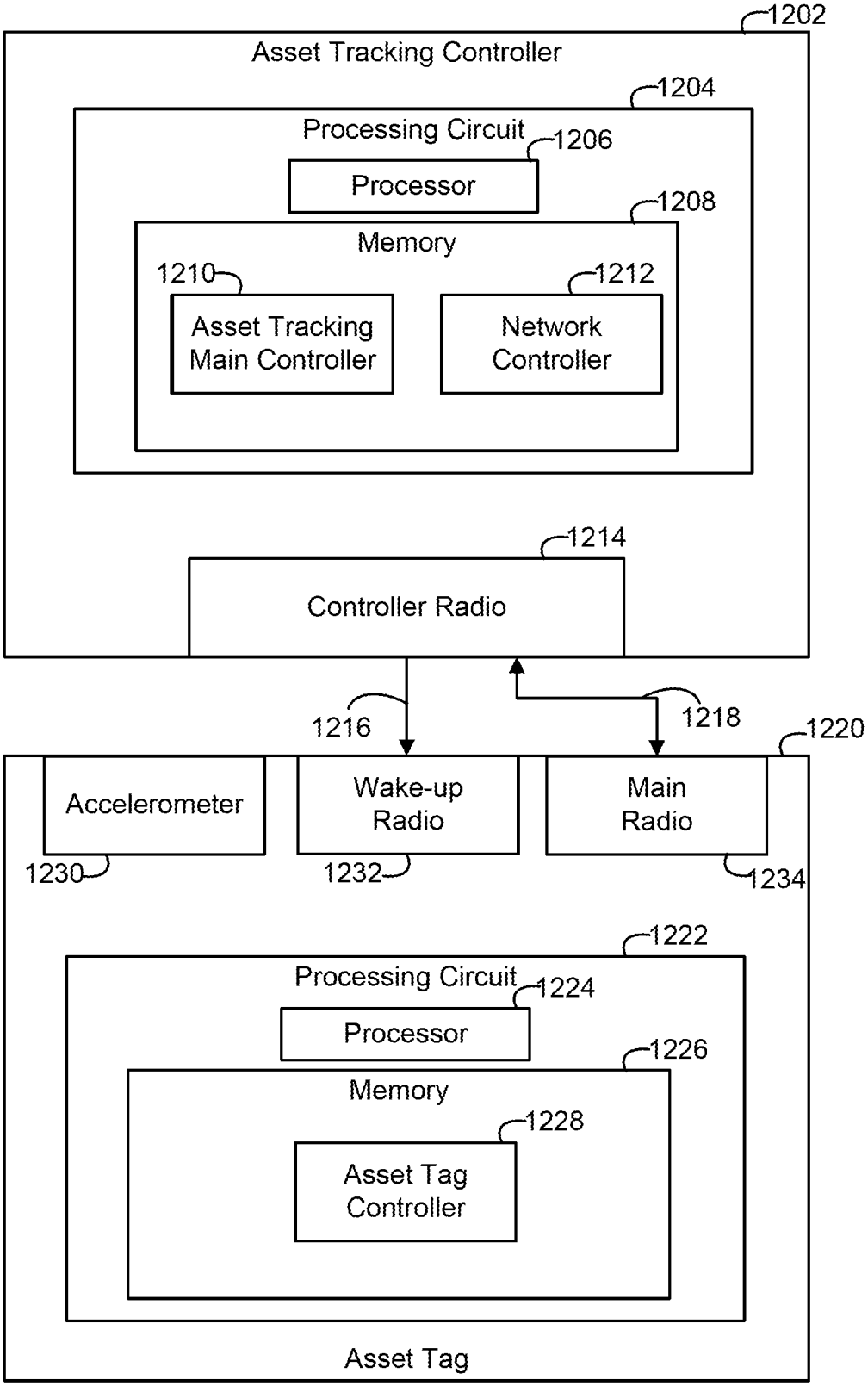
FIG. 12 is a block diagram of the communication of a wake-up message and asset data between the asset tag and the asset tracking controller of FIG. 10, according to an exemplary embodiment.

Referring now to FIG. 12, an asset tracking controller 1202 is shown in greater detail in regards to asset tracking controller 1001 of FIG. 10, according to some embodiments. In some embodiments, the asset tracking controller 1202 may be configured to track one or more asset tags within asset tracking control system 1000, aggregate asset data, store asset data in a database, provide feedback to users regarding the location and/or other information regarding asset tags, and/or operate other supervisory operations of the asset tracking control system 1000.

In some embodiments, asset tracking controller 1202 includes a processing circuit 1204, wherein processing circuit 1204 includes a processor 1206 and/or a memory 1208. Processor 1206 can be implemented as a general-purpose processor, an application specific integrated circuit (ASIC), one or more field programmable gate arrays (FPGAs), a group of processing components, or other suitable electronic processing components.

Memory 1208 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 1208 may be or include volatile memory or non-volatile memory. Memory 1208 may include database components, object code components, script components, or any other type of information structure for supporting the various activities and information structures described in the present application. According to some embodiments, memory 1208 may be communicably connected to processor 1206 via processing circuit 1204 and includes computer code for executing (e.g., by processing circuit 1204 and/or processor 1206) one or more processes described herein.

Still referring to FIG. 12, memory 1208 is shown to include an asset tracking main controller 1210 and a network controller 1212, according to some embodiments. Network controller 1212 may facilitate communication of the asset tracking controller 1202 over one or more networks (e.g. internal building networks, an IP based network, etc.). This communication over the one or more networks may allow the asset tracking controller 1202 to receive network data, according to some embodiments. The network data can include instructions to perform an audit of all asset tags within the asset tracking control system 1000, software updates, information on new varieties of asset tags to be used in the system, etc., according to some embodiments. In some embodiments, the one or more networks can allow the asset tracking controller 1202 to communicate asset data and/or other information. In some embodiments, asset tracking main controller 1210 may be configured to parse asset data and/or make determinations on which asset tag(s) from a set of asset tags should be woken up. In some embodiments, the asset tracking main controller 1210 can provide asset data and/or other information to the network controller 1212 to be distributed over the one or more networks.

Asset tracking controller 1202 is also shown to include a controller radio 1214, according to some embodiments. Controller radio 1214 can be configured to communicate a wake-up message to an asset tag via a wake-up communication channel 1216 in response to a determination that the asset tag should be operating in a high power state similar to the asset tag operating in the high power state as described in reference to FIG. 10. In some embodiments, controller radio 1214 may be configured to receive asset data from an asset tag via a data communication channel 1218. For example, the asset tracking controller 1202 may make a determination that it requires asset data from asset tag 1220 after a database failure where the location of asset tag 1220 was lost. In response to the determination, the asset tracking controller 1202 can operate the controller radio 1214 to send a wake-up message to the asset tag 1220 to operate the asset tag 1220 at the high power state. Once operating in the high power state, the asset tag 1220 may communicate asset data, including the location of the asset tag 1220, to the controller radio 1214. After receiving the asset data, the asset tracking controller 1202 can resolve the database failure.

Still referring to FIG. 12, the asset tag 1220 is shown in greater detail in regards to the asset tag 1006 of FIG. 10, according to some embodiments. Asset tag 1220 is shown to include a processing circuit 1222, wherein processing circuit 1222 includes a processor 1224 and a memory 1226. Processor 1224 can be implemented as a general-purpose processor, an application specific integrated circuit (ASIC), one or more field programmable gate arrays (FPGAs), a group of processing components, or other suitable electronic processing components.

Memory 1226 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 1226 may be or include volatile memory or non-volatile memory. Memory 1226 may include database components, object code components, script components, or any other type of information structure for supporting the various activities and information structures described in the present application. According to some embodiments, memory 1226 may be communicably connected to processor 1224 via processing circuit 1222 and includes computer code for executing (e.g., by processing circuit 1222 and/or processor 1224) one or more processes described herein.

Memory 1226 is shown to include an asset tag controller 1228, according to some embodiments. Asset tag controller 1228 may be configured to gather asset data, operate a main radio 1234 in a high power state in response to receiving a wake-up message via a wake-up radio 1232, and/or instruct the main radio 1234 to communicate asset data to asset tracking controller 1202, according to some embodiments. Asset tag controller 1228 may be configured to operate an accelerometer 1230, according to some embodiments. When accelerometer 1230 detects movement of the asset tag, accelerometer 1230 may operate the asset tag 1220 in the high power level in order to communicate asset data to the asset tracking controller 1202 via a main radio 1234. In some embodiments, this detection of movement by accelerometer 1230 can result in communication of asset data whether or not a wake-up message has been received by the wake-up radio 1232. This operation by the accelerometer 1230 can assist in immediately alerting the asset tracking controller 1202 that the asset tag 1220 may be moving, according to some embodiments. In some embodiments, the accelerometer 1230 operating the asset tag 1220 in the high power state to communicate asset data may be particularly helpful in case a wake-up message may not be sent by the asset tracking controller 1202 for some amount of time. This may ensure asset location data may be kept accurate throughout the asset tracking control system 1000.

Still referring to FIG. 12, the asset tracking controller 1202 and the asset tag 1220 are shown connected by the wake-up communication channel 1216 and the data communication channel 1218, according to some embodiments. Wake-up communication channel 1216 may be similar and/or the same as wake-up communication channel 1003 as described in reference to FIG. 10, according to some embodiments. Data communication channel 1218 may be similar and/or the same as data communication channel 1004 as described with reference to FIG. 10, according to some embodiments.

Wake-up radio 1232 may be configured to receive a wake-up message from controller radio 1214 via wake-up communication channel 1216, according to some embodiments. In response to receiving the wake-up message, asset tag 1220 may operate some and/or all of its components in a high power state. In some embodiments, the wake-up radio 1232 may always be operating in a high power state in order to be able to receive and process the wake-up message. In response to operation in the high power state, asset tag 1220 may prepare asset data (e.g., asset location, asset acceleration, etc.) to communicate to the asset tracking controller 1202, according to some embodiments. In some embodiments, the asset tag controller 1228 operating at the high power level may be configured as to operate the main radio 1234 to communicate the asset data to the controller radio 1214 via data communication channel 1218.

Figure 13:
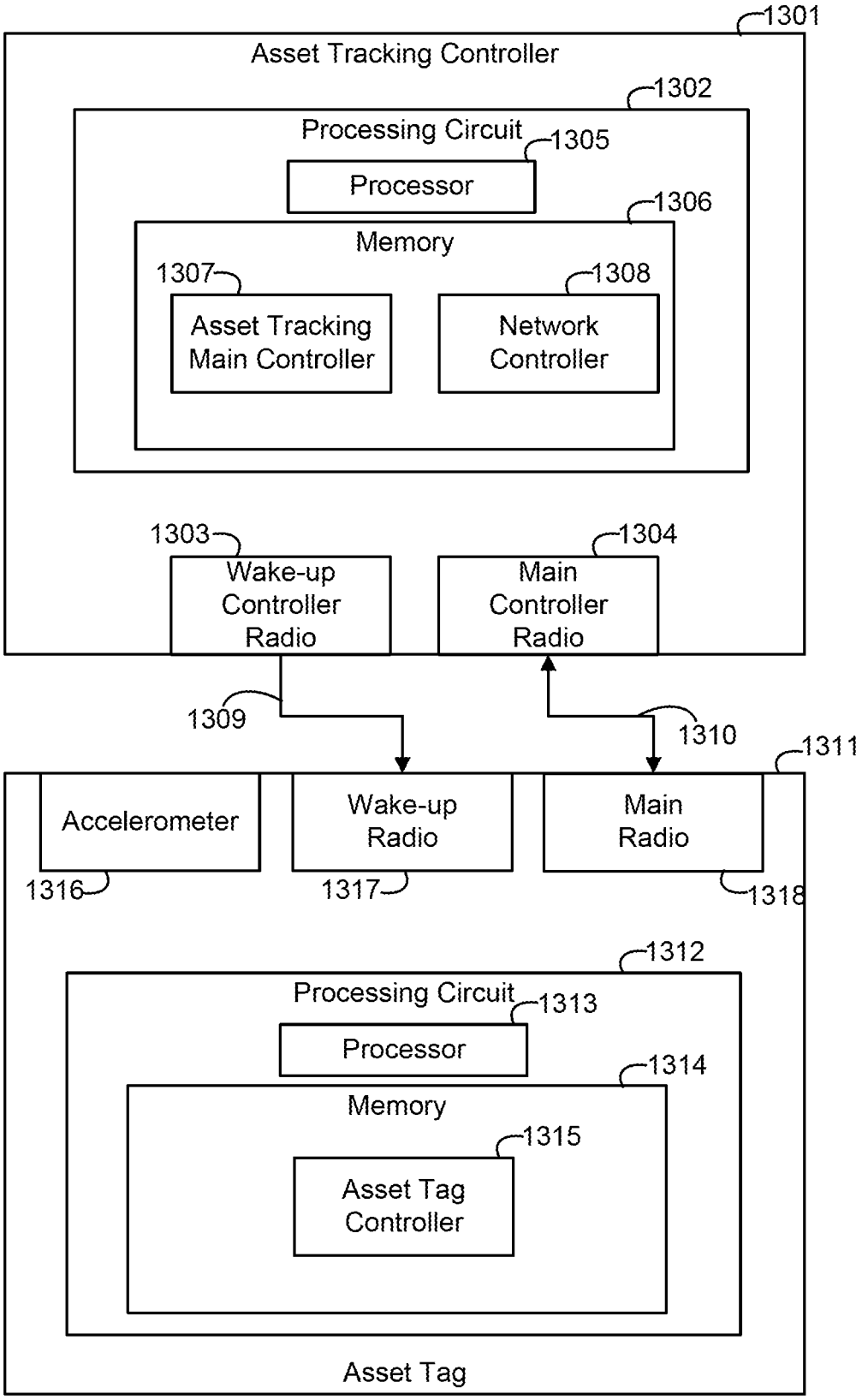
FIG. 13 is a block diagram of the communication of a wake-up message and asset data between the asset tag and the asset tracking controller of FIG. 10 wherein the asset tracking controller includes a wake-up controller radio and a main controller radio, according to an exemplary embodiment.

Referring now to FIG. 13, the asset tracking controller 1202 of FIG. 12 is shown as an asset tracking controller 1301 wherein controller radio 1214 includes a wake-up controller radio 1303 and a main controller radio 1304, according to some embodiments. In the asset tracking controller 1301, there exists a processing circuit 1302, wherein processing circuit 1302 includes a processor 1305 and a memory 1306. Processor 1305 may be similar and/or the same as processor 1206 of FIG. 12, according to some embodiments. Memory 1306 may be similar and/or the same as memory 1208 of FIG. 12, according to some embodiments.

Memory 1306 is shown to include an asset tracking main controller 1307 and a network controller 1308, according to some embodiments. Network controller 1308 may be similar to and/or the same as the network controller 1212 of FIG. 12, according to some embodiments. In some embodiments, asset tracking main controller 1307 may be configured to make determinations on which asset tag(s) from a set of asset tags should be woken up. In some embodiments, asset tracking main controller 1307 may be configured to communicate wake-up messages via the wake-up controller radio 1303 to asset tags the asset tracking main controller 1307 determines should be woken up. In some embodiments, asset tracking main controller 1307 may be configured to parse asset data and/or communicate asset data to the network controller 1308 to be communicated to one or more networks.

In some embodiments, wake-up controller radio 1303 may be configured to communicate a wake-up message to a wake-up radio 1317 of an asset tag 1311 via a wake-up communication channel 1309 where wake-up communication channel 1309 may be similar to and/or the same as wake-up communication channel 1216 described with reference to FIG. 12. Asset tag 1311 may be similar and/or the same as asset tag 1220 described in reference to FIG. 12, according to some embodiments. In some embodiments, the main controller radio 1304 may be configured to receive asset data from a main radio 1318 of the asset tag via a data communication channel 1310 similar to and/or the same as the data communication channel 1218 described in reference to FIG. 12.

Still referring to FIG. 13, asset tracking controller 1301 of FIG. 13 and asset tag 1311 are shown connected by the wake-up communication channel 1309 and the data communication channel 1310, according to some embodiments. In some embodiments, wake-up radio 1317 may be configured to receive a wake-up message from the wake-up controller radio 1303 via wake-up communication channel 1309. In response to receiving the wake-up message, asset tag 1311 may operate the main radio 1318 in a high power state. Likewise, when main radio 1318 is operating in the high power state, main radio 1318 may be able to communicate asset data about the asset tag 1311 via data communication channel 1310 to main controller radio 1304, according to some embodiments.

FIG. 13 differs from FIG. 12 in that the communication channels are either directed towards the same radio in the asset tracking controller as may be the case in FIG. 12, or are directed towards two separate radios in the asset tracking controller as may be the case in FIG. 13. For an example, the asset tracking controller 1202 described with reference to FIG. 12 can communicate a wake-up message to an asset tag including asset data regarding the location of a vehicle in the asset tracking control system 1000 via controller radio 1214 and receive the asset data through the same controller radio 1214. However, the asset tracking controller 1301 described with reference to FIG. 13 can communicate a wake-up message to the asset tag via wake-up controller radio 1303 and receive the asset data via main controller radio 1304, thus distributing the workload across multiple components of asset tracking controller 1301.

Figure 14:
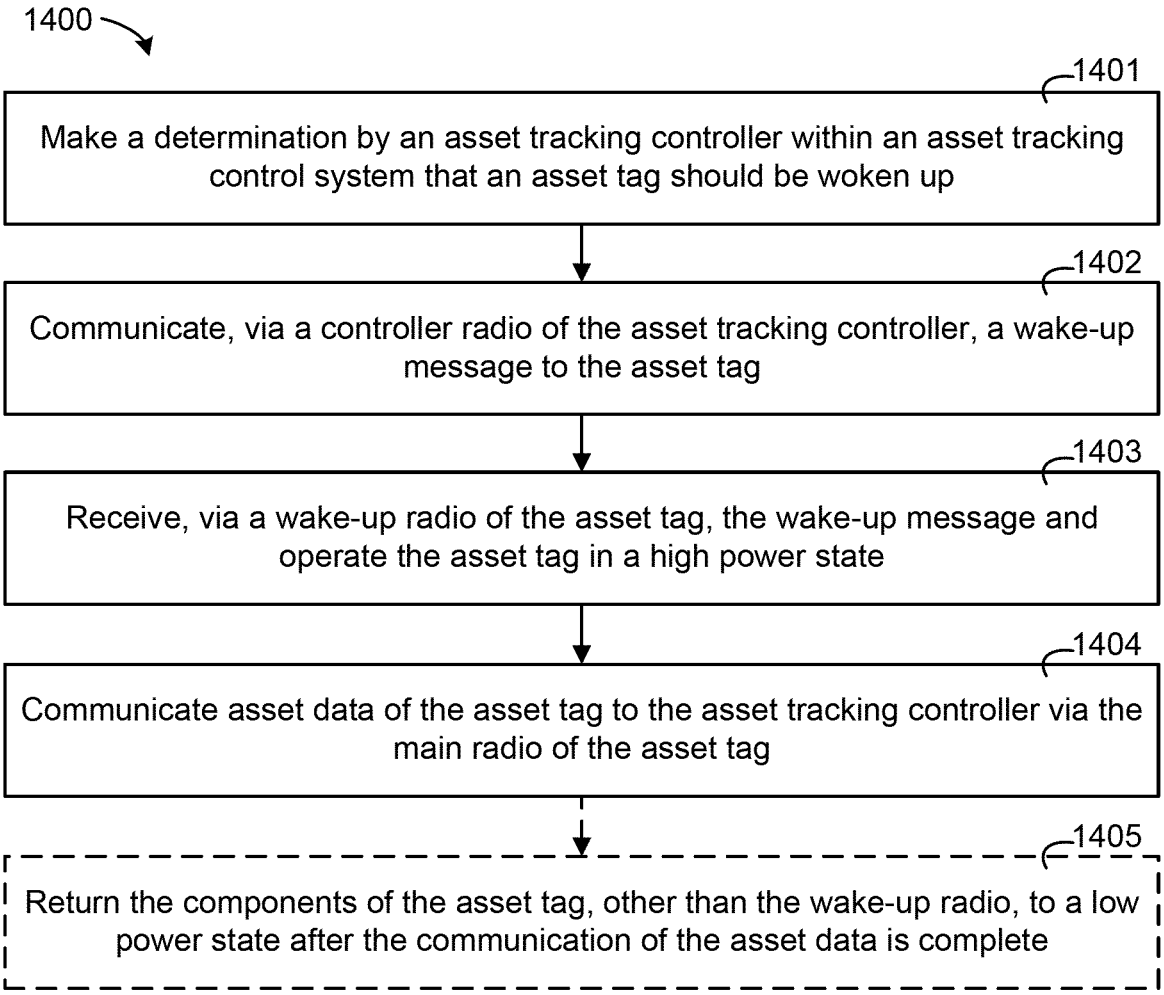
FIG. 14 is a flow diagram of the process by which an asset tracking controller may communicate with an asset tag that may be performed by the asset tracking controller and one of the one or more asset tags of FIG. 10, according to an exemplary embodiment.

Referring now to FIG. 14, a process 1400 of the communication of a wake-up message from an asset tracking controller to an asset tag in order to operate the asset tag at a high power state is shown, according to an exemplary embodiment. In some embodiments, the asset tracking controller 1001 and the asset tag 1006 as described with reference to FIG. 10 can be configured to perform some and/or all of the steps of process 1400.

In step 1401, the asset tracking controller can make a determination that the asset tag should be awoken to operate in the high power state. In some embodiments, the determination that the asset tag should be awoken may be made due to the asset tracking controller requiring asset data from the asset tag for auditing asset locations, a query made by a user to determine the location of the asset tag, a timed check-in with the asset tag to ensure it has not moved, etc.

In step 1402, the asset tracking controller may communicate the wake-up message via a controller radio of the asset tracking controller in response to the determination made at 1401, according to some embodiments. In some embodiments, the wake-up message may be a specialized communication message sent via the controller radio to operate the asset tag in the high power state. When the asset tag is operating at the high power state, it may operate similar to and/or the same as the asset tag 1006 operating at the high power state as described with reference to FIG. 10. In some embodiments, the wake-up message sent by the controller radio may only be able to wake-up an asset tag from a low power state to the high power state. In some embodiments, the wake-up message may contain instructions for the asset tag to perform once it may be operating in the high power state.

In step 1403, the asset tag may initially be operating in the low power state, according to some embodiments. At some point in time after the asset tracking controller communicates the wake-up message in step 1402, the asset tag may receive the wake-up message. In response to the reception of the wake-up message, the asset tag may operate its components, including a main radio, in the high power state as described in step 1403, according to some embodiments. Once operating at the high power state, the asset tag may be configured to communicate asset data to the asset tracking controller and/or operate based on an instruction detailed in the wake-up message, according to some embodiments.

In step 1404, once operating in the high power state, the asset tag may be able to communicate its asset data to the asset tracking controller via the main radio, according to some embodiments. The communication of asset data can continue to occur until the asset tracking controller determines it has gathered the required asset data from the asset tag, according to some embodiments. In some embodiments, the asset tracking controller can determine it may need asset data from the asset tag for an indefinite amount of time. In this case, the communication of asset data from the asset tag to the asset tracking controller can continue to occur until another determination by the asset tracking controller may be made. In step 1404, the asset tag operating at the high power state may execute operations other than communicating asset data based on directions from the asset tracking controller, according to some embodiments.

In step 1405, an optional step in process 1400, the asset tag may return some and/or all of its components to the low power state once the communication of asset data is complete. Step 1405 can further conserve power in the asset tracking control system 1000 by not allowing asset tags to be idle while in the high power state. In some embodiments, once the communication of asset data is complete, the asset tag may have no other operations to perform, thus operation in the high power state may be a waste of power. For example, an asset tag associated with a desktop computer in an office may be able to immediately return to the low power state after transmitting asset data in the high power state as the computer may not be expected to move so further communication of asset data may be unnecessary.

Figure 15:
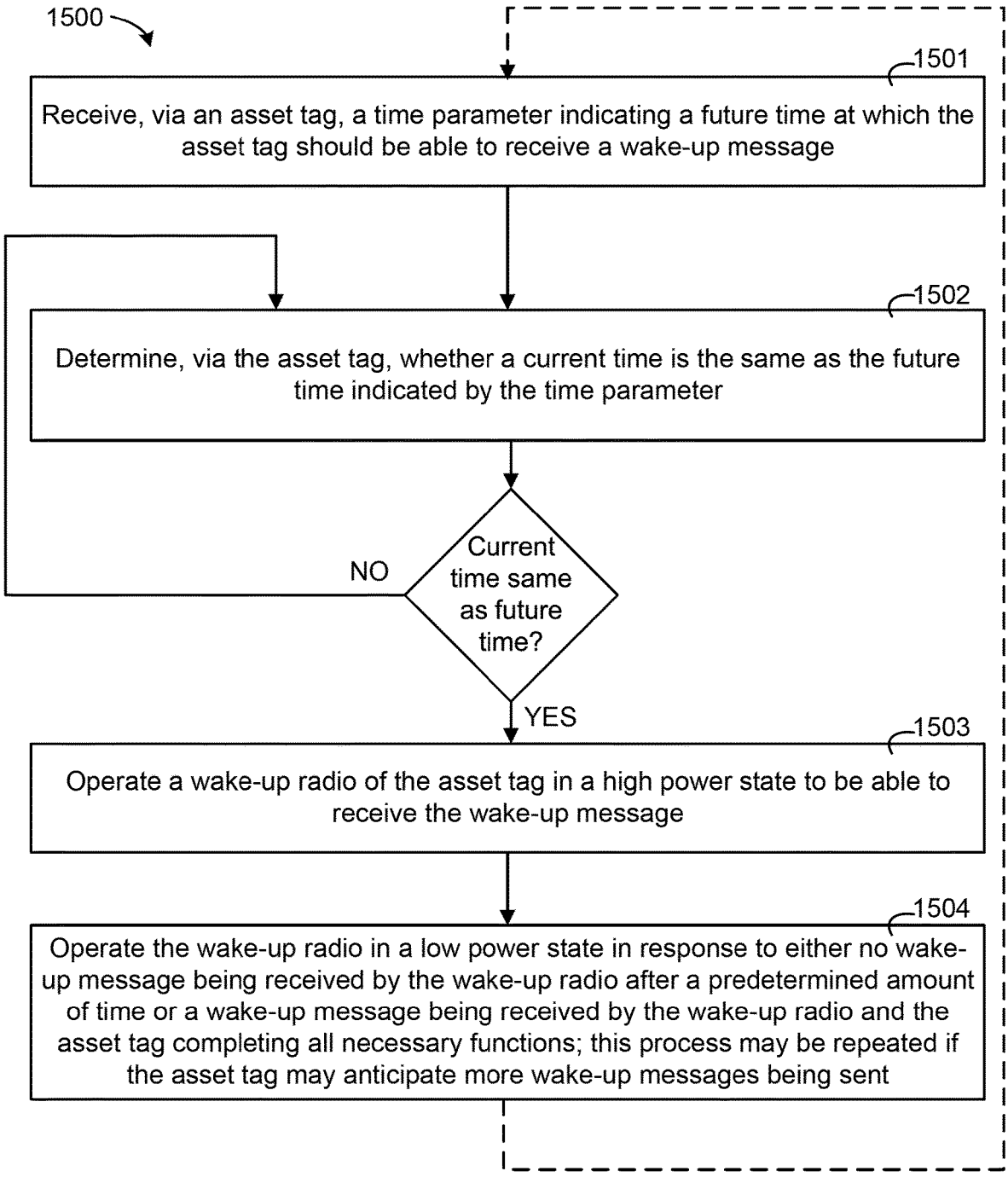
FIG. 15 is a flow diagram of a process that can operate a wake-up radio of an asset tag in a high power state based on a provided time parameter wherein the process can be performed by one of the one or more asset tags of FIG. 10, according to an exemplary embodiment.

Referring now to FIG. 15, a process 1500 for operating a wake-up radio of an asset tag in a high power state based on a provided time parameter is shown, according to an exemplary embodiment. In some embodiments, the asset tracking controller 1001 and the asset tag 1006 described with reference to FIG. 10 may perform some and/or all of the steps of process 1500.

In step 1501, the asset tag may receive a time parameter indicating a future time at which the asset tag should operate the wake-up radio in the high power state. When the asset tag is operating at the high power state, it may have some and/or all of the capabilities of the asset tag operating at the high power state as described with reference to FIG. 10. The time parameter may be received by the asset tag when the asset tag is operating at the high power state and can receive communications, according to some embodiments. In some embodiments, the time parameter may be communicated by an asset tracking controller. In some embodiments, the time parameter can be manually entered into the asset tag.

In step 1502, the asset tag may make a determination if the indicated future time of the time parameter is a current time. This determination may be made by a low power circuit of the asset tag that may be configured to track the current time and make a comparison if the indicated future time of the time parameter is the same as the current time. If the determination is that the current time is not the indicated future time, the asset tag may repeat the step 1502, according to some embodiments. In some embodiments, the comparison can continue to be run by the low power circuit until the current time is the same as the indicated future time. Even though the low power circuit may make many comparisons between the current time and the indicated future time, the power consumed by the low power circuit can still be less than the wake-up radio continuously operating at a power state where it can receive a wake-up message, according to some embodiments. If the determination is that the current time is the future time, process 1500 may continue to step 1503, according to some embodiments.

In step 1503, the asset tag may operate the wake-up radio at the high power state in response to the determination made in step 1502 that the current time is the indicated future time, according to some embodiments. When operating at the high power state, the wake-up radio may be able to receive the wake-up message communicated by the asset tracking controller, according to some embodiments. In some embodiments, when the wake-up radio is operating in the high power state, the wake-up radio can only receive the wake-up message and operate the asset tag in the high power state if the wake-up message is received.

In step 1504, the asset tag may operate the wake-up radio in a low power state if no wake-up message is received after a predetermined time period, according to some embodiments. In some embodiments, the asset tag may operate the wake-up radio in the low power state if the wake-up message was received and the asset tag has completed communicating its asset data to the asset tracking controller and/or completed other functions as determined by the asset tracking controller. Once the wake-up radio of the asset tag is operating at the low power state, process 1500 may repeat starting in step 1501. In some embodiments, process 1500 can repeat because of another time parameter being received by the asset tag. In some embodiments, process 1500 can repeat because the asset tag and/or the asset tracking controller expect the asset tag to need to operate in the high power state at some future time.

Process 1500 may further reduce power consumption of an asset tracking control system by operating wake-up radios only at particular times based on provided time parameters. As the wake-up radios may spend at least some portion of their operation in the low power state, it may be inevitable that less power will be used by the system overall.

Figure 16:
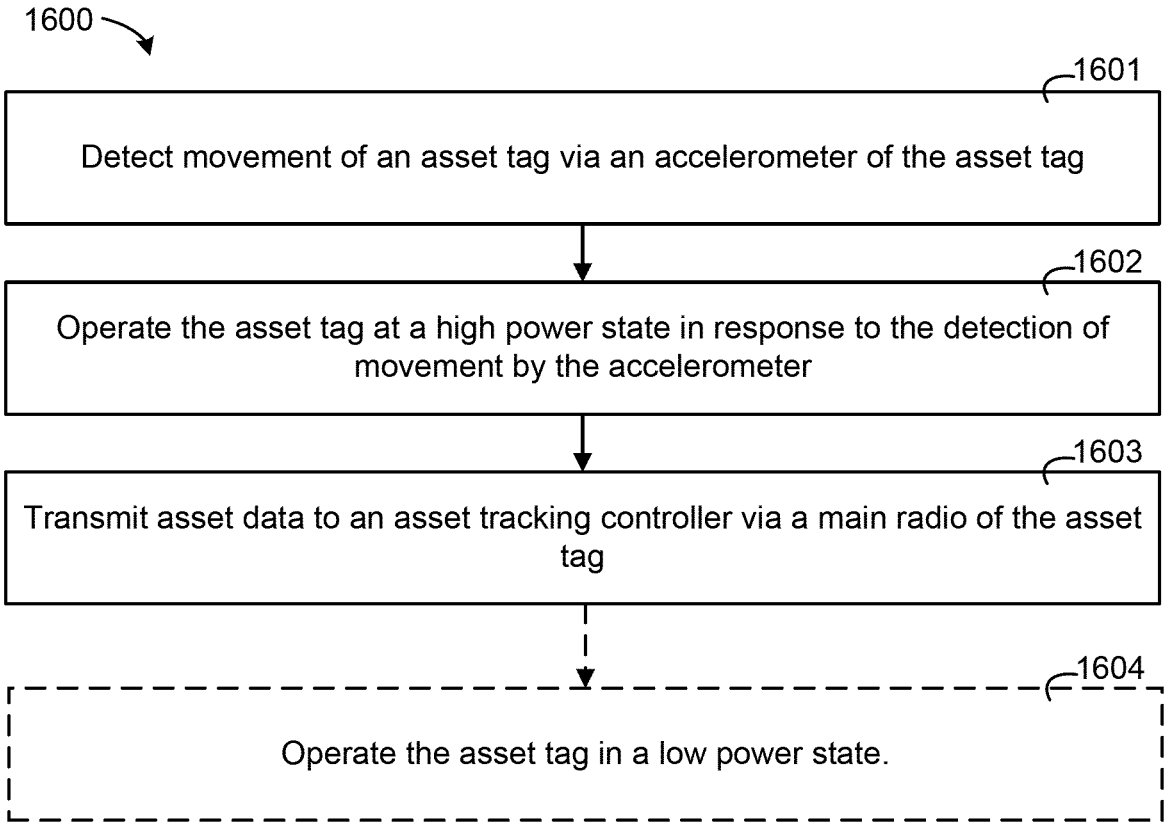
FIG. 16 is a flow diagram of a process that can be performed by an asset tag to communicate asset data in response to a detection of movement by an accelerometer of the asset tag wherein the process can be performed by one of the one or more asset tags of FIG. 10, according to an exemplary embodiment.

Referring now to FIG. 16, a process 1600 for operating an asset tag in a high power state based on a detection of movement from an accelerometer of the asset tag is shown, according to some embodiments. In some embodiments, process 1600 exists to supplement the process 1400 of FIG. 14 so that an asset tracking controller can confirm a location and/or other asset information of an asset through process 1400 and get updated when an asset may be in the process of moving through process 1600. In some embodiments, a detection of movement may be made if the asset may be lifted by a person, the asset tag may be moving along a conveyer belt, an earthquake shakes the asset tags, etc. In some embodiments, the asset tag 1006 and the asset tracking controller 1001 described with reference to FIG. 10 may perform some and/or all of the steps of process 1600.

In step 1601, the accelerometer of the asset tag may detect movement of the asset tag, according to some embodiments. In some embodiments, the accelerometer can be configured to only initiate a step 1602 based on a minimum amount of acceleration. The minimum amount of acceleration can be configured as to avoid small amounts of movement from waking up the asset tag and communicating asset data, according to some embodiments. For example, an amount of acceleration caused by a person colliding with the asset and moving it an inch may not qualify for the minimum amount of acceleration, but the amount of acceleration caused by a person picking up the asset and moving it 100 meters may qualify as more than the minimum amount of acceleration.

In step 1602, the asset tag may operate at the high power state in response to the detection of movement generated in step 1601. By operating at the high power state, the asset tag may be able to transmit asset data to the asset tracking controller, according to some embodiments. In some embodiments, the asset tag may make a determination of whether communicating asset data may be necessary and/or what specific data need to be communicated to the asset tracking controller (e.g., location, acceleration, height off ground, etc.).

In step 1603, the asset tag may communicate asset data to the asset tracking controller via a main radio in response to the asset tag operating at the high power state. In some embodiments, only some asset data determined as required by the asset tag may be communicated. By limiting the amount of data communicated to only required data, further power may be saved and/or communication channels may be less inundated with data.

In step 1604, an optional step in process 1600, the asset tag may return to operation in the low power state, according to some embodiments. In some embodiments, the asset tag may operate in the low power state after it has communicated the asset data it determined was necessary to communicate in step 1602. In some embodiments, the asset tracking controller may communicate to the asset tag that the asset tag should operate in the low power state. By operating in the low power state after all necessary operations are completed, the asset tag may reduce unnecessary power consumption from operating at the high power state for an amount of time longer than may be required to communicate asset data.

Figure 17:
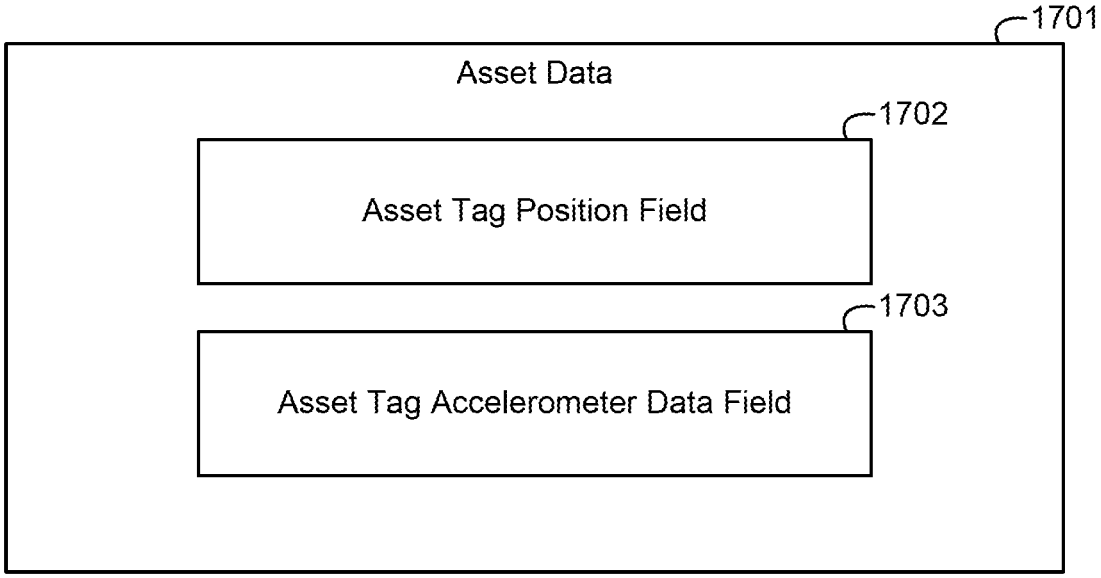
FIG. 17 is a block diagram of the contents of asset data sent from an asset tag similar to an asset tag of FIG. 10, according to an exemplary embodiment.

Referring now to FIG. 17, asset data 1701, an example of asset data communicated by an asset tag, is shown, according to some embodiments. Asset data 1701 is shown to contain an asset tag position field 1702 and an asset tag accelerometer data field 1703. Asset tag position field 1702 may contain data about a current physical position of the asset tag within an asset tracking control system, according to some embodiments. In some embodiments, the asset tag position field 1702 may be configured as to indicate the current physical position of the asset tag in different forms. For example, an asset tracking control system implemented in a building may represent an asset location in the asset tag position field 1702 as a distance and direction from a reference point, whereas an asset tracking control system implemented in a city may represent an asset location in the asset tag position field 1702 as a geographic coordinate. Asset tag accelerometer data field 1703 may contain information about any current acceleration the asset tag is experiencing and/or has experienced within the asset tracking control system, according to some embodiments. In some embodiments, the asset tag accelerometer data field 1703 may indicate how many times the accelerometer detected movement to provide additional information regarding how many times the asset was moved. In some embodiments, the asset tag accelerometer data field 1703 may contain one or more acceleration measurements taken by an accelerometer of the asset tag. Asset data 1701 may be communicated from the asset tag to an asset tracking controller via process 1400 described in reference to FIG. 14, process 1500 described in reference to FIG. 15, and/or process 1600 described in reference to FIG. 16, according to some embodiments.

Figure 18:
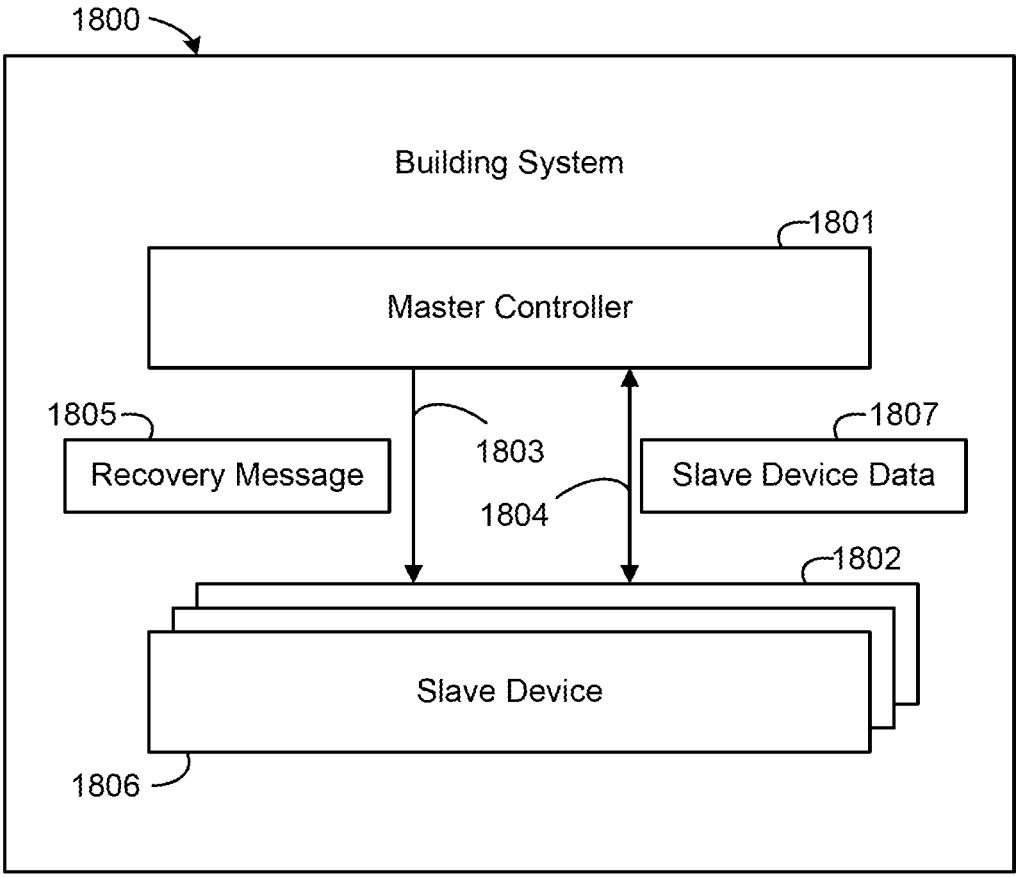
FIG. 18 is a block diagram of a building system including a master controller and one or more slave devices, according to an exemplary embodiment.

Referring now to FIG. 18, a building system 1800 is shown, according to an exemplary embodiment. Building system 1800 is shown to include a master controller 1801 and a set of slave devices 1802 to which a slave device 1806 belongs. From here forward, the slave device 1806 may act as an exemplary embodiment of how all other slave devices in the set of slave devices 1802 may operate. In some embodiments, slave device 1806 may be unique in its operation or may be the same in its operation in regards to the other slave devices in the set of slave devices 1802. Master and slave building systems similar to building system 1800 are a common way of implementing a central controlling device configured to operate one or more subsidiary devices, according to some embodiments. Master and slave building systems can include HVAC systems, lighting systems, elevator systems, hydraulic systems, etc., according to some embodiments. In building system 1800, the set of slave devices 1802 can include one or more devices that are configured to operate within the building system 1800 in response to direction by the master controller 1801. In building system 1800, master controller 1801 may be configured to manage and/or gather data from the set of slave devices 1802 via one or more communication channels. A recovery communication channel 1803 from the master controller 1801 to the set of slave devices 1802 and a data communication channel 1804 from the set of slave devices 1802 to master controller 1801 can be any of the various wireless data transferring mediums (e.g., LAN, WAN, MAN, Bluetooth, Wi-Fi, Zigbee, etc.). In some embodiments, recovery communication channel 1803 may be configured to communicate recovery messages from the master controller 1801 to a slave device in the set of slave devices 1802. In some embodiments, the master controller 1801 may detect a fault status of a slave device in the set of slave devices 1802. The fault status may be determined as the result of the slave device not responding to communication from the master controller 1801, the slave device communicating data the master controller 1801 considers incomplete and/or inconsistent, the slave device itself communicating it has a fault status, etc., according to some embodiments. For example, a slave device in a hydraulic lift system may stop responding to instructions to raise a platform. A master controller of the hydraulic lift system may detect that the slave device may not be raising the platform as it should which indicates a fault status. The master controller may then communicate a recovery message to the slave device in order to resolve the fault status. In some embodiments, recovery messages may be configured to operate a slave device with a fault status in such a way as to resolve the fault status. For example, a recovery message may initiate a reset of a slave device in order to resolve the fault status. In some embodiments, some and/or all of the slave devices in the set of slave devices may be configured to communicate data regarding their status and/or other information to the master controller 1801 via the data communication channel 1804. According to some embodiments, slave devices may be configured as to communicate the result of a reset to the master controller 1801 and/or communicate general device information the master controller 1801 requires. In this regard, master controller 1801 and the set of slave devices 1802 can include the hardware and/or software to make recovery communication channel 1803 and data communication channel 1804 possible.

A fault status of a slave device may be generated within a given period of time if one or more slave devices are operating with at least some functionality (i.e. not powered off). This fault status may be determined by the master controller which may be actively monitoring at least a portion of the set of slave devices 1802 for fault statuses, according to some embodiments. For example, a master controller of a lighting system of a building may be monitoring one or more lights (i.e. slave devices) in a section of the building with people actively present for fault statuses. However, the master controller may not be monitoring a section of the building where persons are not present. In some embodiments, the master controller of the lighting system may only detect a fault status of a light in the section of the building it may be monitoring.

When a fault status of a slave device is detected by the master controller 1801, it may communicate a recovery message 1805 over recovery communication channel 1803, according to some embodiments. In some embodiments, recovery communication channel 1803 may be a dedicated communication channel exclusively for communicating recovery messages. In this way, the likelihood that slave device 1806 may receive recovery message 1805 may be higher as extra communications may not be cluttering the recovery communication channel 1803. Likewise, data communication channel 1804 may be used to communicate slave device data 1807 from a slave device in the set of slave devices 1802 to the master controller 1801, according to some embodiments. In keeping the recovery communication channel 1803 separate from data communication channel 1804, a fault status of a slave device in the set of slave devices 1802 can optimally be resolved quicker and more efficiently.

Figure 19:
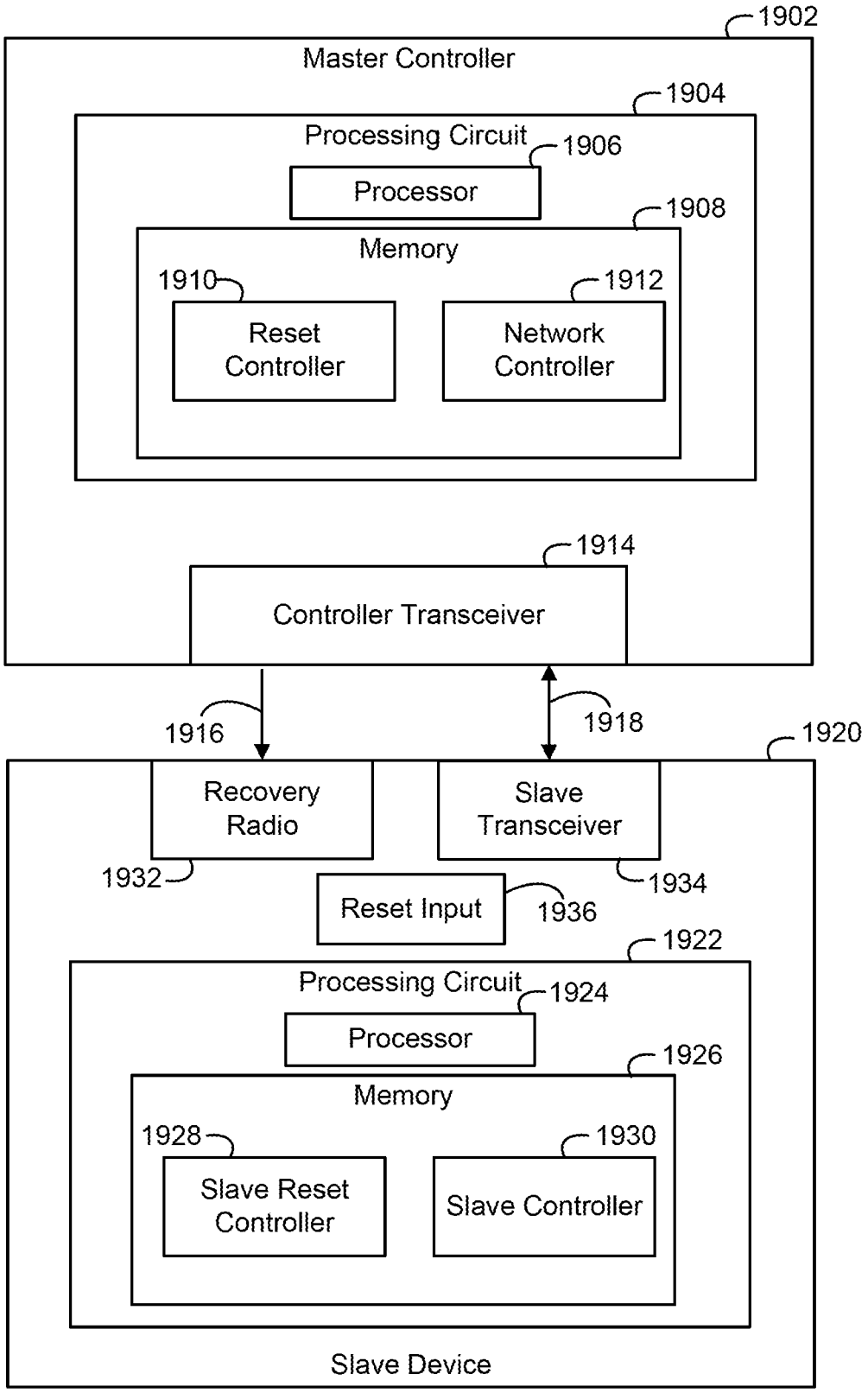
FIG. 19 is a block diagram of the communication of a recovery message and slave device data between a slave device and a master controller including a controller transceiver wherein the communication can be performed by the master controller and one of the one or more slave devices of FIG. 18, according to an exemplary embodiment.

Now referring to FIG. 19, a master controller 1902 is shown in greater detail in regards to master controller 1801 of FIG. 18, according to some embodiments. In some embodiments, master controller 1902 may be configured to control and manage one or more slave devices including a slave device 1920 within building system 1800. In some embodiments, the operation of the slave devices including slave device 1920 may include monitoring for fault statuses among the slave devices, communicating recovery messages to slave devices with a fault status, storing slave device data in a database, allowing users to interface with slave devices, etc.

In some embodiments, master controller 1902 includes a processing circuit 1904, wherein processing circuit 1904 includes a processor 1906 and a memory 1908. Processor 1906 may be implemented as a general-purpose processor, an application specific integrated circuit (ASIC), one or more field programmable gate arrays (FPGAs), a group of processing components, or other suitable electronic processing components.

Memory 1908 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 1908 may be or include volatile memory or non-volatile memory. Memory 1908 may include database components, object code components, script components, or any other type of information structure for supporting the various activities and information structures described in the present application. According to some embodiments, memory 1908 may be communicably connected to processor 1906 via processing circuit 1904 and includes computer code for executing (e.g., by processing circuit 1904 and/or processor 1906) one or more processes described herein.

Still referring to FIG. 19, memory 1908 is shown to include a reset controller 1910 and a network controller 1912, according to some embodiments. Network controller 1912 may facilitate communication of the master controller 1902 over one or more networks (e.g. internal building networks, an IP based network, etc.). This communication over the one or more networks may allow the master controller 1902 to receive network data, according to some embodiments. The network data can include instructions to perform an audit of all slave devices within the building system 1800, software updates, information about new slave devices that may be/are configured in the building system, etc., according to some embodiments. In some embodiments, reset controller 1910 may be configured to detect a fault status of a slave device in a set of slave devices and/or communicate a recovery message to the slave device experiencing a fault. In some embodiments, the reset controller 1910 can provide slave device data and/or other information to the network controller 1912 to be distributed over one or more networks.

Master controller 1902 is also shown to include a controller transceiver 1914, according to an embodiment. Controller transceiver 1914 may be configured to communicate the recovery message to the slave device via recovery communication channel 1916 where recovery communication channel 1916 may be similar to and/or the same as the recovery communication channel 1803 detailed with reference to FIG. 18, according to some embodiments. In some embodiments, controller transceiver 1914 may also be configured to receive slave device data via data communication channel 1918 from one or more of the slave devices in the set of slave devices where data communication channel 1918 may be similar to and/or the same as the data communication channel 1804 detailed with reference to FIG. 18.

Still referring to FIG. 19, a slave device 1920 is shown in greater detail in regards to a slave device of the set of slave devices 1802 of FIG. 18, according to some embodiments.

Slave device 1920 is shown to include a processing circuit 1922, wherein processing circuit 1922 includes a processor 1924 and a memory 1926. Processor 1924 can be implemented as a general-purpose processor, an application specific integrated circuit (ASIC), one or more field programmable gate arrays (FPGAs), a group of processing components, or other suitable electronic processing components.

Memory 1926 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 1926 may be or include volatile memory or non-volatile memory. Memory 1926 may include database components, object code components, script components, or any other type of information structure for supporting the various activities and information structures described in the present application. According to some embodiments, memory 1926 may be communicably connected to processor 1924 via processing circuit 1922 and includes computer code for executing (e.g., by processing circuit 1922 and/or processor 1924) one or more processes described herein.

Memory 1926 is shown to include a slave reset controller 1928, according to some embodiments. Slave reset controller 1928 may be configured to initiate a type of reset of the slave device in response to a reception of a recovery message via a recovery radio 1932. Types of resets may include turning the slave device off and back on, changing a configuration of the slave device, performing a factory reset of the device, and/or a combination of the above, according to some embodiments. In some embodiments, slave reset controller 1928 may be configured to operate a single reset in response to the reception of the recovery message where the single reset may be one of the types of resets. In some embodiments, slave reset controller 1928 may be configured to operate more than one reset based on reception of the recovery message where a particular reset may be operated depending on what fault status the slave device may be experiencing. For example, a recovery message detailing a slave device may be transmitting incorrect data may cause the slave device to operate a reset where the slave device may be powered off and back on while a recovery message detailing the slave device has equipment failure may cause the slave device to perform a factory reset, according to some embodiments.

Memory 1926 is also shown to include a slave controller 1930, according to some embodiments. Slave controller 1930 may be configured to communicate slave device data to the master controller 1902 via a slave transceiver 1934, according to some embodiments. In some embodiments, slave controller 1930 may communicate slave device data to the master controller 1902 via slave transceiver 1934 after a reset is performed on the slave device where the slave device data may include information regarding the results of the reset (e.g., if the reset was successful, what was changed about the slave device in response to the reset, test data slave data for the master controller 1902 to determine if another reset should be performed, etc.). In some embodiments, slave controller 1930 may communicate slave device data via slave transceiver 1934 to the master controller 1902 on a predetermined schedule and/or a single instance based on what data the master controller 1902 requires from the slave device 1920. For an example, in a heating system, a heating sensor slave device may communicate temperature information to a heating master controller on a predetermined schedule of every 10 minutes to ensure a comfortable temperature may be maintained.

In some embodiments, slave reset controller 1928 and slave controller 1930 are implemented separately where the purpose of slave reset controller 1928 may exclusively be to perform operations to resolve a fault status of the slave device 1920. In this way, if slave controller 1930 is responsible for a fault status, an operation to resolve the fault status may still be able to occur. In some embodiments, slave reset controller 1928 and slave controller 1930 are implemented as a single slave controller in memory 1926. The single slave controller may be configured to perform some and/or all of the operations of slave reset controller 1928 and slave controller 1930, according to some embodiments.

In some embodiments, recovery radio 1932 may be connected to a reset input 1936 where the reset input 1936 only includes hardware that initiates a reset of the slave device. In some embodiments, recovery radio 1932 may communicate an activation signal to the reset input 1936 in response to the reception of a recovery message. In some embodiments, reset input 1936 may be configured to initiate a reset of the slave device in response to the reception of the activation signal from the recovery radio 1932. In this way, when recovery radio 1932 receives a recovery message, the slave device 1920 may be able to begin a reset without processing by the slave reset controller 1928, according to some embodiments. In the case that a majority of the components of slave device 1920 are experiencing a fault status, a reset can nonetheless occur if the recovery radio 1932 can receive the recovery message and communicate the activation signal to the reset input 1936. Reset input 1936 may further ensure that a reset of the slave device may be performed reliably based on reception of the recovery message.

Figure 20:
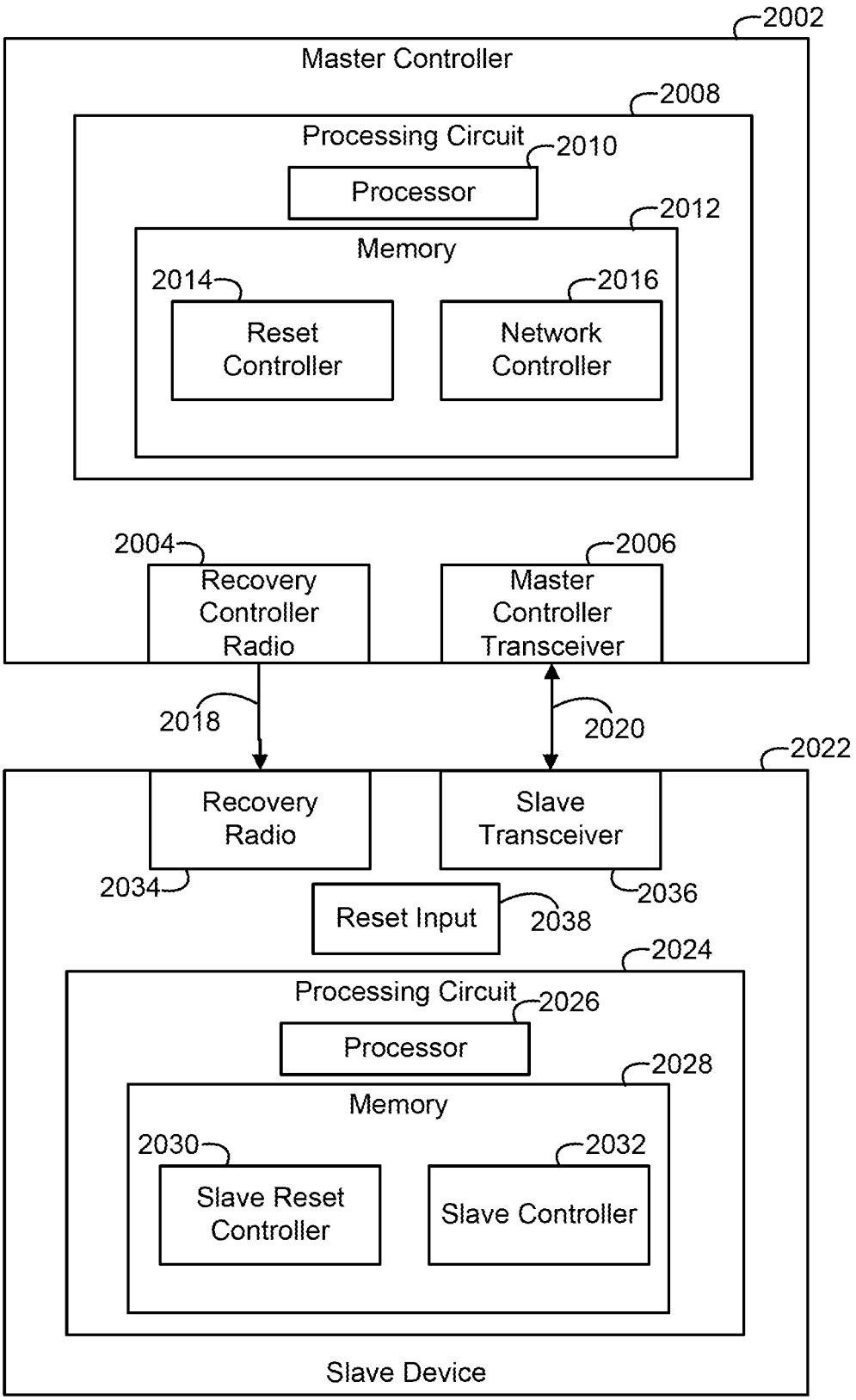
FIG. 20 is a block diagram of the communication of a recovery message and slave device data between a slave device and a master controller including a recovery controller radio and a master controller transceiver wherein the communication can be performed by the master controller and one of the one or more slave devices of FIG. 18, according to an exemplary embodiment.

Referring now to FIG. 20, the master controller 1902 of FIG. 19 is shown in greater detail as master controller 2002 wherein controller transceiver 1914 consists of a recovery controller radio 2004 and a master controller transceiver 2006, according to some embodiments. Master controller 2002 is shown to include a processing circuit 2008, wherein processing circuit 2008 includes a processor 2010 and a memory 2012 where processor 2010 and memory 2012 may be similar to and/or the same as processor 1906 and memory 1908 described with reference to FIG. 19 respectively, according to some embodiments.

Memory 2012 is shown to include a reset controller 2014 and a network controller 2016, according to some embodiments. Network controller 2016 may operate similar to and/or the same as network controller 1912 described with reference to FIG. 19, according to some embodiments. In some embodiments, reset controller 2014 may operate similar to and/or the same as reset controller 1910 described with reference to FIG. 19, according to some embodiments. In some embodiments, reset controller 2014 may be configured to communicate recovery messages to slave devices the master controller 2002 determines have a fault status via the recovery controller radio 2004. In some embodiments, reset controller 2014 may be configured to operate the master controller transceiver 2006 to receive slave device data.

Still referring to FIG. 20, master controller 2002 and a slave device 2022 are shown connected by a recovery communication channel 2018 and a data communication channel 2020 where recovery communication channel 2018 and data communication channel 2020 may be similar to and/or the same as the recovery communication channel 1916 and data communication channel 1918 detailed with reference to FIG. 19 respectively, according to some embodiments. Slave device 2022 may be similar to and/or the same as the slave device 1920 described with reference to FIG. 19, according to some embodiments.

In some embodiments, recovery radio 2034 may be configured to receive a recovery message from recovery controller radio 2004 via recovery communication channel 2018 where the recovery message may be similar to and/or the same as the recovery message described with reference to FIG. 18. In response to receiving the recovery message, the slave device 2022 may perform an operation to resolve the fault status.

Slave transceiver 2036 is shown connected to master controller transceiver 2006 via data communication channel 2020, according to some embodiments. According to some embodiments, slave device data can be communicated by the slave transceiver 2036 and can be received by the master controller transceiver 2006 when the slave device is on and not processing a reset. In some embodiments, the master controller transceiver 2006 can use data communication channel 2020 to communicate instructions and/or information to the slave device via slave transceiver 2036 via data communication channel 2020. These instructions may include other operations the slave device should perform, system information the slave device may need to operate properly, etc., according to some embodiments.

FIG. 20 differs from FIG. 19 in that the communication channels shown are either directed towards the same transceiver of a master controller as may be the case in FIG. 19, or are directed towards two separate transceivers and/or radios of a master controller as may be the case in FIG. 20, according to some embodiments. The controller transceiver 1914 shown in FIG. 19 may have the benefit of lowering the complexity of the master controller 1902, according to some embodiments. The recovery controller radio 2004 and the master controller transceiver 2006 of FIG. 20 may have the benefit among other benefits where the detection of a fault status in a slave device can be handled by the recovery controller radio 2004 so the master controller transceiver 2006 may be able to continue normal operation of receiving and transmitting information to and/or from other slave devices.

Figure 21:
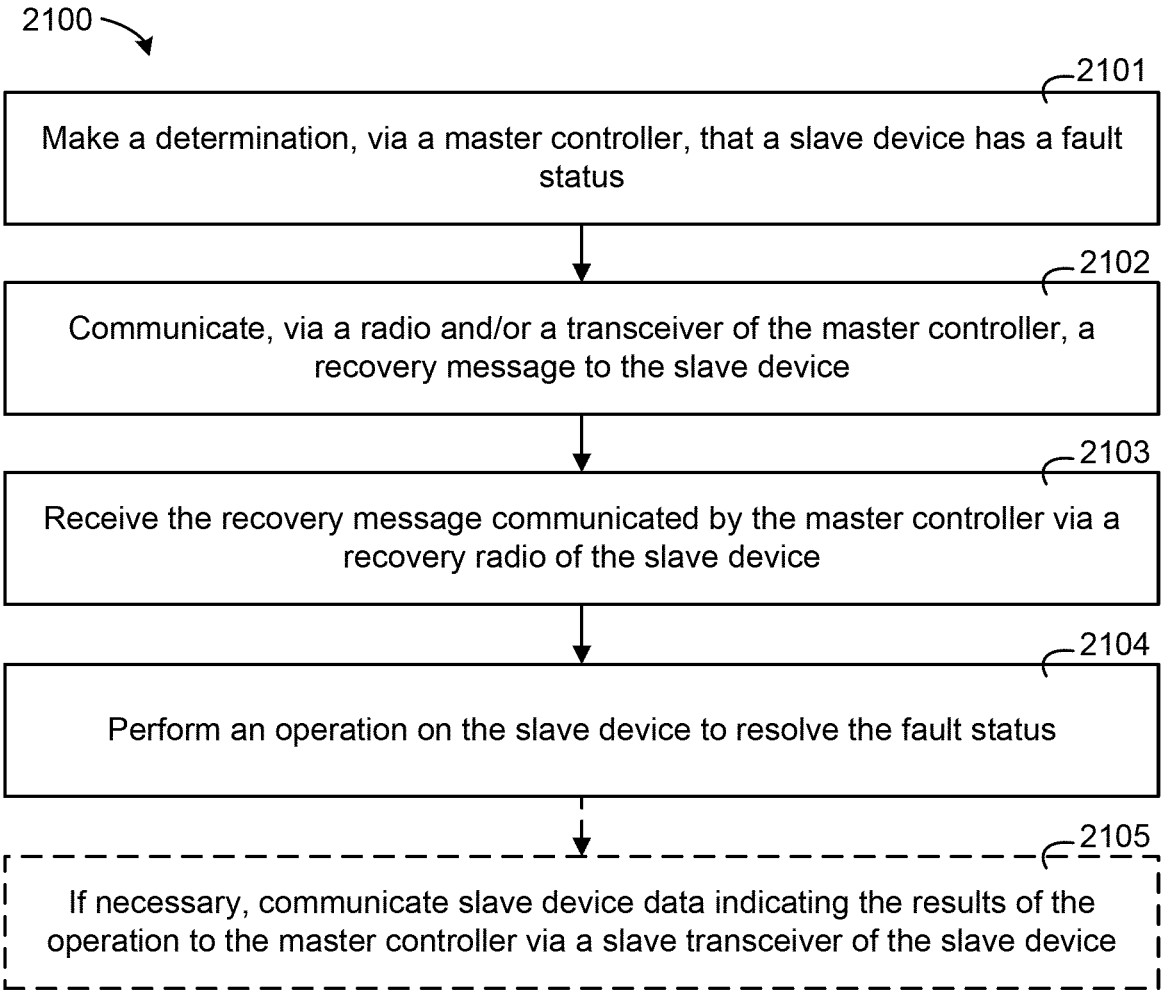
FIG. 21 is a flow diagram of a process by which a master controller may communicate a recovery message in order to resolve a fault status of a slave device that can be performed by the master controller and one of the one or more slave devices of FIG. 18, according to an exemplary embodiment.

Referring now to FIG. 21, a process 2100 of the communication of a recovery message between a master controller and a slave device in order to resolve a fault status of the slave device is shown, according to some embodiments. In some embodiments, the master controller 1801 and the slave device 1806 described with reference to FIG. 18 may be able to perform some and/or all of the steps of process 2100.

In step 2101, a master controller may make a determination that a slave device has a fault status and a recovery message should be communicated to the slave device in order to resolve the fault status. This determination may be made for any of the reasons a slave device may be detected to have a fault status described with reference to FIG. 18, according to some embodiments. In some embodiments, the determination may be made by a reset controller similar to the reset controller 1910 described with reference to FIG. 19.

In step 2102, the master controller may communicate a recovery message via a controller radio and/or a controller transceiver. This communication may occur in response to the determination made in step 2101 by the master controller, according to some embodiments. In some embodiments, the recovery message may be configured as a specialized communication message with the purpose of resolving a fault status through an operation performed by the slave device experiencing the fault status. In some embodiments, the recovery message may be transmitted over a recovery communication channel similar to the recovery communication channel 1803 described with reference to FIG. 18. In some embodiments, the recovery message may be directed at a single slave device and all other slave devices in the system may ignore the message. In some embodiments, the recovery message may be communicated to some and/or all of the slave devices in the system where each slave device would then perform a reset in response to the reception of the recovery message. The recovery message able to be communicated to some and/or all of the slave devices in the system allows the master controller to perform a partial and/or full system reset in response to detection of some fault statuses.

In step 2103, a recovery radio of the slave device may receive the recovery message some amount of time after the recovery message may be communicated in step 2102 via the recovery communication channel. In some embodiments, the recovery radio may be similar to and/or the same as the recovery radio 1932 described with reference to FIG. 19.

In step 2104, the slave device may perform an operation in order to resolve the fault status, in response to reception of the recovery message. The operation to be performed by the slave device may be described in the recovery message or the slave device may be configured to determine the reset to perform based on only receiving the recovery message, according to some embodiments. In some embodiments, the slave device may determine what reset to perform via a reset controller similar to and/or the same as the slave reset controller 1928 of FIG. 19. In some embodiments, the recovery radio of the slave device may be hard-wired to a reset input similar and/or the same as the reset input 1936 described with reference to FIG. 19 where the reset input may be configured to automatically begin a reset of the slave device upon activation.

In step 2105, an optional step in process 2100, the slave device may communicate slave device data of the slave device including the results of the operation performed, according to some embodiments. This optional step in process 2100 can provide feedback to the master controller about whether the operation was successful and/or if another recovery message should be communicated to the slave device, according to some embodiments. In some embodiments, the slave device data communicated in step 2105 may include general slave device information the master controller may require in addition to the results of the reset.

Figure 22:
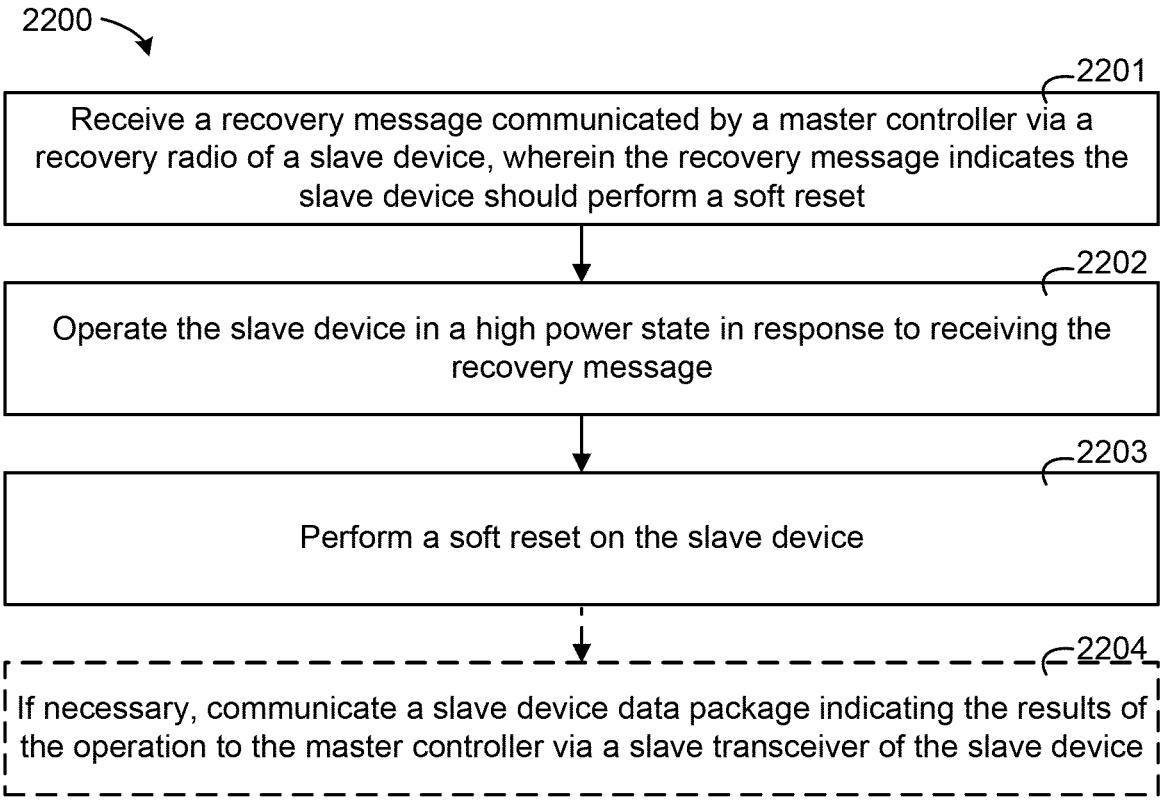
FIG. 22 is a flow diagram of a process by which a master controller may communicate a recovery message to a slave device that initiates a soft reset of the slave device that can be performed by the master controller and one of the one or more slave devices of FIG. 18, according to an exemplary embodiment.

Referring now to FIG. 22, a process 2200 of how a slave device may perform a soft reset based on a recovery message indicating it should perform the soft reset, according to some embodiments. A soft reset may be an operation to turn the slave device off and back on, restart one or more components of the slave device, recalculate slave data, etc., according to some embodiments. In some embodiments, the slave device 1806 described with reference to FIG. 18 may be able to perform some and/or all of the steps in process 2200.

In step 2201, a slave recovery radio of the slave device may receive the recovery message from a master controller wherein the recovery message indicates the slave device should perform a soft reset, according to some embodiments. In some embodiments, the recovery message may be communicated from the master controller to the slave device in a process similar to and/or the same as process 2100 described with reference to FIG. 21. The recovery message may indicate the slave device should operate a soft reset through a data field of the recovery message, by communicating the recovery message to a specific address the recovery radio of the slave device may be listening to, etc., according to some embodiments.

In step 2202, the slave device may operate in a high power state as to be able to perform the soft reset. If the slave device is not operating in a high power state (e.g. the slave device is powered off), the soft reset may not be able to occur, according to some embodiments. The high power state of the slave device may be a power state where the slave device is operating with enough power to perform the soft reset. In some embodiments, the slave device with a fault status may not be receiving enough power as to perform the soft reset, in which case the process 2200 may end as the soft reset cannot be performed.

In step 2203, the slave device operating in a high power state may perform the soft reset on the slave device in order to resolve a fault status as determined by the master controller, according to some embodiments. In some embodiments, the slave device may be configured to perform more than one soft reset in determination that the previous soft reset did not resolve the fault status. In some embodiments, the slave device may be configured to perform one soft reset, regardless of whether the soft reset was successful in resolving the fault status.

In step 2204, an optional step in process 2200, the slave device may communicate slave device data of the slave device including the results of the operation performed, according to some embodiments. This optional step can provide feedback to the master controller about whether the operation was successful and/or if another recovery message should be communicated to the slave device. Step 2204 may be similar to and/or the same as step 2105 described with reference to FIG. 21. In some embodiments, the slave device data communicated to the master controller may include what soft reset(s) were performed and/or determinations made by the slave device during process 2200.

Figure 23:
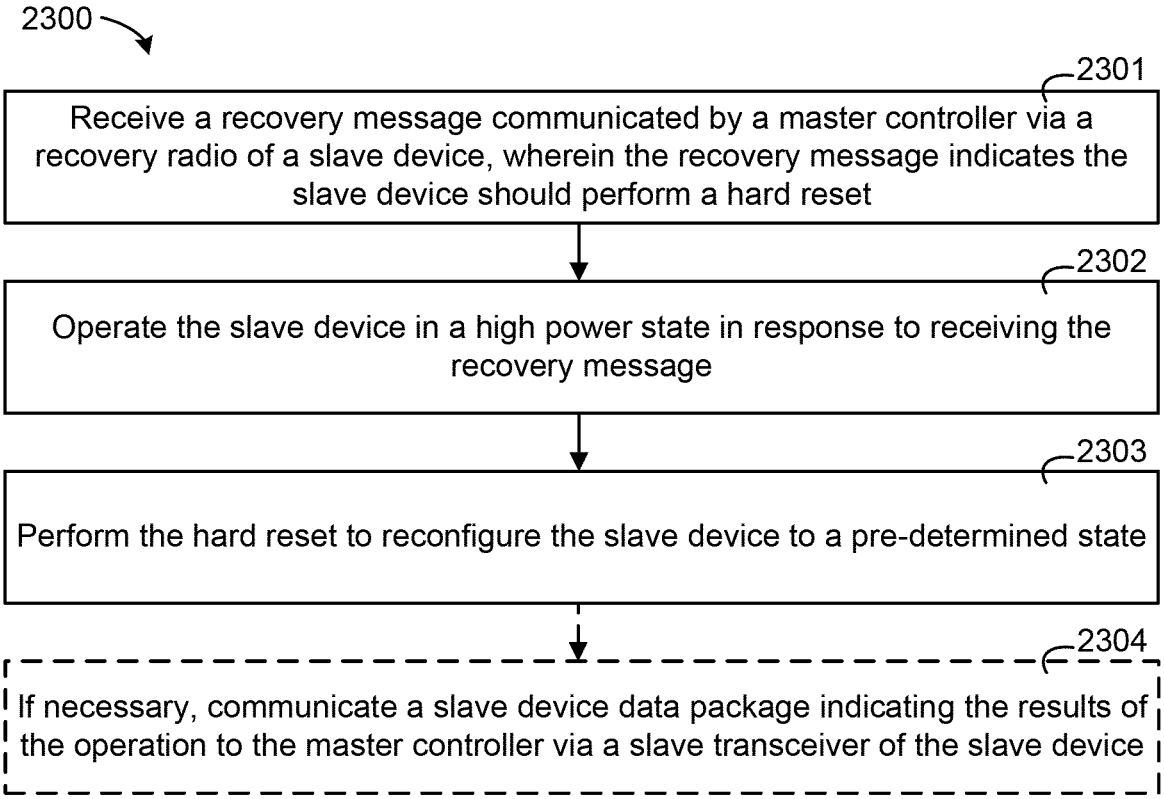
FIG. 23 is a flow diagram of a process by which a master controller may communicate a recovery message to a slave device that initiates a hard reset of the slave device that can be performed by the master controller and one of the one or more slave devices of FIG. 18, according to an exemplary embodiment.

Referring now to FIG. 23, a process 2300 of how a slave device may perform a hard reset based on a recovery message indicating it should perform the hard reset, according to some embodiments. A hard reset may be a reset including resetting a configuration of the slave device to a predetermined state, reconfigure the slave device to be temporarily and/or permanently disabled, etc., according to some embodiments. The slave device 1806 described with reference to FIG. 18 may be able to perform some and/or all of the steps of process 2300.

In step 2301, a slave recovery radio of the slave device may receive the recovery message from a master controller wherein the recovery message indicates the slave device should perform a hard reset, according to some embodiments. In some embodiments, the recovery message may be communicated from the master controller to the slave device in a process similar to and/or the same as process 2100 described with reference to FIG. 21. The recovery message may indicate the slave device should operate a hard reset through a data field of the recovery message, by communicating the recovery message to a specific address the recovery radio of the slave device may be listening to, etc., according to some embodiments.

In step 2302, the slave device may operate in a high power state as to be able to perform the hard reset. If slave device is not operating in a high power state (e.g. the slave device is powered off), the hard reset may not be able to occur, according to some embodiments. The high power state of the slave device may be a power state where the slave device is operating with enough power to perform the hard reset. In some embodiments, the slave device with a fault status may not be receiving enough power as to perform the hard reset, in which case the process 2300 may end as the hard reset cannot be performed. In some embodiments, the slave device may require more or less power to perform the hard reset than the slave device of FIG. 22 requires to perform the soft reset.

In step 2303, the slave device operating in a high power state may perform the hard reset on the slave device in order to resolve a fault status as determined by the master controller, according to some embodiments. In some embodiments, the slave device may be configured to perform more than one hard reset in determination that the previous hard reset did not resolve the fault status. In some embodiments, the slave device may be configured to perform one hard reset, regardless of whether the hard reset was successful in resolving the fault status. In some embodiments, the hard reset performed may reconfigure the slave device in such a way that it may require new instructions from the master controller to be able to perform any further operations.

In step 2304, an optional step in process 2300, the slave device may communicate slave device data of the slave device including the results of the operation performed, according to some embodiments. This optional step can provide feedback to the master controller about whether the operation was successful and/or if another recovery message should be communicated to the slave device. Step 2304 may be similar to and/or the same as step 2105 described with reference to FIG. 21. In some embodiments, the slave device data communicated to the master controller may include what hard reset(s) were performed and/or determinations made by the slave device during process 2200.

Figure 24:
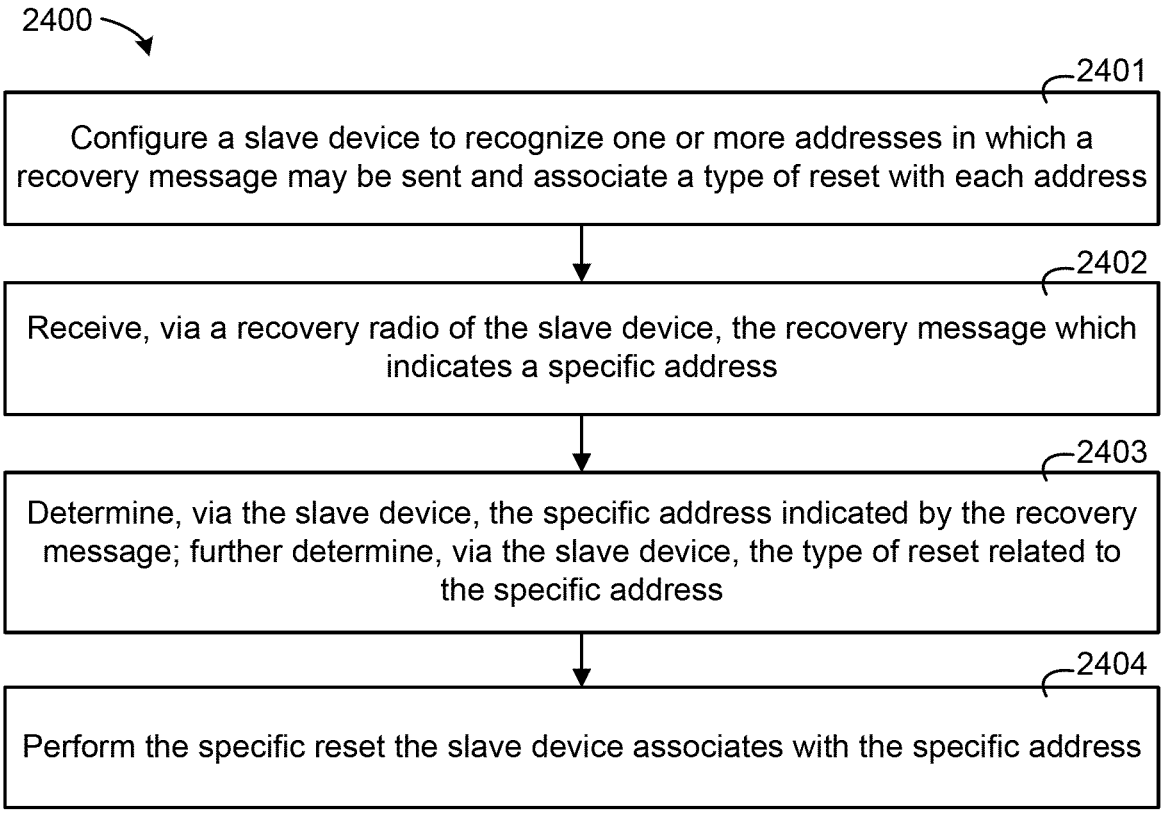
FIG. 24 is a flow diagram of a process by which a slave device may initiate a certain type of reset based on receiving a recovery message at a particular address that can be performed by one of the one or more slave devices of FIG. 18, according to an exemplary embodiment.

Referring now to FIG. 24, a process 2400 for performing a predetermined type of reset of a slave device based on an address that a recovery message may be sent to is shown, according to some embodiments. In some embodiments, an address may include an electromagnetic wavelength the slave device may be listening to, a packet header of the recovery message, an internet protocol (IP) address, etc. In some embodiments, the slave device 1806 described with reference to FIG. 18 may be able to perform some and/or all of the steps of process 2400.

In step 2401, the slave device may be configured to recognize one or more addresses wherein each address may be related to a preconfigured type of reset, according to some embodiments. For example, the recovery radio of the slave device may be configured to have two IP addresses where if the recovery message is sent to the first IP address the slave device may perform a soft reset and if the recovery message is sent to the second IP address the slave device may perform a hard reset, according to some embodiments.

In step 2402, the slave device may receive the recovery message wherein the recovery message indicates an address, according to some embodiments. In some embodiments, the slave device can receive the recovery message via the recovery radio where the recovery radio may be similar to and/or the same as the recovery radio 1932 described with reference to FIG. 19.

In step 2403, the slave device may determine what address was indicated by the recovery message. Based on which address is determined, the slave device may determine what associated type of reset should be performed, according to some embodiments. In some embodiments, the determination of what reset to perform may be made by a reset controller similar to and/or the same as the slave reset controller 1928 described with reference to FIG. 19. In some embodiments, the determination of what reset to perform may be made by the recovery radio itself where the recovery radio may be configured to be connected to one or more reset inputs similar to and/or the same as reset input 1936 described with reference to FIG. 19. Each of the one or more reset inputs may be hardwired to the slave device in such a way as to perform a particular reset on activation, according to some embodiments.

In step 2404, the slave device may perform the type of reset determined at step 2403 based on the address of the recovery message, according to some embodiments. In some embodiments, the slave device may repeatedly perform the reset determined in step 2403 until the reset is successful. In some embodiments, the slave device may perform the reset determined in step 2403 once, regardless of whether the reset was successful.

Figure 25:
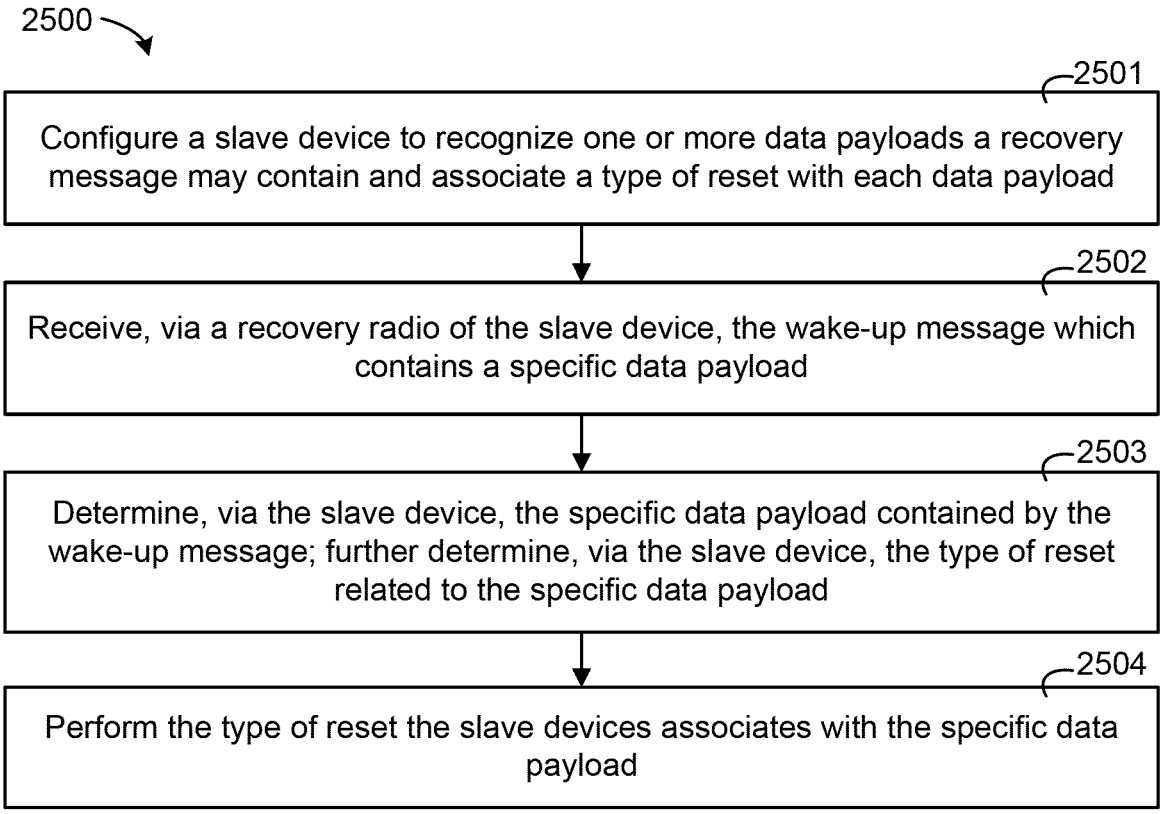
FIG. 25 is a flow diagram of a process by which a slave device may initiate a certain type of reset based on receiving a recovery message with a data payload that can be performed by one of the one or more slave devices of FIG. 18, according to an exemplary embodiment.

Referring now to FIG. 25, a process 2500 for performing a particular type of reset of a slave device based on information in a data payload of a recovery message, according to some embodiments. In some embodiments, the slave device 1806 of FIG. 18 may be able to perform some and/or all of the steps of process 2500.

At step 2501, the slave device may be configured to recognize one or more data payloads, wherein each data payload indicates a predetermined type of reset to be performed, according to some embodiments. For example, the slave device may be configured to recognize data payloads containing binary numbers where the data payload may contain a binary field where binary number 00 indicates a soft reset, binary number 01 indicates a hard reset, etc., according to some embodiments. In some embodiments, the slave device may not recognize the data payload of the recovery message in which case the slave device may perform a default reset and/or ignore the recovery message.

At step 2502, the slave device may receive the recovery message wherein the recovery message contains a data payload, according to some embodiments. In some embodiments, the slave device can receive the recovery message via the recovery radio where the recovery radio may be similar to and/or the same as the recovery radio 1932 described with reference to FIG. 19.

At step 2503, the slave device may determine what data payload is contained by the recovery message. Based on what data payload is determined, the slave device may determine what associated type of reset should be performed, according to some embodiments. In some embodiments, the determination of what reset to perform may be made by a reset controller similar to and/or the same as the slave reset controller 1928 described with reference to FIG. 19. In some embodiments, the recovery radio may contain a processing circuit configured to decode data payloads and perform related resets on the slave device directly.

At step 2504, the slave device may perform the type of reset determined at step 2503 based on the data payload of the recovery message, according to some embodiments.

Figure 26:
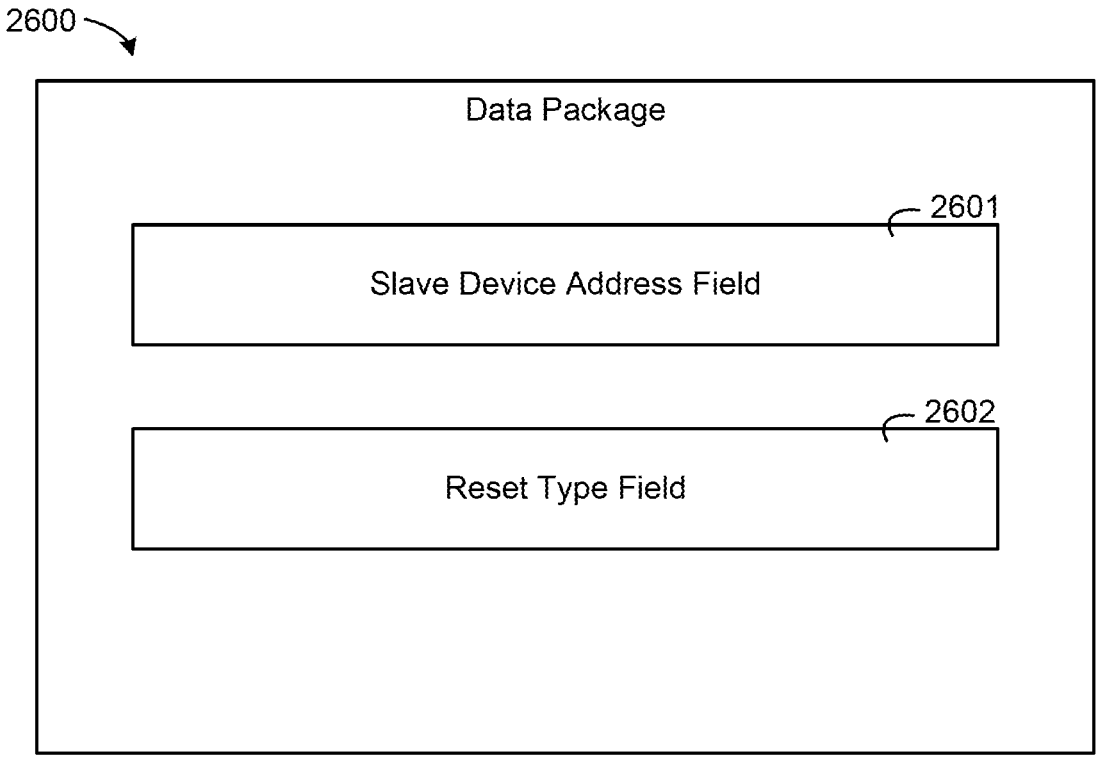
FIG. 26 is a block diagram of the contents of a recovery message sent by the master controller of FIG. 18, according to an exemplary embodiment.

Referring now to FIG. 26, a block diagram of the contents of a data package 2600 that may be included in a recovery message communicated to a slave device is shown, according to some embodiments. Data package 2600 may be included in some and/or all of the recovery messages described with reference to FIG. 18 through FIG. 25, according to some embodiments.

Data package 2600 may contain a slave device address field 2601, wherein the slave device address field 2601 may indicate where the data package 2600 should be directed, according to some embodiments. The slave device address field 2601 may be used by process 2400 described with reference to FIG. 24 to perform a reset of the slave device based on the reset associated with an address in slave device address field 2601, according to some embodiments. In some embodiments, slave device address field 2601 may be configured to include an IP address, an electromagnetic wavelength, etc. for the slave device to process.

Data package 2600 is also shown to contain a reset type field 2602, wherein the reset type field 2602 may indicate a type of reset to be performed, according to some embodiments. The reset type field 2602 may be used by process 2500 described with reference to FIG. 25 to perform a reset of the slave device based on the reset detailed by the reset type field 2602. In some embodiments, the reset type field may include the reset to be performed and/or other operations for the slave device to perform.

Figure 27:
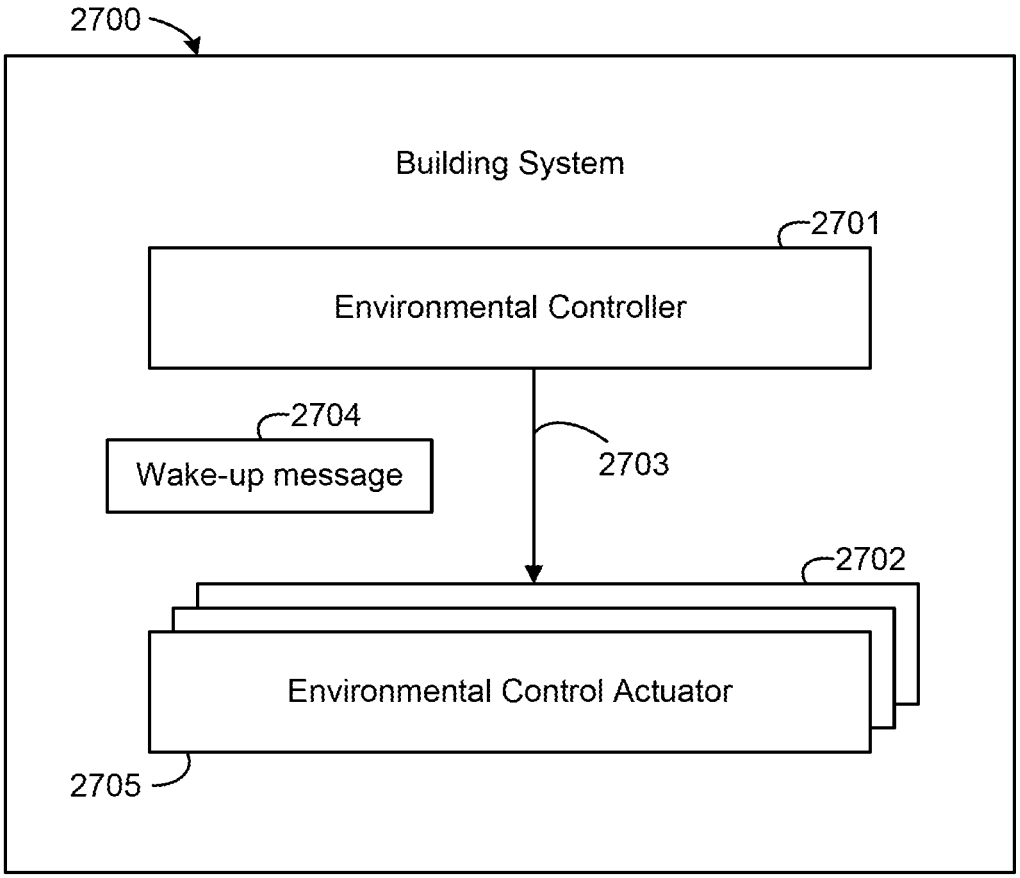
FIG. 27 is a block diagram of a building system including an environmental controller and one or more environmental control actuators, according to an exemplary embodiment.

Referring now to FIG. 27, a building system 2700 is shown, according to an exemplary embodiment. Building system 2700 is shown to include an environmental controller 2701 and a set of environmental control actuators 2702 to which an environmental control actuator 2705 belongs. From here forward, the environmental control actuator 2705 may act as an exemplary embodiment of how all other environmental control actuators in the set of environmental control actuators 2702 may operate. In some embodiments, environmental control actuator 2705 may be unique in its operation or may be the same in its operation in regards to the other environmental control actuators in the set of environmental control actuators 2702. Environmental control actuators are commonly used in building systems to evoke a change in some environmental setting in a building, according to some embodiments. In some embodiments, environmental control actuators may open and/or close air ducts, adjust lighting, adjust temperature, adjust air quality, etc. in a building system. The set of environmental control actuators 2702 can include one or more environmental control actuators that are configured to operate within the building system 2700 in response to directions via the environmental controller 2701, according to some embodiments. In the building system 2700, the environmental controller 2701 may be configured to manage the set of environmental control actuators 2702 via one or more communication channels. A wake-up communication channel 2703 similar to and/or the same as the wake-up communication channel 403 as described with reference to FIG. 4 may be configured to transmit a wake-up message 2704 from the environmental controller 2701 to an environmental control actuator in the set of environmental control actuators 2702. The wake-up communication channel 2703 can be any of the various wireless data transferring mediums (e.g., LAN, WAN, MAN, Bluetooth, Wi-Fi, Zigbee, etc.). In this regard, environmental controller 2701 and the set of environmental control actuators 2702 can include the hardware and/or software to make the wake-up communication channel 2703 possible.

The power consumption in building system 2700 can be high if one or more environmental control actuators are always operating in a high power state, regardless if they are effecting a change. In a building system wherein wake-up radio features are not used, all environmental control actuators may constantly be in a high power state, even if there are long periods of time where they may not receive any message indicating an environmental change needs to occur. Similarly, in a case where a building's environmental controller is disabled, there may be no need for the entire set of environmental control actuators to operate in a high power state if they cannot receive instructions to effect an environmental change.

In some embodiments, some and/or all of the components of the environmental control actuator 2705 can operate at a low power state. In some embodiments, when components are operating at the low power state, the components may not receive any power. When not receiving any power, the components may not be able to perform any operations, according to some embodiments. In some embodiments, components operating in the low power state may receive minimal amounts of power. While receiving minimal amounts of power, the components of the environmental control actuator 2705 may be able to perform limited operations, but not all of the operations the environmental control actuator 2705 can perform when operating with full power where full power may be an amount of power the environmental control actuator 2705 requires to perform all configured operations. For example, an environmental control actuator to control lighting operating at the low power state may be able to operate lights at a dim level, but not at a bright level, according to some embodiments. Once the wake-up message 2704 is received by the wake-up radio of environmental control actuator 2705, environmental control actuator 2705 can operate its other components in a high power state so that it can effect a change on an environment in the building system 2700, according to some embodiments. After the environmental control actuator effects the change on the environment, it can then return some and/or all of its components to the low power state in order to reduce power consumption, according to some embodiments. In some embodiments, the environmental control actuator may remain in the high power state until the environmental controller 2701 communicates to the environmental control actuator that it can return some and/or all of its components to the low power state.

Figure 28:
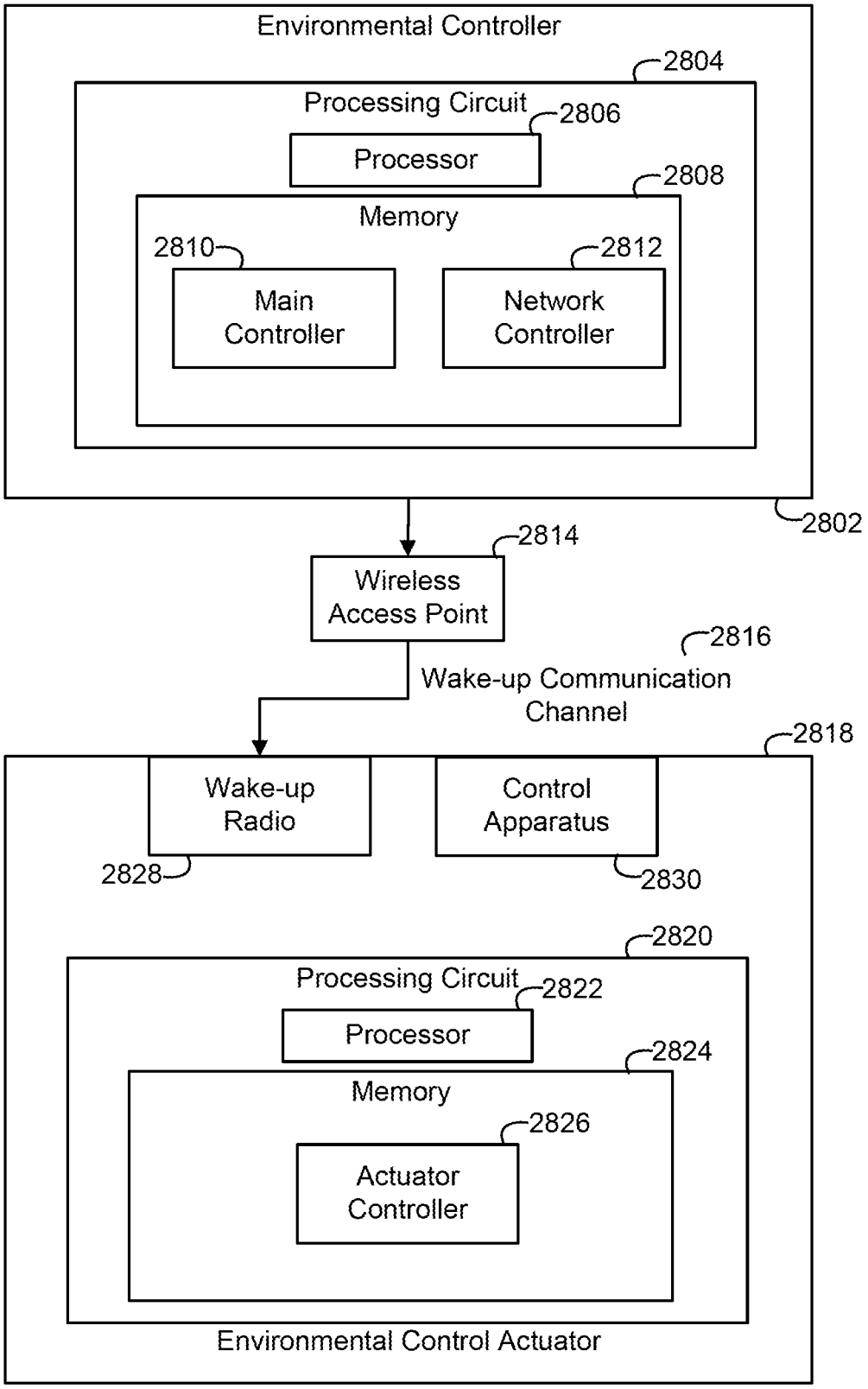
FIG. 28 is a block diagram of the communication of a wake-up message from an environmental controller to an environmental control actuator via a wireless access point to operate a control apparatus of the environmental control actuator wherein the communication can be performed by the environmental controller and one of the one or more environmental control actuators of FIG. 27, according to an exemplary embodiment.

Referring now to FIG. 28, an environmental controller 2802 is shown in greater detail in regards to the environmental controller 2701 of FIG. 27, according to some embodiments. In some embodiments, the environmental controller 2802 may be configured to operate one or more environmental control actuators including an environmental control actuator 2818. In some embodiments, the environmental controller 2802 may acquire environmental data from one or more environmental sensors and make determinations on what environmental control actuators should be operated in order to effect a change on an environment within the building system 2700. In some embodiments, the environmental controller 2802 may provide an interface to users where the users can set desired environmental conditions that the environmental controller 2802 can control one or more environmental control actuators to achieve.

In some embodiments, environmental controller 2802 includes a processing circuit 2804, wherein processing circuit 2804 includes a processor 2806 and a memory 2808. Processor 2806 can be implemented as a general-purpose processor, an application specific integrated circuit (ASIC), one or more field programmable gate arrays (FPGAs), a group of processing components, or other suitable electronic processing components.

Memory 2808 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 2808 may be or include volatile memory or non-volatile memory. Memory 2808 may include database components, object code components, script components, or any other type of information structure for supporting the various activities and information structures described in the present application. According to some embodiments, memory 2808 may be communicably connected to processor 2806 via processing circuit 2804 and includes computer code for executing (e.g., by processing circuit 2804 and/or processor 2806) one or more processes described herein.

Still referring to FIG. 28, memory 2808 is shown to include a main controller 2810 and a network controller 2812, according to some embodiments. Network controller 2812 may facilitate communication of the environmental controller 2802 over one or more networks (e.g. internal building networks, an IP based network, etc.). This communication over the one or more networks may allow the environmental controller 2802 to receive network data, according to some embodiments. The network data can include instructions to perform an adjust on one or more environmental control actuators, the status of one or more environments in building system 2700, information on new environmental control actuators installed in the building system 2700, communicate data on the environmental control actuators the environmental controller 2802 operates, etc., according to some embodiments. In some embodiments, main controller 2810 may be configured to make a determination if an environment within a building system 2700 needs to be modified. In response to the determination that an environment in the building system 2700 needs to be modified, the environmental controller 2802 may decide if an environmental control actuator should be woken up and/or effect a change on building equipment, according to some embodiments.

Still referring to FIG. 28, an environmental control actuator 2818 is shown in greater detail in regards to the environmental control actuator 2705 of FIG. 27, according to some embodiments. Environmental control actuator 2818 is shown to include a processing circuit 2820, wherein processing circuit 2820 includes a processor 2822 and a memory 2824. Processor 2822 can be implemented as a general-purpose processor, an application specific integrated circuit (ASIC), one or more field programmable gate arrays (FPGAs), a group of processing components, or other suitable electronic processing components.

Memory 2824 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 2824 may be or include volatile memory or non-volatile memory. Memory 2824 may include database components, object code components, script components, or any other type of information structure for supporting the various activities and information structures described in the present application. According to some embodiments, memory 2824 may be communicably connected to processor 2822 via processing circuit 2820 and includes computer code for executing (e.g., by processing circuit 2820 and/or processor 2822) one or more processes described herein.

Memory 2824 is shown to include an actuator controller 2826. Actuator controller 2826 may be configured to operate a control apparatus 2830 in response to the reception of a wake-up message via a wake-up radio 2828, according to some embodiments. Actuator controller 2826 may be configured to determine how to operate the control apparatus 2830 based on the contents of the wake-up message and/or the address the wake-up message may be sent to, according to some embodiments. In some embodiments, actuator controller 2826 may be able to operate the control apparatus 2830 in one or more than one way. The control apparatus 2830 may be able to effect a change on one environmental condition such as temperature, ventilation, lighting, air flow, air quality, etc., according to some embodiments. In some embodiments, control apparatus 2830 may be able to effect a change on multiple environmental conditions.

The environmental controller 2802 and the environmental control actuator 2818 are shown connected by a wireless access point 2814 and a wake-up communication channel 2816, according to some embodiments. In some embodiments, wake-up communication channel 2816 may be similar to and/or the same as wake-up communication channel 2703 described with reference to FIG. 27. In some embodiments, wireless access point 2814 may be a standard networking device that allows environmental control actuators to connect over Wi-Fi and/or another wireless data transferring medium to the environmental controller 2802.

The environmental controller 2802 may be configured to communicate a message to the wireless access point 2814, according to some embodiments. In some embodiments, the message may be configured to cause the wireless access point 2814 to communicate a wake-up message to the wake-up radio 2828 via wake-up communication channel 2816, according to some embodiments. The wake-up radio 2828 may be configured to receive the wake-up message at some point in time after the wireless access point 2814 communicates the wake-up message. The environmental control actuator 2818 may be configured to operate some and/or all of its components in a high power state in response to the reception of the wake-up message, according to some embodiments. While operating in the high power state, the environmental control actuator 2818 may be able to determine what operation the environmental controller 2802 communicated via the wake-up message, according to some embodiments. In some embodiments, when the environmental control actuator 2818 is operating in the high power state it may be able to evoke a change on an environment in building system 2700 via the control apparatus 2830.

In some embodiments, the wireless access point 2814 and the environmental controller 2802 may be separate devices. In some embodiments, the wireless access point may be connected through a wired and/or wireless connection. In some embodiments, the wireless access point 2814 and the environmental controller 2802 may be a part of the same device. In some embodiments, when the wireless access point 2814 and the environmental controller 2802 are a part of the same device, communication of the wake-up message may happen faster as the device that determines that the wake-up message should be communicated and the device that communicates the wake-up message are the same.

Figure 29:
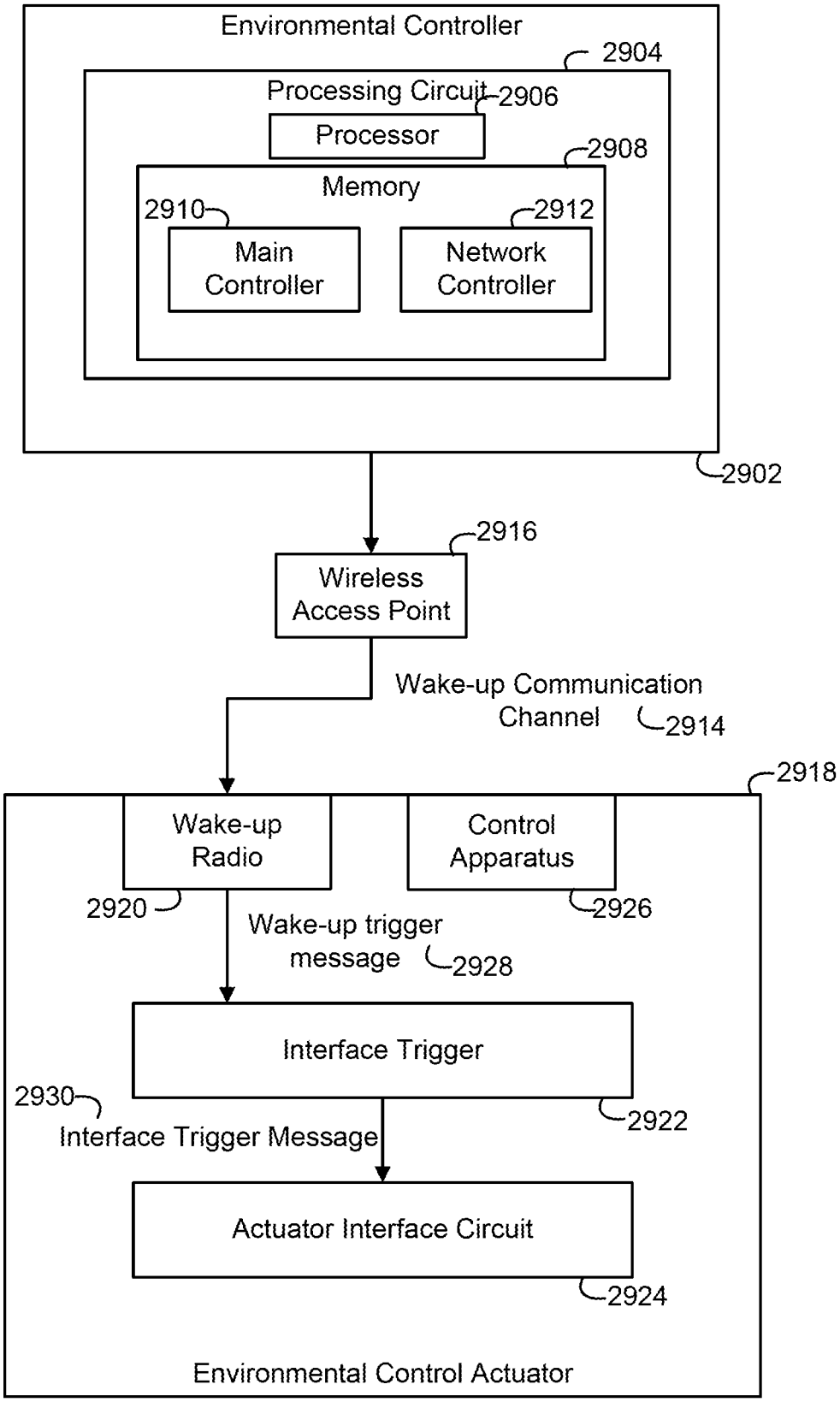
FIG. 29 is a block diagram of the communication of a wake-up message from an environmental controller to an environmental control actuator differing in structure from the environmental control actuator of FIG. 28 via a wireless access point to operate a control apparatus of the environmental control actuator wherein the communication can be performed by the environmental controller and one of the one or more environmental control actuators of FIG. 27, according to an exemplary embodiment.

Referring now to FIG. 29, an environmental controller 2902 and an environmental control actuator 2918 are shown connected by a wake-up communication channel 2914 and a wireless access point 2916, according to some embodiments. In some embodiments, environmental controller 2902 may be similar to and/or the same as environmental controller 2802 described with reference to FIG. 28. In some embodiments, wireless access point 2916 and wake-up communication channel 2914 may be similar to and/or the same as wireless access point 2814 and wake-up communication channel 2816 described with reference to FIG. 28 respectively, according to some embodiments.

Still referring to FIG. 29, an environmental control actuator 2918 differing from the environmental control actuator 2818 of FIG. 28 is shown, according to some embodiments. The environmental control actuator 2918 may be configured to operate a control apparatus in response to the reception of a wake-up message through a different method than the environmental control actuator 2818, according to some embodiments.

Environmental control actuator 2918 consists of a wake-up radio 2920, an interface trigger 2922, an actuator interface circuit 2924, and a control apparatus 2926, according to some embodiments. Wake-up radio 2920 may be configured to communicate a wake-up trigger message 2928 to the interface trigger 2922. In some embodiments, the wake-up trigger message 2928 may be a simple electrical impulse and/or may be a message including information from the environmental controller 2902 and/or the wake-up radio 2920. The interface trigger 2922 may be then configured to communicate an interface trigger message 2930 to the actuator interface circuit 2924 in response to the reception of the wake-up trigger message 2928. In some embodiments, the interface trigger message 2930 may be a simple electric impulse and/or may be a message including information from the wake-up trigger message 2928 and/or the interface trigger 2922. The actuator interface circuit 2924 may then be configured to operate the control apparatus 2926 in response to the reception of the interface trigger message 2930, according to some embodiments. In some embodiments, the actuator interface circuit 2924 may be configured to operate the control apparatus 2926 in a predetermined way and/or may operate the control apparatus 2926 based on direction given by the interface trigger message 2930. In some embodiments, the actuator interface circuit 2924 may operate the control apparatus 2926 in a way determined by the environmental controller 2902 based on an environment within a building system needing to change.

Figure 30:
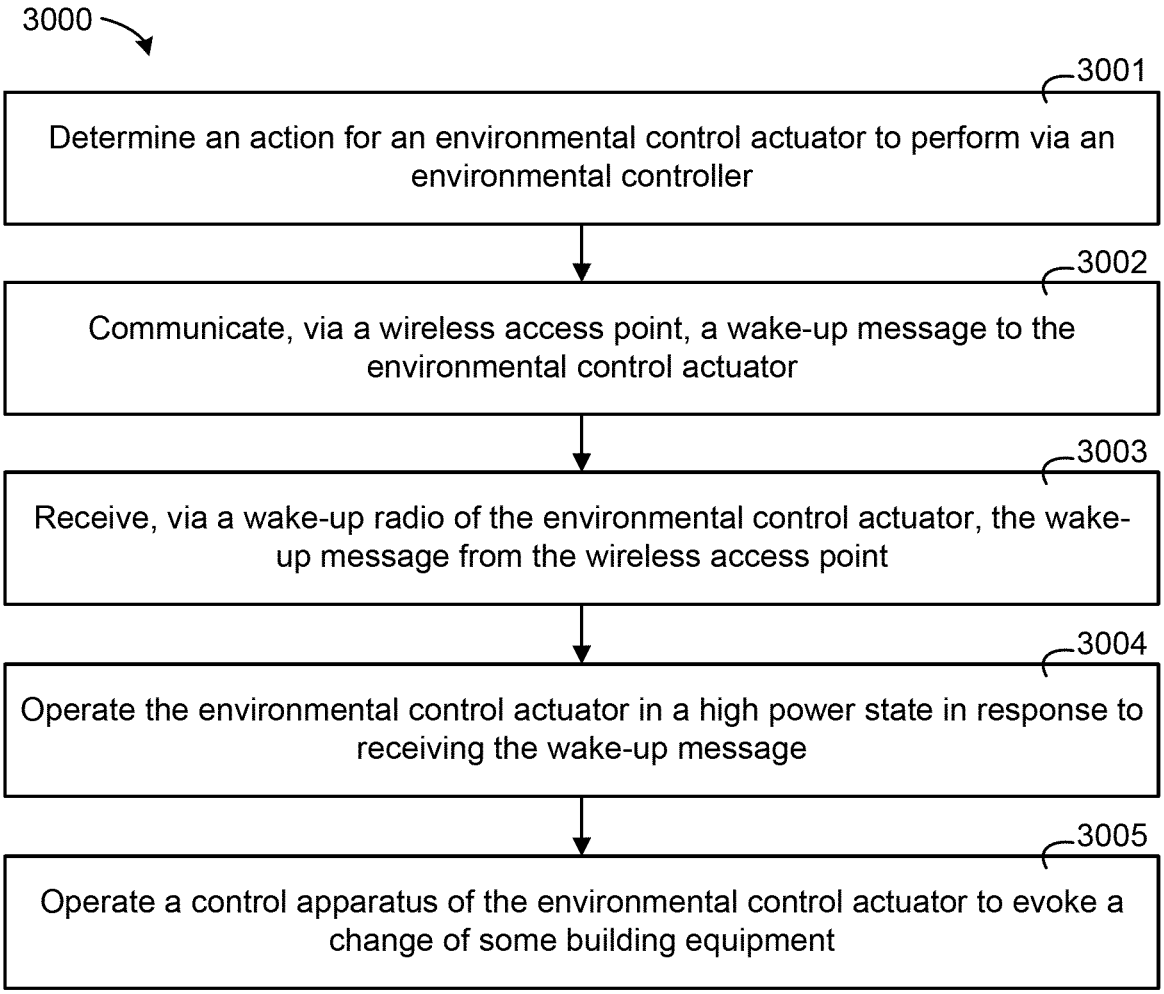
FIG. 30 is a flow diagram of the process where an environmental controller may communicate a wake-up message to an environmental control actuator in order to evoke a change of some building equipment that can be performed by the environmental controller and one of the one or more environmental control actuators of FIG. 27, according to an exemplary embodiment.

Referring now to FIG. 30, a process 3000 of the communication of a wake-up message from an environmental controller to an environmental control actuator is shown, according to some embodiments. In some embodiments, the wake-up message can be configured to operate the environmental control actuator in a high power state. In some embodiments, the environmental control actuator operating in the high power state may have some and/or all of its components receiving a necessary amount of power to be able to perform all of operations the components are configured to do. In some embodiments, the environmental controller 2701 and the environmental control actuator 2705 can be configured to perform some and/or all of the steps of process 3000.

In step 3001, the environmental controller may make a determination if the environmental control actuator needs to be operated in order to effect a change on an environment within a building system. In some embodiments, the determination that the environmental control actuator needs to be operated can be made by environmental control analyzing the current state of the environment of the building system. If the environment is determined to not be in a desired state, the determination may be made that the environmental control actuator should perform an operation, according to some embodiments. Desired states may include a temperature comfortable for people, proper oxygen levels in the building, bright lighting in a room if the room is too dark for people to see in, window shades being lowered to block excessive sunlight, etc., according to some embodiments.

In step 3002, if the determination in step 3001 is that the environmental control actuator needs to be operated, the environmental controller may communicate, via a wireless access point, a wake-up message to the environmental control actuator, according to some embodiments. In some embodiments, the wake-up message may be a specialized communication message sent via the wireless access point to operate the environmental control actuator in the high power state. In some embodiments, the wake-up message may include instructions for the environmental control actuator to perform when operating in the high power state. The instructions in the wake-up message may be any instructions to effect a change to reach a desired state of the environment, according to some embodiments.

In step 3003, a wake-up radio of the environmental control actuator may receive the wake-up message communicated by the wireless access point. Prior to receiving the wake-up message, the environmental control actuator may be operating in a low power state where some and/or all of the components of the environmental control actuator may be receiving none and/or limited amounts of power, according to some embodiments. In some embodiments, the wake-up radio may always be operating with enough power as to receive the wake-up message and bring the environmental control actuator to the high power state based on the reception of the wake-up message.

In step 3004, the environmental control actuator may operate in the high power state based on the reception of the wake-up message in step 3003. Once operating in the high power state, the environmental control actuator may be able to evoke a change on some environment in the building system, according to some embodiments.

In step 3005 the environmental control actuator may operate the control apparatus to evoke a change in the environment of the building system identified by the environmental controller. In some embodiments, the operation performed by the control apparatus may be a preconfigured operation that occurs in response to the reception of a wake-up message such as a light toggling between on or off, a vent toggling between fully open or fully shut, a heating system toggling between on or off, etc. In some embodiments, the operation performed by the control apparatus may be in response to the configuration of the wake-up message communicated by the wireless access point. The wake-up message may be able to be configured to operate the control apparatus in one or more ways (e.g. multiple heights to move a window blind to, multiple angles for a fan to blow at, multiple temperatures for a heating system, etc.).

Figure 31:
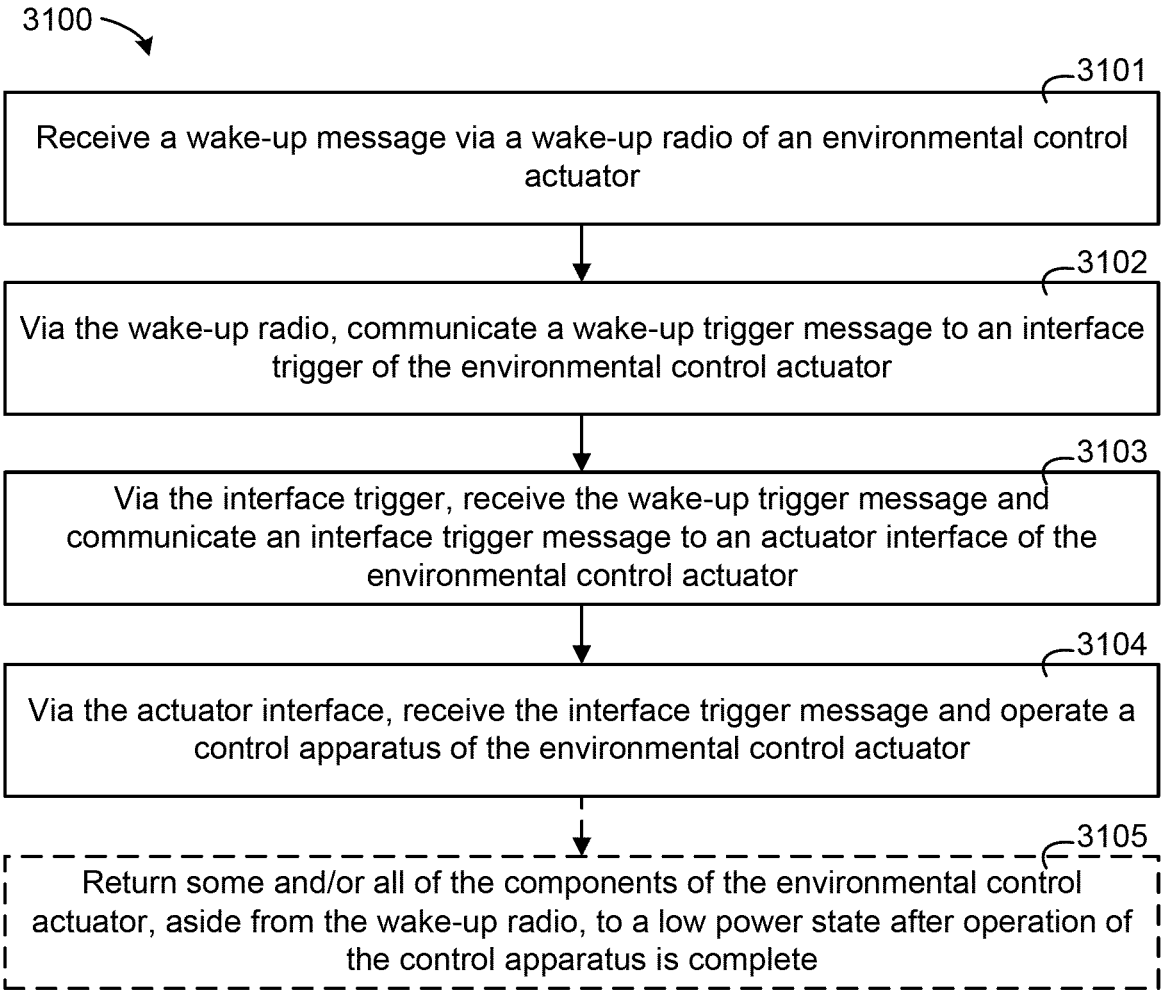
FIG. 31 is a flow diagram of a process that can be performed by the environmental control actuator of FIG. 29 to operate the control apparatus in response to a reception of a wake-up message, according to an exemplary embodiment.

Now referring to FIG. 31, a process 3100 further of how the environmental control actuator 2918 described with reference to FIG. 29 may operate based on the reception of a wake-up message, according to some embodiments. The environmental control actuator 2918 may be a specialized environmental control actuator without a processing circuit like that of environmental control actuator 2818 described with reference to FIG. 28, according to some embodiments. In some embodiments, environmental control actuator 2918 may operate the control apparatus 2926 through a series of trigger messages internal to the environmental control actuator 2918 in response to the reception of the wake-up message.

In step 3101, the wake-up radio 2920 of the environmental control actuator 2918 may receive a wake-up message, according to some embodiments. In some embodiments, the wake-up message may be a specialized communication message where the wake-up message only indicates to the environmental control actuator 2918 to operate in a high power state. In some embodiments, the wake-up message may contain information about how the environmental control actuator 2918 should operate the control apparatus 2926 to effect a change in an environmental within a building system.

In step 3102, the wake-up radio 2920 may be configured to communicate a wake-up trigger message 2928 to the interface trigger 2922 of the environmental control actuator 2918 in response to the reception of the wake-up message, according to some embodiments. Before the communication of the wake-up trigger message 2928, the wake-up radio 2920 may be the only component of the environmental control actuator 2918 that may be operating in a high power state, according to some embodiments. In some embodiments, the wake-up trigger message 2928 may be configured as to cause the interface trigger 2922 to operate in a high power state if it was not operating in a high power state already. In some embodiments, the wake-up trigger message 2928 may be configured to contain information about how the environmental control actuator 2918 should operate the control apparatus 2926 as indicated by the wake-up message received by the wake-up radio 2920.

In step 3103, the interface trigger 2922 may operate in the high power state in response to the reception of the wake-up trigger message 2928, according to some embodiments. The interface trigger 2922 may then be configured to communicate an interface trigger message 2930 to the actuator interface circuit 2924, in response to the reception of the wake-up trigger message 2928, according to some embodiments. In some embodiments, the interface trigger message 2930 may be configured as to wake-up the actuator interface circuit 2924 and operate it in a high power state if it was not already. In some embodiments, the wake-up trigger message 2928 may be configured to contain information about how the environmental control actuator 2918 should operate the control apparatus 2926 as indicated by the wake-up trigger message 2928.

In step 3104, the actuator interface circuit 2924 may receive the interface trigger message 2930 sent by the interface trigger 2922, according to some embodiments. In some embodiments, in response to the reception of the interface trigger message 2930, the actuator interface circuit 2924 may be configured to operate in the high power state if it was not already. In some embodiments, operating in the high power state indicates the actuator interface circuit 2924 may have the ability to interpret information contained in the interface trigger message 2930 and/or operate the control apparatus 2926. The actuator interface circuit 2924 may be further configured to operate the control apparatus 2926 in response to receiving the interface trigger message 2930. In some embodiments, the actuator interface circuit 2924 may operate the control apparatus 2926 in a predetermined way.

In some embodiments, the actuator interface circuit 2924 may operate the control apparatus 2926 based on information contained in the interface trigger message 2930. Once the control apparatus 2926 is operated and/or reaches a desired state, an environment in the building system 2700 described with reference to FIG. 27 may experience a change, according to some embodiments.

In step 3105, an optional step of process 3100, the environmental control actuator 2918 may be configured to return some and/or all of its components to a low power state in order to reduce system power consumption after the control apparatus 2926 reaches a desired state, according to some embodiments. In some embodiments, the environmental control actuator 2918 may be configured to keep some and/or all of its components in the high power state in response to a determination the components may need to be operated again.

Figure 32:
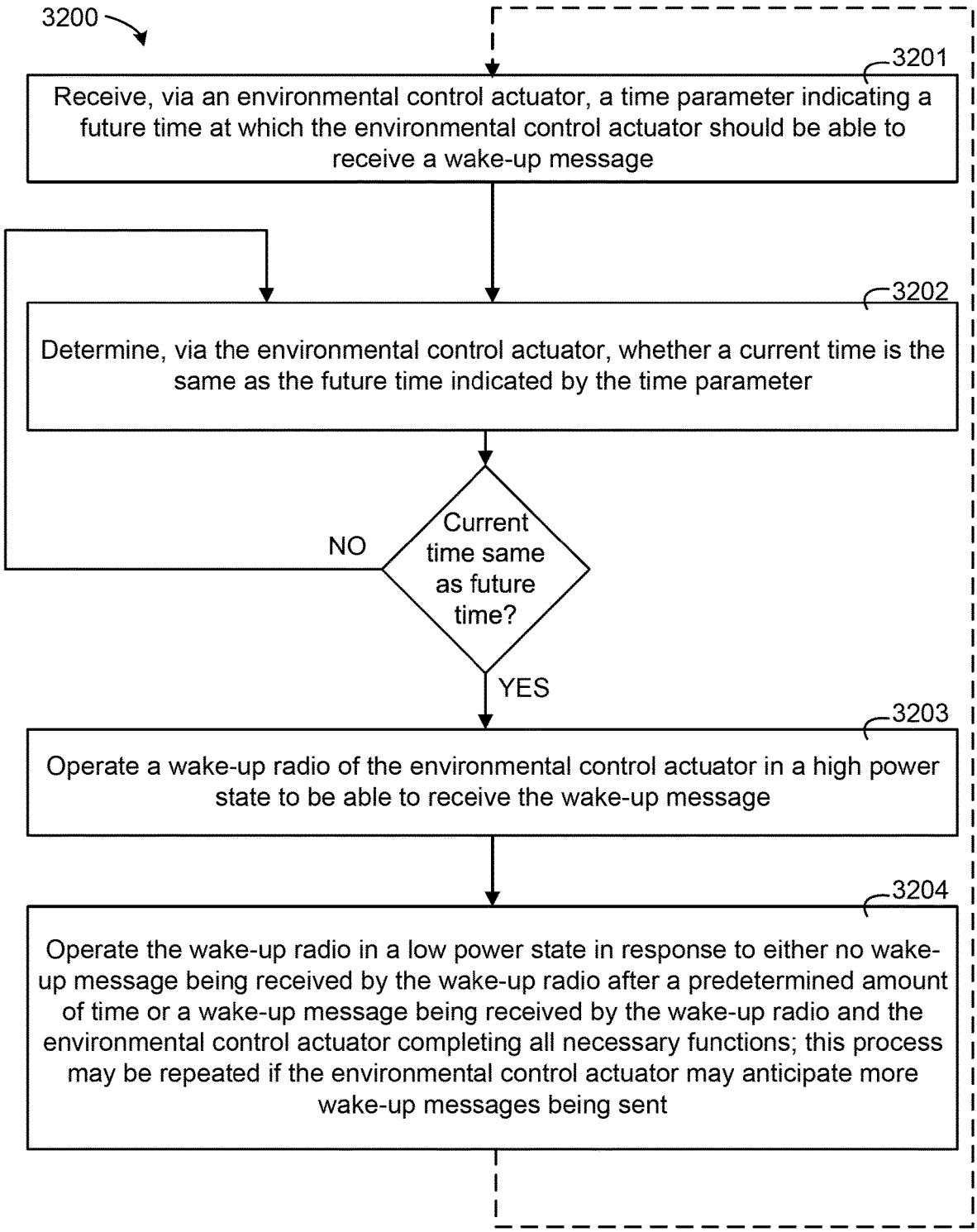
FIG. 32 is a flow diagram of a process of operating a wake-up radio of an environmental control actuator in a high power state based on a provided time parameter that can be performed by one of the one or more environmental control actuators of FIG. 27, according to an exemplary embodiment.

Now referring to FIG. 32, a process 3200 for operating a wake-up radio of an environmental control actuator in a high power state based on a provided time parameter is shown, according to some embodiments. In some embodiments, the environmental control actuator 2705 and the environmental controller 2701 described with reference to FIG. 27 may be configured to perform some and/or all of the steps of process 3200.

In step 3201, the environmental control actuator may receive a time parameter indicating a future time at which the environmental control actuator should operate the wake-up radio in the high power state. When operating the wake-up radio in the high power state, the environmental control actuator may be able to receive a wake-up message from the environmental controller, according to some embodiments. In some embodiments, the time parameter may be communicated by an environmental controller. In some embodiments, the time parameter can be manually programmed into the environmental control actuator.

In step 3202, the environmental control actuator may make a determination if the indicated future time of the time parameter is a current time. This determination may be made by a low power circuit of the environmental control actuator that has an ability to track the current time and make a comparison if the indicated future time of the time parameter is the same as the current time, according to some embodiments. If the determination is that the current time is not the indicated future time, the environmental control actuator may repeat the step 3202, according to some embodiments. In some embodiments, the comparison between the indicated future time and the current time can continue to be run by the lower power circuit until the current time is the same as the indicated future time. Even though the low power circuit may make many comparisons between the current time and the indicated future time, the power consumed by the low power circuit can still be less than the wake-up radio continuously operating at a power state where it can receive a wake-up message, according to some embodiments. If the determination is that the current time is the future time, process 3200 may continue to step 3203, according to some embodiments.

In step 3203, the environmental control actuator may operate the wake-up radio in the high power state in response to the determination made in step 3202 that the current time is the indicated future time. When operating in the high power state, the wake-up radio may be able to receive the wake-up message communicated by the environmental controller, according to some embodiments. In some embodiments, when the wake-up radio is operating in the high power state, the wake-up radio can only receive the wake-up message and/or operate some and/or all of the components of the environmental control actuator in the high power state if the wake-up message is received.

In step 3204, the environmental control actuator may operate the wake-up radio in a low power if either no wake-up message is received after a predetermined time period, according to some embodiments. In some embodiments, the environmental control actuator may operate the wake-up radio in the low power state if the wake-up message is received and the environmental control actuator has completed operating a control apparatus. Once the wake-up radio of the environmental control actuator is operating in the low power state, process 3200 may repeat starting in step 3201. In some embodiments, process 3200 may repeat if another time parameter is received by the environmental control actuator and/or the environmental control actuator and/or the environmental controller expect the environmental control actuator to operate at the high power state at some future time.

Process 3200 may further reduce power consumption of a building system by operating the wake-up radio of the environmental control actuator only at particular times based on provided time parameters. As the wake-up radio may spend at least some portion of its existence in a low power state, it may be inevitable that less power will be used by the system overall. Further considering that the environmental control actuator may be one of many in a set of environmental control actuators, power consumption may drop significantly over the building system if one or more of wake-up radios are sometimes operated in a low power state. In some embodiments, making determinations whether the indicated future time and the current time are the same requires less power than constantly operating the wake-up radio in the high power state. Therefore, in some embodiments, wake-up radio scheduling functionality can conserve power in the building system.

Figure 33:
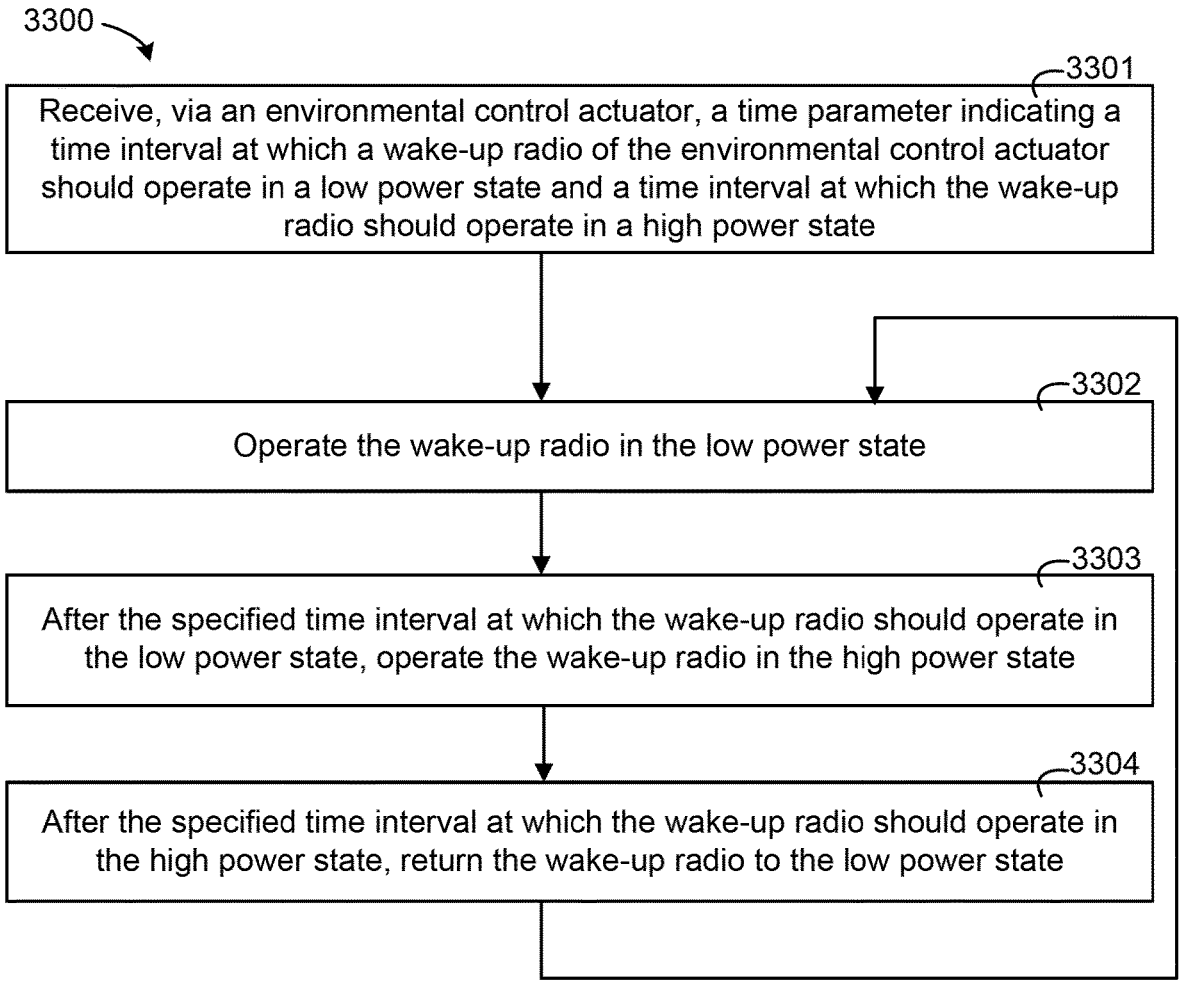
FIG. 33 is a flow diagram of a process of operating a wake-up radio of an environmental control actuator in a high power state based on a provided time interval that can be performed by one of the one or more environmental control actuators of FIG. 27, according to an exemplary embodiment.

Referring now to FIG. 33, a process 3300 for operating a wake-up radio of an environmental control actuator in a low power state or a high power state during time intervals specified in a time parameter is shown, according to some embodiments. In some embodiments, the environmental controller 2701 and/or the environmental control actuator 2705 may be configured to perform some and/or all of the steps of process 3300.

In step 3301, the environmental control actuator may receive the time parameter. In some embodiments, the time parameter may be communicated by an environmental controller. In some embodiments, the time parameter can be manually configured into the environmental control actuator. In some embodiments, the time parameter may include a high time interval where the environmental control actuator should operate the wake-up radio in the high power state, and a low time interval which indicates an amount of time the environmental control actuator should operate the wake-up radio in the low power state. In some embodiments, the high time interval and the low time interval are different amounts of time where the high time interval may be shorter than the low time interval. In some embodiments, the low time interval can be shorter than the high time interval. In some embodiments the time parameter can include a single time interval which indicates the environmental control actuator should operate the wake-up radio in the low power state and the high power state for the same amount of time.

In step 3302, some and/or all of the components of the environmental control actuator may be operated in the low power state to conserve energy usage. When the components of the environmental control actuator are operated in the low power state, the environmental control actuator may operate similarly and/or the same as the environmental control actuator operating in the low power state as described in reference to FIG. 30, according to some embodiments. In some embodiments, a low power circuit similar to and/or the same as the low power circuit described with reference to FIG. 32 may continue operation to track a current time and make comparisons between the current time and a future time. These comparisons can determine if an amount of time has passed as indicated by the time interval(s) where the wake-up radio of the environmental control actuator should alternate between the high power state to the low power state, or the low power state to the high power state, according to some embodiments.

In step 3303, the low power circuit may make a determination that the wake-up radio has operated in the low power state for the amount of time specified by the low time interval or the single time interval, according to various embodiments. In response to the determination that the wake-up radio has operated for the specified amount of time in the low power state, the wake-up radio can operate in the high power state, according to some embodiments.

In step 3304, the low power circuit may make a determination that the wake-up radio has operated in the high power state for the amount of time specified by the high time interval or the single time interval, according to various embodiments. In response to the determination that the wake-up radio has operated for the specified amount of time in the high power state, the wake-up radio can operate in the low power state, according to some embodiments. The wake-up radio operating in the low power state may not receive the amount of power necessary to be able to receive the wake-up message from the environmental controller, according to some embodiments. In some embodiments, once the wake-up radio is operating in the low power state, process 3300 may return to step 3302 where the low power circuit can continue to make determinations to switch the wake-up radio between the high power state and the low power state.

By periodically operating the wake-up radio in a low or high power state, only one time parameter may need to be passed to the wake-up radio in comparison to the multiple individual time parameters in FIG. 32. This simplifies a building system further by reducing the amount of additional communications that need to occur in order for all the components of the building system to function appropriately.

Figure 34:
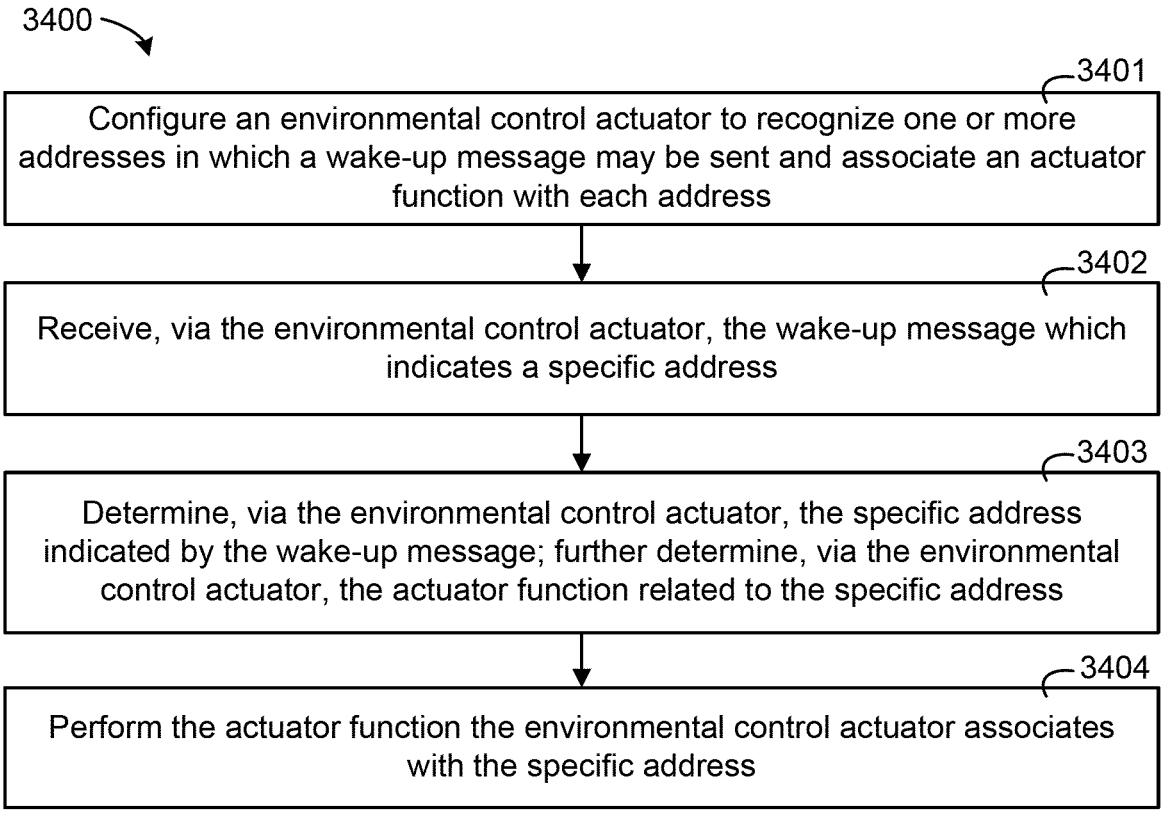
FIG. 34 is a flow diagram of a process by which an environmental control actuator may perform a certain operation of a control apparatus based on an address of a recovery message communicated by an environmental controller that can be performed by the environmental controller and one of the one or more environmental control actuators of FIG. 27, according to an exemplary embodiment.

Referring now to FIG. 34, a process 3400 for performing a predetermined control operation of an environmental control actuator based on an address that a wake-up message may be sent to is shown, according to some embodiments. In some embodiments, an address may include an electromagnetic wavelength a wake-up radio of the environmental control actuator may be listening to, a packet header of the wake-up message, an internet protocol (IP) address the wake-up message may be received on, etc. In some embodiments, the environmental control actuator 2705 described with reference to FIG. 27 may be configured to perform some and/or all of the steps of process 3400.

In step 3401, the environmental control actuator may be configured to recognize one or more addresses wherein each address may be related to a preconfigured control operation, according to some embodiments. For example, the wake-up radio of the environmental control actuator may be configured to have two IP addresses where if the wake-up message is sent to the first IP address the environmental control actuator may perform a first control operation (e.g., a window blind opening partway, a vent opening partway, a fan blowing at half speed, etc.) and if the wake-up message is sent to the second IP address the environmental control actuator may perform a second control operation (e.g., a window blind opening fully, a vent opening fully, a fan blowing at full speed, etc.), according to some embodiments.

In step 3402, the environmental control actuator may receive the wake-up message where the wake-up message indicates a specific address, according to some embodiments. In some embodiments, the environmental control actuator can receive the wake-up message via the wake-up radio where the wake-up radio may be similar to and/or the same as the wake-up radio 2828 described with reference to FIG. 28 and/or the wake-up radio 2920 described with reference to FIG. 29, according to some embodiments.

In step 3403, the environmental control actuator may determine what address was indicated by the wake-up message. Based on what address is determined, the environmental control actuator may determine what associated control operation should be performed, according to some embodiments. In some embodiments, the determination of what control operation to perform may be made by an actuator controller similar to and/or the same as the actuator controller 2826 described with reference to FIG. 28 and/or an actuator interface circuit similar to and/or the same as the actuator interface circuit 2924 described with reference to FIG. 29, according to some embodiments.

In step 3404, the environmental control actuator may perform the control operation determined in step 3403, according to some embodiments. In some embodiments, the environmental control actuator may repeatedly attempt to perform the control operation determined in step 3403 if the previous attempt was unsuccessful. In some embodiments, the environmental control actuator may only perform one attempt of the control operation.

Figure 35:
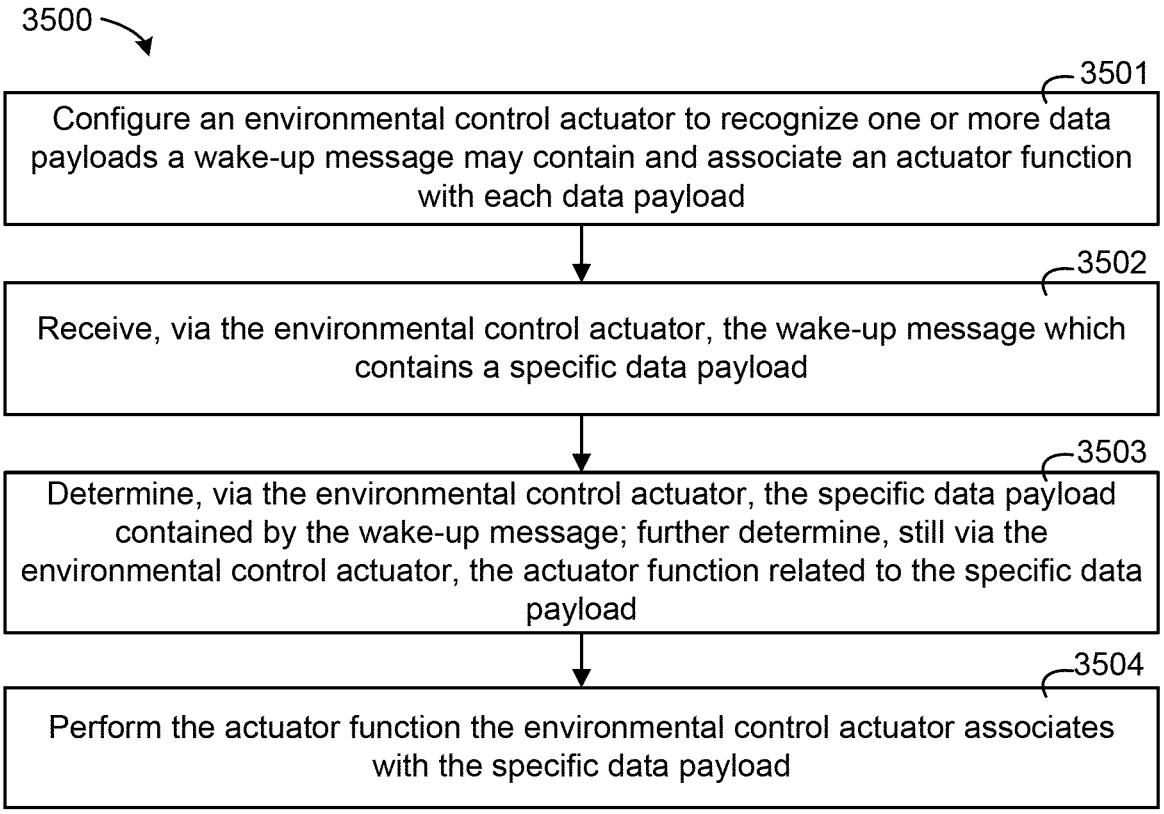
FIG. 35 is a flow diagram of a process where an environmental control actuator may perform a certain operation of a control apparatus based on a data payload of a recovery message communicated by an environmental controller that can be performed by the environmental controller and one of the one or more environmental control actuators of FIG. 27, according to an exemplary embodiment.

Referring now to FIG. 35, a process 3500 for performing a particular control operation based on information contained in a data payload of a wake-up message communicated by an environmental controller is shown, according to some embodiments. In some embodiments, the environmental control actuator 2705 and the environmental controller 2701 described with reference to FIG. 27 may be configured to perform some and/or all of the steps of process 3500.

In step 3501, an environmental control actuator may be configured to recognize one or more data payloads, wherein each data payload indicates a particular control operation to be performed by the environmental control actuator, according to some embodiments. For example, the data payload may contain a binary field wherein binary number 00 indicates first control operation (e.g., a window blind opening partway, a vent opening partway, a fan blowing at half speed, etc.) and binary number 01 indicates a second control operation (e.g., a window blind opening fully, a vent opening fully, a fan blowing at full speed, etc.).

In step 3502, the environmental control actuator may receive the wake-up message via a wake-up radio where the wake-up message contains a data payload indicating a control operation. In some embodiments, the environmental control actuator can receive the wake-up message via the wake-up radio where the wake-up radio may be similar to and/or the same as the wake-up radio 2828 described with reference to FIG. 28 and/or the wake-up radio 2920 described with reference to FIG. 29, according to some embodiments.

In step 3503, the environmental control actuator may determine what data payload is contained by the wake-up message. Based on what data payload is determined, the environmental control actuator may determine what associated control operation should be performed, according to some embodiments. In some embodiments, the determination of what control operation to perform may be made by an actuator controller similar to and/or the same as the actuator controller 2826 described with reference to FIG. 28 and/or an actuator interface circuit similar to and/or the same as the actuator interface circuit 2924 described with reference to FIG. 29, according to some embodiments.

In step 3504, the environmental control actuator may perform the environmental control actuator function determined in step 3503 based on the data payload of the wake-up message, according to some embodiments. In some embodiments, the environmental control actuator may repeatedly attempt to perform the control operation determined in step 3403 if the previous attempt was unsuccessful. In some embodiments, the environmental control actuator may only perform one attempt of the control operation.

Figure 36:
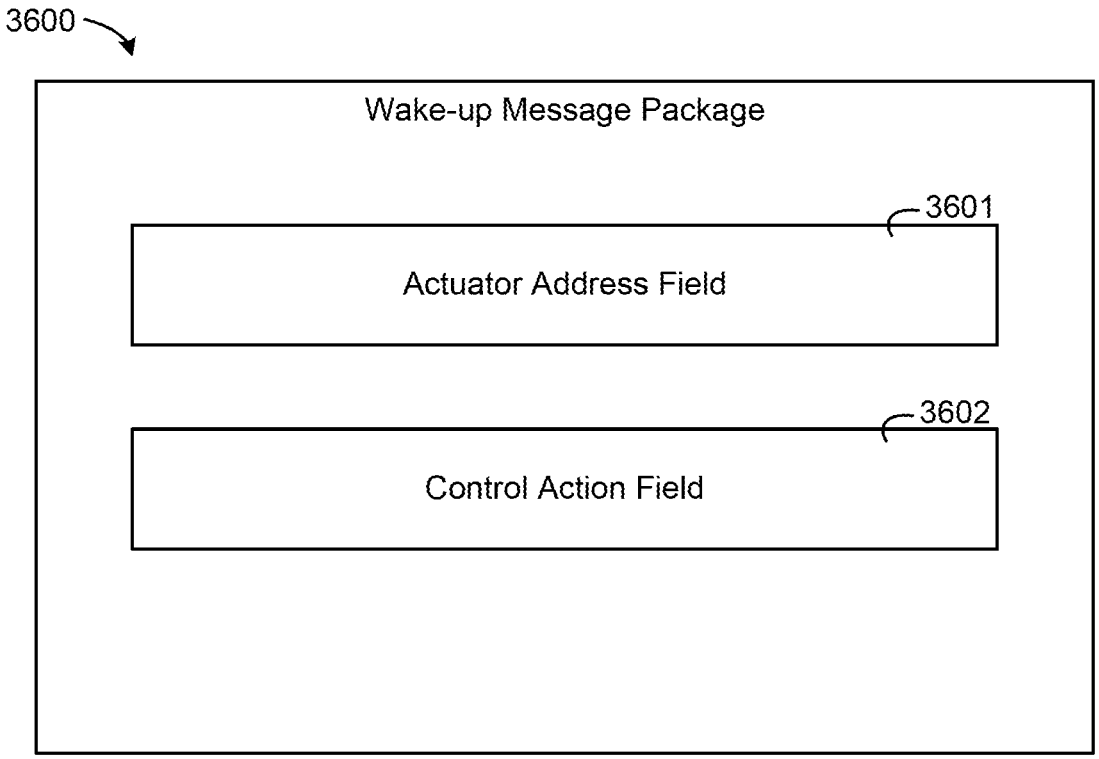
FIG. 36 is a block diagram of a wake-up message package that may be communicated by an environmental controller similar to the environmental controller of FIG. 27, according to an exemplary embodiment.

Referring now to FIG. 36, a block diagram of a wake-up message package 3600 detailing the contents of a wake-up message that may be communicated to an environmental control actuator is shown, according to some embodiments. Wake-up message package 3600 may be included in some and/or all of the wake-up messages described with reference to FIG. 27 through FIG. 35, according to some embodiments.

Wake-up message package 3600 may contain an actuator address field 3601 and/or a control action field 3602, according to some embodiments. The actuator address field 3601 may be configured to specify which environmental control actuator in a set of environmental control actuators the wake-up message should be sent to. The control action field 3602 may be configured to specify which environmental control actuator function should be performed by the environmental control actuator the wake-up message may be directed to. In some embodiments, the process shown in FIG. 34 may use the actuator address field 3601 to perform a control operation of the environmental control actuator. In some embodiments, the process shown in FIG. 35 may use the control action field 3602 to perform a control operation of the environmental control actuator.

Figure 37:
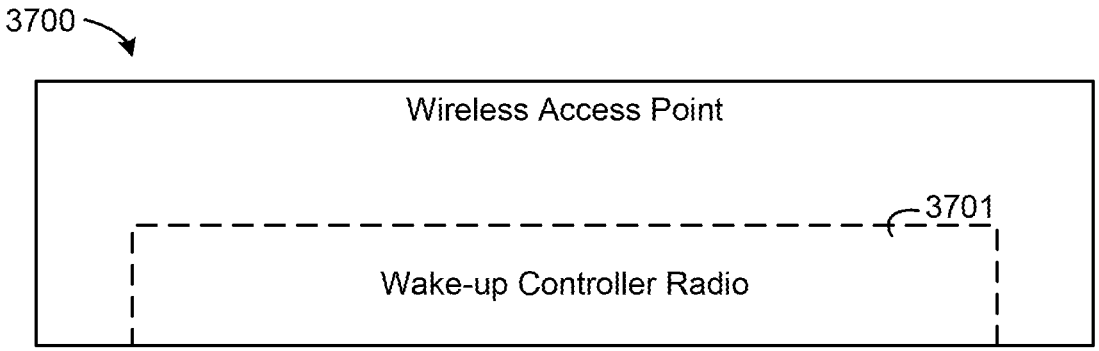
FIG. 37 is a block diagram of a wireless access point that may communicate a wake-up message and that may be similar to and/or the same as the wireless access point of FIG. 28 and/or the wireless access point of FIG. 29, according to an exemplary embodiment.

Referring now to FIG. 37, a block diagram of a wireless access point 3700 is shown, according to some embodiments. In some embodiments, wireless access point 3700 may be configured to communicate a wake-up message to an environmental control actuator at the direction of a message from an environmental controller. In some embodiments, wireless access point 3700 may be similar to and/or the same as the wireless access point 2814 described with reference to FIG. 28 and/or the wireless access point 2916 described with reference to FIG. 29.

According to some embodiments, wireless access point 3700 may contain a wake-up controller radio 3701 as shown. In some embodiments, the wake-up controller radio 3701 may be configured to communicate a wake-up message to an environmental control actuator. In some embodiments, the wake-up message communicated by the wireless access point 3700 may be similar and/or the same as the message communicated to the wireless access point 3700 by the environmental controller. In some embodiments, the wireless access point 3700 may be configured to add additional information to the message communicated to the wireless access point 3700 by the environmental controller in order to make the communication of the wake-up message possible and/or for the environmental control actuator to be able to perform the desired operation.

Figure 38:
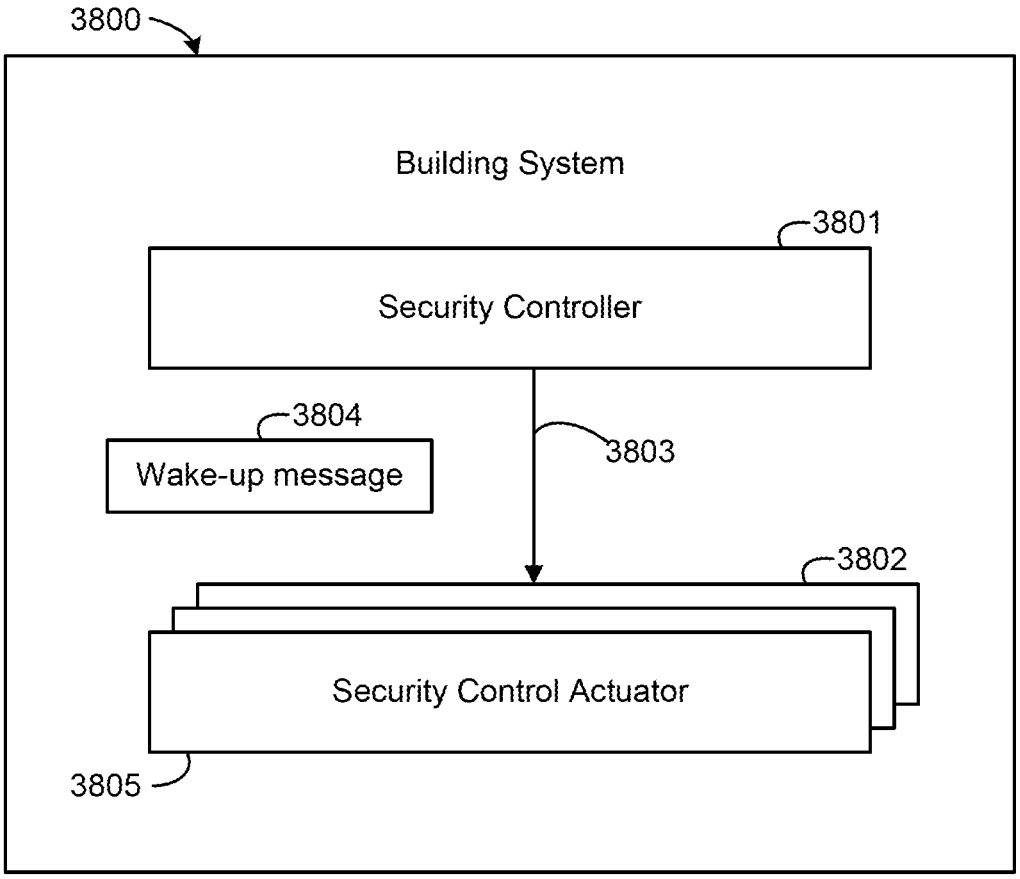
FIG. 38 is a block diagram of a building system including a security controller and one or more security control actuators, according to an exemplary embodiment.

Referring now to FIG. 38, a building system 3800 is shown, according to an exemplary embodiment. Building system 3800 is shown to include a security controller 3801 and a set of security control actuators 3802 to which a security control actuator 3805 belongs. From here forward, the security control actuator 3805 may act as an exemplary embodiment of how all other security actuators in the set of security control actuators 3802 may operate. In some embodiments, security control actuator 3805 may be unique in its operation or may be the same in its operation in regards to the other security actuators in the set of security control actuators 3802. Security actuators are commonly used in building systems to evoke a change in some security setting in a building, according to some embodiments. In some embodiments, security actuators will lock/unlock doors, disable/enable lighting for security, open/close a gate, etc. in a building system. The set of security control actuators 3802 can include one or more security control actuators that are configured to operate within the building system 3800 in response to directions via the security controller 3801, according to some embodiments. In the building system 3800, the security controller 3801 may be configured to manage the set of security control actuators 3802 via one or more communication channels. A wake-up communication channel 3803 similar to and/or the same as the wake-up communication channel 403 as described with reference to FIG. 4 may be configured to transmit a wake-up message 3804 from the security controller 3801 to a security control actuator in the set of security control actuators 3802. The wake-up communication channel 3803 can be any of the various wireless data transferring mediums (e.g., LAN, WAN, MAN, Bluetooth, Wi-Fi, Zigbee, etc.). In this regard, security controller 3801 and the set of security control actuators 3802 can include the hardware and/or software to make the wake-up communication channel 3803 possible.

The power consumption in building system 3800 can be high if one or more security control actuators are always operating in a high power state, regardless if they are effecting a change. In a building system wherein wake-up radio features are not used, all security control actuators may constantly be in a high power state, even if there are long periods of time where they may not receive any message indicating a security change needs to occur. Similarly, in a case where a building's security controller is disabled, there may be no need for the entire set of security control actuators to operate in a high power state if they cannot receive instructions to effect a security change.

In some embodiments, some and/or all of the components of the security control actuator 3805 can operate at a low power state. In some embodiments, when components are operating at the low power state, the components may not receive any power. When not receiving any power, the components may not be able to perform any operations, according to some embodiments. In some embodiments, components operating in the low power state may receive minimal amounts of power. While receiving minimal amounts of power, the components of the security control actuator 3805 may be able to perform limited operations, but not all of the operations the security control actuator 3805 can perform when operating with full power where full power may be an amount of power the security control actuator 3805 requires to perform all configured operations. For example, a security control actuator to lock and unlock a door operating at the low power state may be able to lock the door, but not unlock the door. Once the wake-up message 3804 is received by the wake-up radio of security control actuator 3805, security control actuator 3805 can operate its other components in a high power state so that it can effect a change on a security condition in the building system 3800, according to some embodiments. After the security control actuator effects the change on the security condition, it can then return some and/or all of its components to the low power state in order to reduce power consumption, according to some embodiments. In some embodiments, the security control actuator may remain in the high power state until the security controller 3801 communicates to the security control actuator that it can return some and/or all of its components to the low power state.

Figure 39:
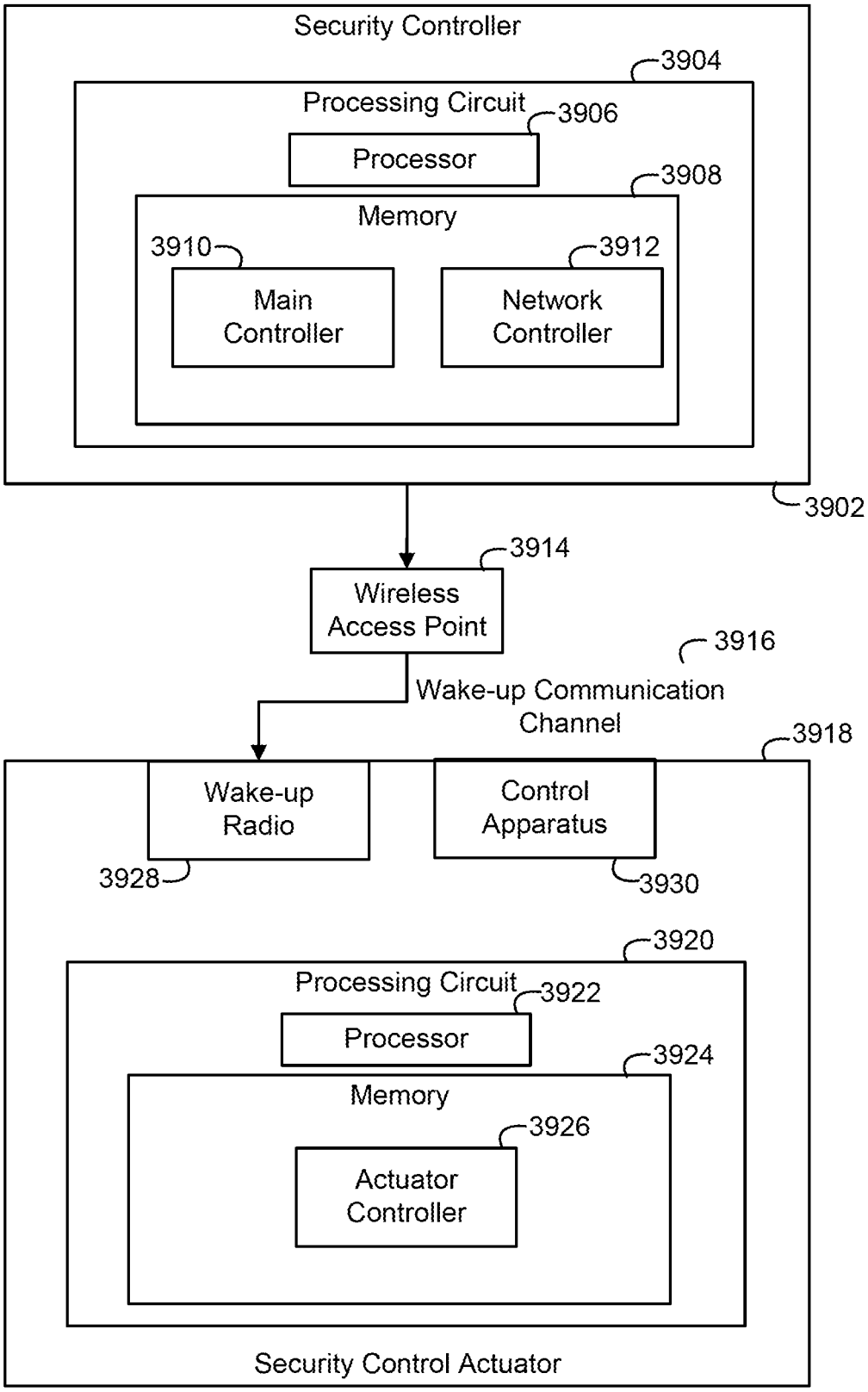
FIG. 39 is a block diagram of the communication of a wake-up message from a security controller to a security control actuator via a wireless access point to operate a control apparatus of the security control actuator wherein the communication can be performed by the security controller and one of the one or more security control actuators of FIG. 38, according to an exemplary embodiment.

Referring now to FIG. 39, a security controller 3902 is shown in greater detail in regards to the security controller 3801 of FIG. 38, according to some embodiments. In some embodiments, the security controller 3902 may be configured to operate one or more security actuators including a security control actuator 3918. In some embodiments, the security controller 3902 may acquire security data from one or more security sensors and make determinations on what security actuators should be operated in order to effect a change on a security condition within the building system 3800. In some embodiments, the security controller 3902 may provide an interface to users where the users can set desired security conditions that the security controller 3902 can control one or more security actuators to achieve.

In some embodiments, security controller 3902 includes a processing circuit 3904, wherein processing circuit 3904 includes a processor 3906 and a memory 3908. Processor 3906 can be implemented as a general-purpose processor, an application specific integrated circuit (ASIC), one or more field programmable gate arrays (FPGAs), a group of processing components, or other suitable electronic processing components.

Memory 3908 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 3908 may be or include volatile memory or non-volatile memory. Memory 3908 may include database components, object code components, script components, or any other type of information structure for supporting the various activities and information structures described in the present application. According to some embodiments, memory 3908 may be communicably connected to processor 3906 via processing circuit 3904 and includes computer code for executing (e.g., by processing circuit 3904 and/or processor 3906) one or more processes described herein.

Still referring to FIG. 39, memory 3908 is shown to include a main controller 3910 and a network controller 3912, according to some embodiments. Network controller 3912 may facilitate communication of the security controller 3902 over one or more networks (e.g. internal building networks, an IP based network, etc.). This communication over the one or more networks may allow the security controller 3902 to receive network data, according to some embodiments. The network data can include instructions to perform an adjust on one or more security actuators, the status of one or more security conditions in building system 3800, information on new security actuators installed in the building system 3800, communicate data on the security actuators the security controller 3902 operates, etc., according to some embodiments. In some embodiments, main controller 3910 may be configured to make a determination if a security condition within a building system 3800 needs to be modified. In response to the determination that a security condition in the building system 3800 needs to be modified, the security controller 3902 may decide if a security control actuator should be woken up and/or effect a change on building equipment, according to some embodiments.

Still referring to FIG. 39, a security control actuator 3918 is shown in greater detail in regards to the security control actuator 3805 of FIG. 38, according to some embodiments. Security control actuator 3918 is shown to include a processing circuit 3920, wherein processing circuit 3920 includes a processor 3922 and a memory 3924. Processor 3922 can be implemented as a general-purpose processor, an application specific integrated circuit (ASIC), one or more field programmable gate arrays (FPGAs), a group of processing components, or other suitable electronic processing components.

Memory 3924 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Memory 3924 may be or include volatile memory or non-volatile memory. Memory 3924 may include database components, object code components, script components, or any other type of information structure for supporting the various activities and information structures described in the present application. According to some embodiments, memory 3924 may be communicably connected to processor 3922 via processing circuit 3920 and includes computer code for executing (e.g., by processing circuit 3920 and/or processor 3922) one or more processes described herein.

Memory 3924 is shown to include an actuator controller 3926. Actuator controller 3926 may be configured to operate a control apparatus 3930 in response to the reception of a wake-up message via a wake-up radio 3928, according to some embodiments. Actuator controller 3926 may be configured to determine how to operate the control apparatus 3930 based on the contents of the wake-up message and/or the address the wake-up message may be sent to, according to some embodiments. In some embodiments, actuator controller 3926 may be able to operate the control apparatus 3930 in one or more than one way. The control apparatus 3930 may be able to effect a change on one security condition such as lock/unlock a door, disable/enable lighting in a room, open/close a gate, etc., according to some embodiments. In some embodiments, control apparatus 3930 may be able to effect a change on multiple security conditions.

The security controller 3902 and the security control actuator 3918 are shown connected by a wireless access point 3914 and a wake-up communication channel 3916, according to some embodiments. In some embodiments, wake-up communication channel 3916 may be similar to and/or the same as wake-up communication channel 3803 described with reference to FIG. 38. In some embodiments, wireless access point 3914 may be a standard networking device that allows security control actuators to connect over Wi-Fi and/or another wireless data transferring medium to the security controller 3902.

The security controller 3902 may be configured to communicate a message to the wireless access point 3914, according to some embodiments. In some embodiments, the message may be configured to cause the wireless access point 3914 to communicate a wake-up message to the wake-up radio 3928 via wake-up communication channel 3916, according to some embodiments. The wake-up radio

3928 may be configured to receive the wake-up message at some point in time after the wireless access point 3914 communicates the wake-up message. The security control actuator 3918 may be configured to operate some and/or all of its components in a high power state in response to the reception of the wake-up message, according to some embodiments. While operating in the high power state, the security control actuator 3918 may be able to determine what operation the security controller 3902 communicated via the wake-up message, according to some embodiments. In some embodiments, when the security control actuator 3918 is operating in the high power state it may be able to evoke a change on a security condition in building system 3800 via the control apparatus 3930.

In some embodiments, the wireless access point 3914 and the security controller 3902 may be separate devices. In some embodiments, the wireless access point may be connected through a wired and/or wireless connection. In some embodiments, the wireless access point 3914 and the security controller 3902 may be a part of the same device. In some embodiments, when the wireless access point 3914 and the security controller 3902 are a part of the same device, communication of the wake-up message may happen faster as the device that determines that the wake-up message should be communicated and the device that communicates the wake-up message are the same.

Figure 40:
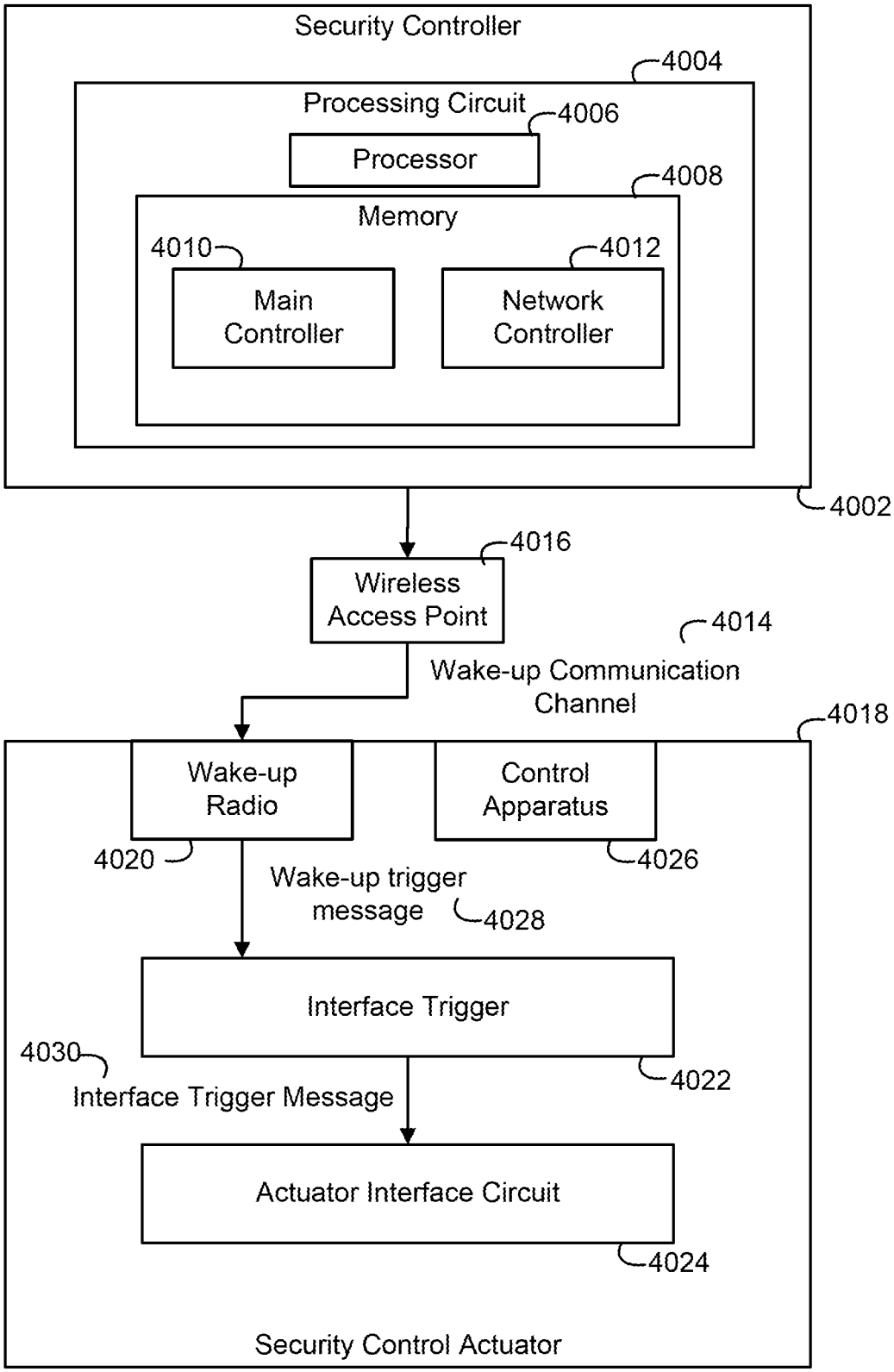
FIG. 40 is a block diagram of the communication of a wake-up message from a security controller to a security control actuator differing in structure from the security control actuator of FIG. 39 via a wireless access point to operate a control apparatus of the security control actuator wherein the communication can be performed by the security controller and one of the one or more security control actuators of FIG. 38, according to an exemplary embodiment.

Referring now to FIG. 40, a security controller 4002 and a security control actuator 4018 are shown connected by a wake-up communication channel 4014 and a wireless access point 4016, according to some embodiments. In some embodiments, security controller 4002 may be similar to and/or the same as security controller 3902 described with reference to FIG. 39. In some embodiments, wireless access point 4016 and wake-up communication channel 4014 may be similar to and/or the same as wireless access point 3914 and wake-up communication channel 3916 described with reference to FIG. 39 respectively, according to some embodiments.

Still referring to FIG. 40, a security control actuator 4018 differing from the security control actuator 3918 of FIG. 39 is shown, according to some embodiments. The security control actuator 4018 may be configured to operate a control apparatus 4026 in response to the reception of a wake-up message through a different method than the security control actuator 3918, according to some embodiments.

Security control actuator 4018 consists of a wake-up radio 4020, an interface trigger 4022, an actuator interface circuit 4024, and the control apparatus 4026, according to some embodiments. Wake-up radio 4020 may be configured to communicate a wake-up trigger message 4028 to the interface trigger 4022. In some embodiments, the wake-up trigger message 4028 may be a simple electrical impulse and/or may be a message including information from the security controller 4002 and/or the wake-up radio 4020. The interface trigger 4022 may be then configured to communicate an interface trigger message 4030 to the actuator interface circuit 4024 in response to the reception of the wake-up trigger message 4028. In some embodiments, the interface trigger message 4030 may be a simple electric impulse and/or may be a message including information from the wake-up trigger message 4028 and/or the interface trigger 4022. The actuator interface circuit 4024 may then be configured to operate the control apparatus 4026 in response to the reception of the interface trigger message 4030, according to some embodiments. In some embodiments, the actuator interface circuit 4024 may be configured to operate the control apparatus 4026 in a predetermined way and/or may operate the control apparatus 4026 based on direction given by the interface trigger message 4030. In some embodiments, the actuator interface circuit 4024 may operate the control apparatus 4026 in a way determined by the security controller 4002 based on a security condition within a building system needing to change.

Figure 41:
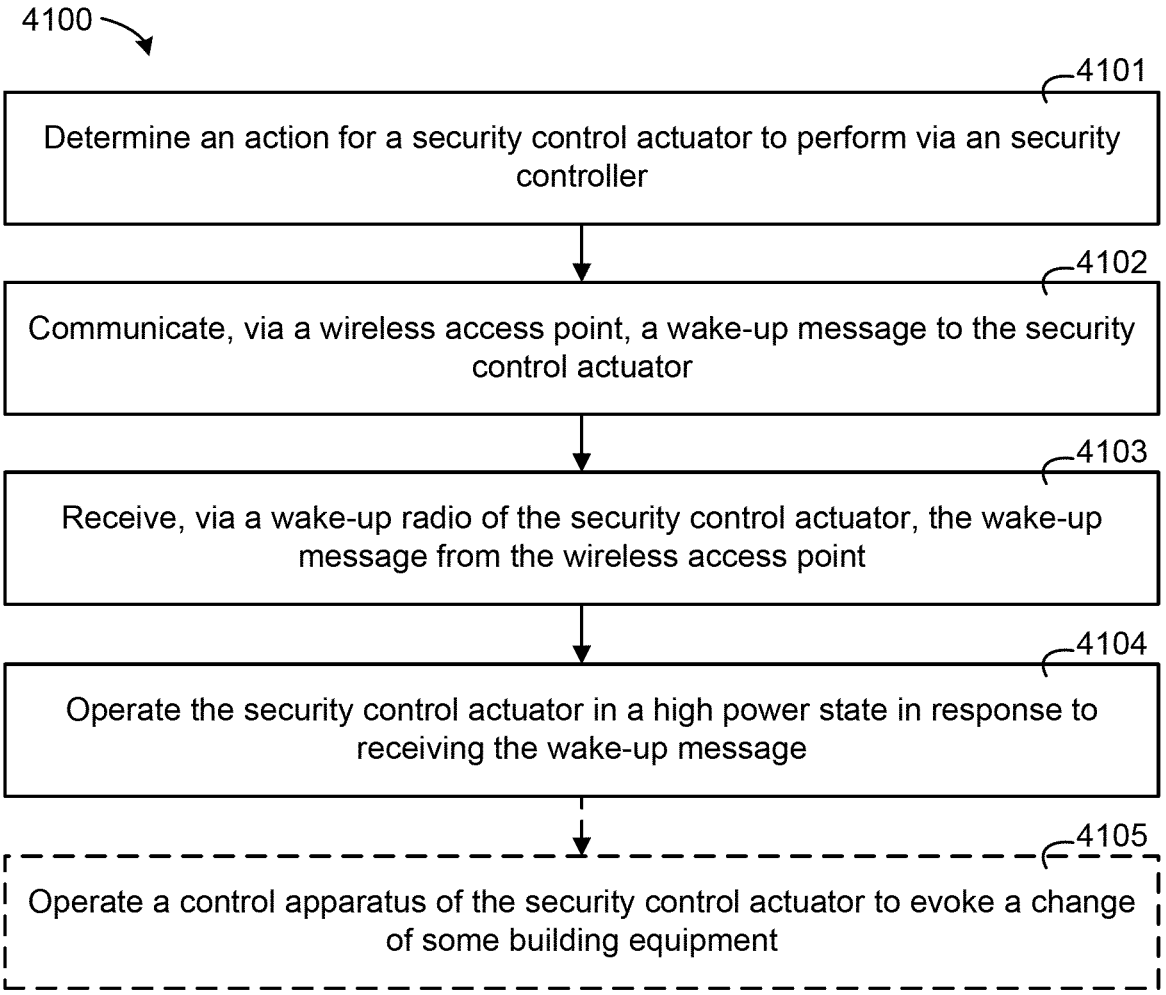
FIG. 41 is a flow diagram of a process where a security controller may communicate a wake-up message to a security control actuator in order to evoke a change of some building equipment that can be performed by the security controller and one of the one or more security control actuators of FIG. 38, according to an exemplary embodiment.

Referring now to FIG. 41, a process 4100 of the communication of a wake-up message from a security controller to a security control actuator is shown, according to some embodiments. In some embodiments, the wake-up message can be configured to operate the security control actuator in a high power state. In some embodiments, the security control actuator operating in the high power state may have some and/or all of its components receiving a necessary amount of power to be able to perform all of operations the components are configured to do. In some embodiments, the security controller 3801 and the security control actuator 3805 can be configured to perform some and/or all of the steps of process 4100.

In step 4101, the security controller may make a determination if the security control actuator needs to be operated in order to effect a change on a security condition within a building system. In some embodiments, the determination that the security control actuator needs to be operated can be made by security control analyzing the current state of the security condition of the building system. If the security condition is determined to not be in a desired state, the determination may be made that the security control actuator should perform an operation, according to some embodiments. Desired states may include, for example, a door being locked, a gate being shut, lighting in a room to be off such that people cannot see inside the room, etc.

In step 4102, if the determination in step 4101 is that the security control actuator needs to be operated, the security controller may communicate, via a wireless access point, a wake-up message to the security control actuator, according to some embodiments. In some embodiments, the wake-up message may be a specialized communication message sent via the wireless access point to operate the security control actuator in the high power state. In some embodiments, the wake-up message may include instructions for the security control actuator to perform when operating in the high power state. The instructions in the wake-up message may be any instructions to effect a change to reach a desired state of the security condition, according to some embodiments.

In step 4103, a wake-up radio of the security control actuator may receive the wake-up message communicated by the wireless access point. Prior to receiving the wake-up message, the security control actuator may be operating in a low power state where some and/or all of the components of the security control actuator may be receiving none and/or limited amounts of power, according to some embodiments. In some embodiments, the wake-up radio may always be operating with enough power as to receive the wake-up message and bring the security control actuator to the high power state based on the reception of the wake-up message.

In step 4104, the security control actuator may operate in the high power state based on the reception of the wake-up message in step 4103. Once operating in the high power state, the security control actuator may be able to evoke a change on some security condition in the building system, according to some embodiments.

In step 4105 the security control actuator may operate the control apparatus to evoke a change in the security condition of the building system identified by the security controller. In some embodiments, the operation performed by the control apparatus may be a preconfigured operation that occurs in response to the reception of a wake-up message such as a light toggling between on or off, a door toggling between locked and unlocked, a gate toggling between open or closed, etc. In some embodiments, the operation performed by the control apparatus may be in response to the configuration of the wake-up message communicated by the wireless access point. The wake-up message may be able to be configured to operate the control apparatus in one or more ways (e.g. multiple locks on a door to control, multiple heights to open a gate to, various lighting intensities in a room, etc.).

Figure 42:
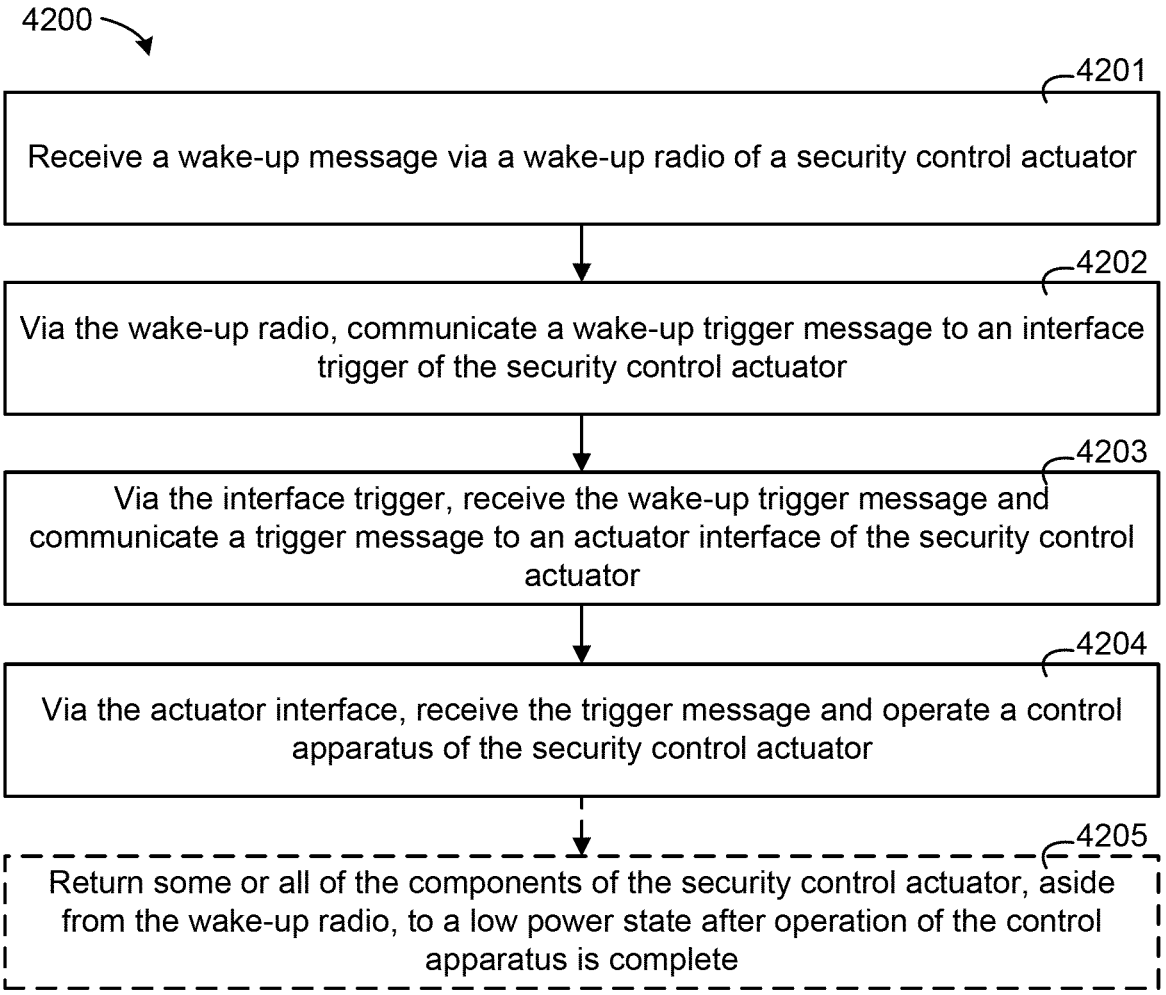
FIG. 42 is a flow diagram of a process that can be performed by the security control actuator of FIG. 40 to operate the control apparatus in response to a reception of a wake-up message, according to an exemplary embodiment.

Now referring to FIG. 42, a process 4200 of how the security control actuator 4018 of FIG. 40 may operate based on the reception of a wake-up message, according to some embodiments. The security control actuator 4018 may be a specialized security control actuator without a processing circuit like that of security control actuator 3918 described with reference to FIG. 39, according to some embodiments. In some embodiments, security control actuator 4018 may operate the control apparatus 4026 through a series of trigger messages internal to the security control actuator 4018 in response to the reception of the wake-up message.

In step 4201, the wake-up radio 4020 of the security control actuator 4018 may receive a wake-up message, according to some embodiments. In some embodiments, the wake-up message may be a specialized communication message where the wake-up message only indicates to the security control actuator 4018 to operate in a high power state. In some embodiments, the wake-up message may contain information about how the security control actuator 4018 should operate the control apparatus 4026 to effect a change in a security within a building system.

In step 4202, the wake-up radio 4020 may be configured to communicate a wake-up trigger message 4028 to the interface trigger 4022 of the security control actuator 4018 in response to the reception of the wake-up message, according to some embodiments. Before the communication of the wake-up trigger message 4028, the wake-up radio 4020 may be the only component of the security control actuator 4018 that is operating in a high power state, according to some embodiments. In some embodiments, the wake-up trigger message 4028 may be configured as to cause the interface trigger 4022 to operate in a high power state if it was not operating in a high power state already. In some embodiments, the wake-up trigger message 4028 may be configured to contain information about how the security control actuator 4018 should operate the control apparatus 4026 as indicated by the wake-up message received by the wake-up radio 4020.

In step 4203, the interface trigger 4022 may operate in the high power state in response to the reception of the wake-up trigger message 4028, according to some embodiments. The interface trigger 4022 may then be configured to communicate an interface trigger message 4030 to the actuator interface circuit 4024, in response to the reception of the wake-up trigger message 4028, according to some embodiments. In some embodiments, the interface trigger message 4030 may be configured as to wake-up the actuator interface circuit 4024 and operate it in a high power state if it was not already. In some embodiments, the wake-up trigger message 4028 may be configured to contain information about how the security control actuator 4018 should operate the control apparatus 4026 as indicated by the wake-up trigger message 4028.

In step 4204, the actuator interface circuit 4024 may receive the interface trigger message 4030 sent by the interface trigger 4022, according to some embodiments. In some embodiments, in response to the reception of the interface trigger message 4030, the actuator interface circuit 4024 may be configured to operate in the high power state if it was not already. In some embodiments, operating in the high power state indicates the actuator interface circuit 4024 may have the ability to interpret information contained in the interface trigger message 4030 and/or operate the control apparatus 4026. The actuator interface circuit 4024 may be further configured to operate the control apparatus 4026 in response to receiving the interface trigger message 4030. In some embodiments, the actuator interface circuit 4024 may operate the control apparatus 4026 in a predetermined way. In some embodiments, the actuator interface circuit 4024 may operate the control apparatus 4026 based on information contained in the interface trigger message 4030. Once the control apparatus 4026 is operated and/or reaches a desired state, a security condition in the building system 3800 described with reference to FIG. 38 may experience a change, according to some embodiments.

In step 4205, an optional step of process 4200, the security control actuator 4018 may be configured to return some and/or all of its components to a low power state in order to reduce system power consumption after the control apparatus 4026 reaches a desired state, according to some embodiments. In some embodiments, the security control actuator 4018 may be configured to keep some and/or all of its components in the high power state in response to a determination the components may need to be operated again.

Figure 43:
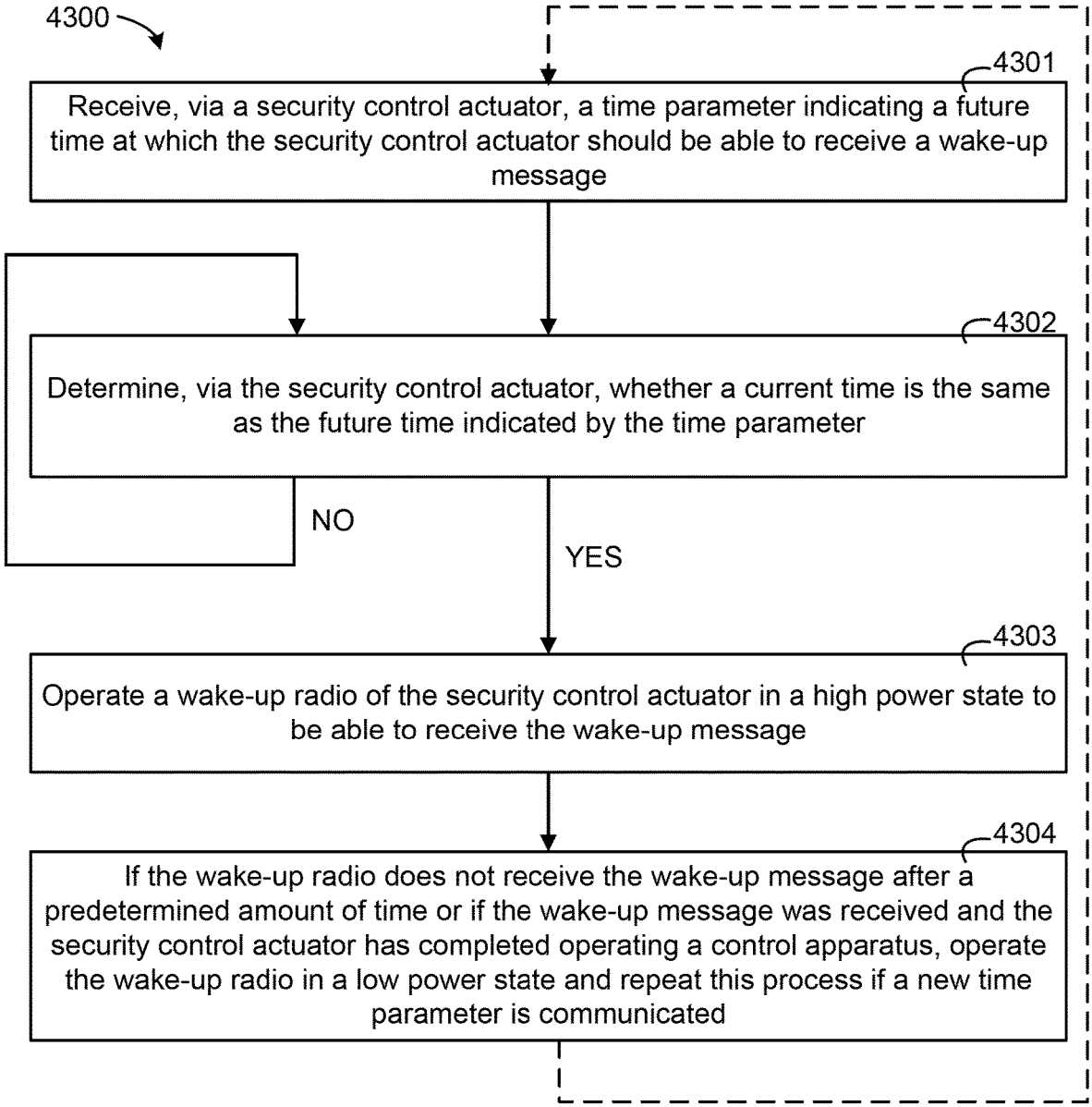
FIG. 43 is a flow diagram of a process of operating a wake-up radio of a security control actuator in a high power state based on a provided time parameter that can be performed by one of the one or more security control actuators of FIG. 38, according to an exemplary embodiment.

Now referring to FIG. 43, a process 4300 for operating a wake-up radio of a security control actuator in a high power state based on a provided time parameter is shown, according to some embodiments. In some embodiments, the security control actuator 3805 and the security controller 3801 described with reference to FIG. 38 may be configured to perform some and/or all of the steps of process 4300.

In step 4301, the security control actuator may receive a time parameter indicating a future time at which the security control actuator should operate the wake-up radio in the high power state. When operating the wake-up radio in the high power state, the security control actuator may be able to receive a wake-up message from the security controller, according to some embodiments. In some embodiments, the time parameter may be communicated by a security controller. In some embodiments, the time parameter can be manually programmed into the security control actuator.

In step 4302, the security control actuator may make a determination if the indicated future time of the time parameter is a current time. This determination may be made by a low power circuit of the security control actuator that has an ability to track the current time and make a comparison if the indicated future time of the time parameter is the same as the current time, according to some embodiments. If the determination is that the current time is not the indicated future time, the security control actuator may repeat the step 4302, according to some embodiments. In some embodiments, the comparison between the indicated future time and the current time can continue to be run by the lower power circuit until the current time is the same as the indicated future time. Even though the low power circuit may make many comparisons between the current time and the indicated future time, the power consumed by the low power circuit can still be less than the wake-up radio continuously operating at a power state where it can receive a wake-up message, according to some embodiments. If the determination is that the current time is the future time, process 4300 may continue to step 4303, according to some embodiments.

In step 4303, the security control actuator may operate the wake-up radio in the high power state in response to the determination made in step 4302 that the current time is the indicated future time. When operating in the high power state, the wake-up radio may be able to receive the wake-up message communicated by the security controller, according to some embodiments. In some embodiments, when the wake-up radio is operating in the high power state, the wake-up radio can only receive the wake-up message and/or operate some and/or all of the components of the security control actuator in the high power state if the wake-up message is received.

In step 4304, the security control actuator may operate the wake-up radio in a low power if either no wake-up message is received after a predetermined time period, according to some embodiments. In some embodiments, the security control actuator may operate the wake-up radio in the low power state if the wake-up message is received and the security control actuator has completed operating a control apparatus. Once the wake-up radio of the security control actuator is operating in the low power state, process 4300 may repeat starting in step 4301. In some embodiments, process 4300 may repeat if another time parameter is received by the security control actuator and/or the security control actuator and/or the security controller expect the security control actuator to operate at the high power state at some future time.

Process 4300 may further reduce power consumption of a building system by operating the wake-up radio of the security control actuator only at particular times based on provided time parameters. As the wake-up radio may spend at least some portion of its existence in a low power state, it may be inevitable that less power will be used by the system overall. Further considering that the security control actuator may be one of many in a set of security control actuators, power consumption may drop significantly over the building system if one or more of wake-up radios are sometimes operated in a low power state. In some embodiments, making determinations whether the indicated future time and the current time are the same requires less power than constantly operating the wake-up radio in the high power state. Therefore, in some embodiments, wake-up radio scheduling functionality can conserve power in the building system.

Figure 44:
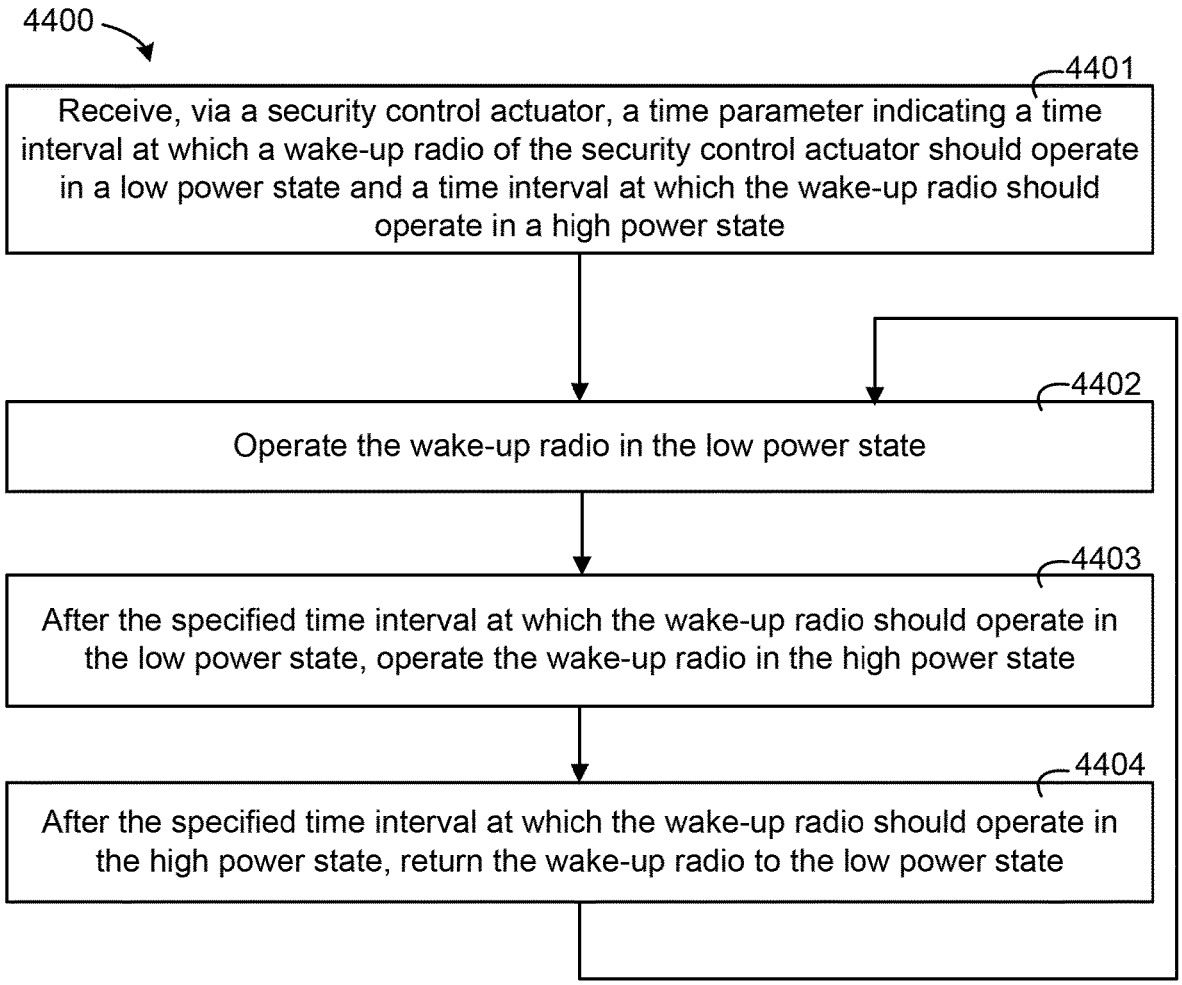
FIG. 44 is a flow diagram of a process of operating a wake-up radio of a security control actuator in a high power state based on a provided time interval that can be performed by one of the one or more security control actuators of FIG. 38, according to an exemplary embodiment.

Referring now to FIG. 44, a process 4400 for operating a wake-up radio of a security control actuator in a low power state or a high power state during time intervals specified in a time parameter is shown, according to some embodiments. In some embodiments, the security controller 3801 and/or the security control actuator 3805 may be configured to perform some and/or all of the steps of process 4400.

In step 4401, the security control actuator may receive the time parameter. In some embodiments, the time parameter may be communicated by a security controller. In some embodiments, the time parameter can be manually configured into the security control actuator. In some embodiments, the time parameter may include a high time interval where the security control actuator should operate the wake-up radio in the high power state, and a low time interval which indicates an amount of time the security control actuator should operate the wake-up radio in the low power state. In some embodiments, the high time interval and the low time interval are different amounts of time where the high time interval may be shorter than the low time interval. In some embodiments, the low time interval can be shorter than the high time interval. In some embodiments the time parameter can include a single time interval which indicates the security control actuator should operate the wake-up radio in the low power state and the high power state for the same amount of time.

In step 4402, some and/or all of the components of the security control actuator may be operated in the low power state to conserve energy usage. When the components of the security control actuator are operated in the low power state, the security control actuator may operate similarly and/or the same as the security control actuator operating in the low power state as described in reference to FIG. 41, according to some embodiments. In some embodiments, a low power circuit similar to and/or the same as the low power circuit described with reference to FIG. 43 may continue operation to track a current time and make comparisons between the current time and a future time. These comparisons can determine if an amount of time has passed as indicated by the time interval(s) where the wake-up radio of the security control actuator should alternate between the high power state to the low power state, or the low power state to the high power state, according to some embodiments.

In step 4403, the low power circuit may make a determination that the wake-up radio has operated in the low power state for the amount of time specified by the low time interval or the single time interval, according to various embodiments. In response to the determination that the wake-up radio has operated for the specified amount of time in the low power state, the wake-up radio can operate in the high power state, according to some embodiments.

In step 4404, the low power circuit may make a determination that the wake-up radio has operated in the high power state for the amount of time specified by the high time interval or the single time interval, according to various embodiments. In response to the determination that the wake-up radio has operated for the specified amount of time in the high power state, the wake-up radio can operate in the low power state, according to some embodiments. The wake-up radio operating in the low power state may not receive the amount of power necessary to be able to receive the wake-up message from the security controller, according to some embodiments. In some embodiments, once the wake-up radio is operating in the low power state, process 4400 may return to step 4402 where the low power circuit can continue to make determinations to switch the wake-up radio between the high power state and the low power state.

By periodically operating the wake-up radio in a low or high power state, only one time parameter may need to be passed to the wake-up radio in comparison to the multiple individual time parameters in FIG. 43. This simplifies a building system further by reducing the amount of additional communications that need to occur in order for all the components of the building system to function appropriately.

Figure 45:
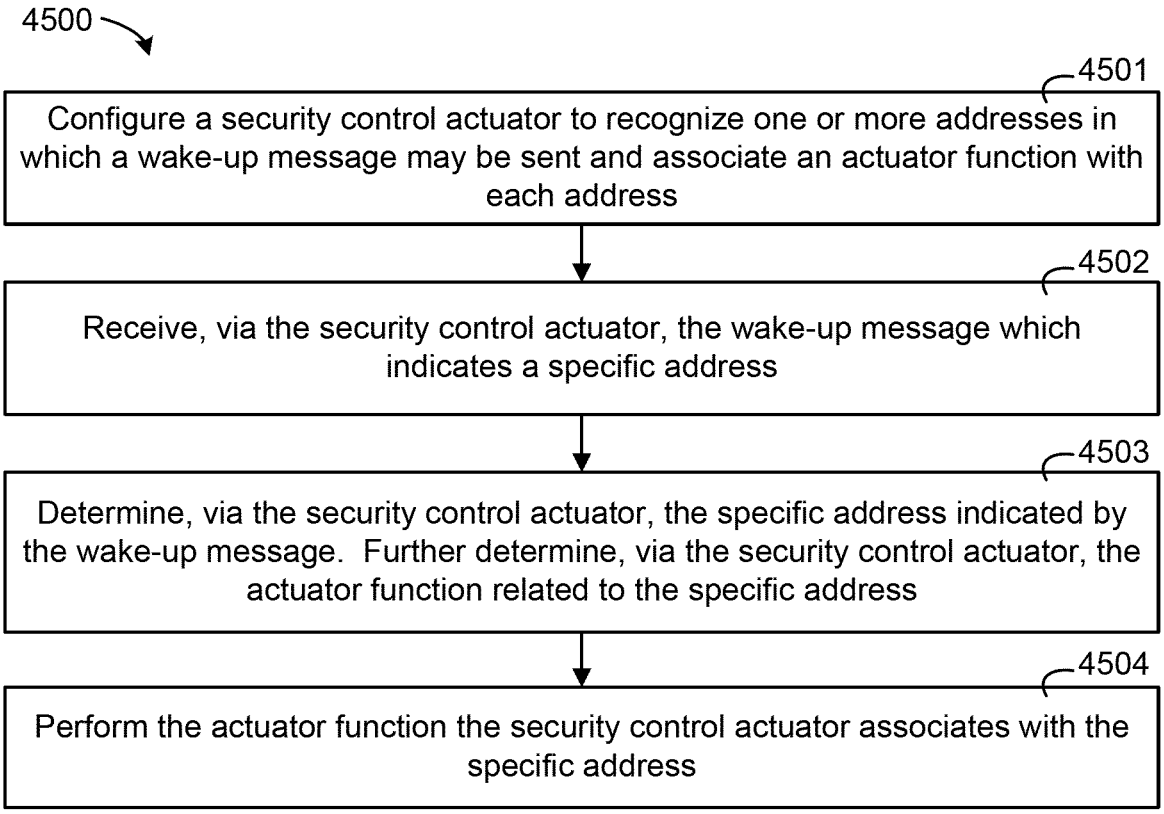
FIG. 45 is a flow diagram of a process by which a security control actuator may perform a certain operation of a control apparatus based on an address of a recovery message communicated by a security controller that can be performed by the security controller and one of the one or more security control actuators of FIG. 38, according to an exemplary embodiment.

Referring now to FIG. 45, a process 4500 for performing a predetermined control operation of a security control actuator based on an address that a wake-up message may be sent to is shown, according to some embodiments. In some embodiments, an address may include an electromagnetic wavelength a wake-up radio of the security control actuator may be listening to, a packet header of the wake-up message, an internet protocol (IP) address the wake-up message may be received on, etc. In some embodiments, the security control actuator 3805 described with reference to FIG. 38 may be configured to perform some and/or all of the steps of process 4500.

In step 4501, the security control actuator may be configured to recognize one or more addresses wherein each address may be related to a preconfigured control operation, according to some embodiments. For example, the wake-up radio of the security control actuator may be configured to have two IP addresses where if the wake-up message is sent to the first IP address the security control actuator may perform a first control operation (e.g., a gate opening partway, certain locks on a door being unlocked, etc.) and if the wake-up message is sent to the second IP address the security control actuator may perform a second control operation (e.g., a gate opening fully, all locks on a door being unlocked, etc.), according to some embodiments.

In step 4502, the security control actuator may receive the wake-up message where the wake-up message indicates a specific address, according to some embodiments. In some embodiments, the security control actuator can receive the wake-up message via the wake-up radio where the wake-up radio may be similar to and/or the same as the wake-up radio 3928 described with reference to FIG. 39 and/or the wake-up radio 4020 described with reference to FIG. 40, according to some embodiments.

In step 4503, the security control actuator may determine what address was indicated by the wake-up message. Based on what address is determined, the security control actuator may determine what associated control operation should be performed, according to some embodiments. In some embodiments, the determination of what control operation to perform may be made by an actuator controller similar to and/or the same as the actuator controller 3926 described with reference to FIG. 39 and/or an actuator interface circuit similar to and/or the same as the actuator interface circuit 4024 described with reference to FIG. 40, according to some embodiments.

In step 4504, the security control actuator may perform the control operation determined in step 4503, according to some embodiments. In some embodiments, the security control actuator may repeatedly attempt to perform the control operation determined in step 4503 if the previous attempt was unsuccessful. In some embodiments, the security control actuator may only perform one attempt of the control operation.

Figure 46:
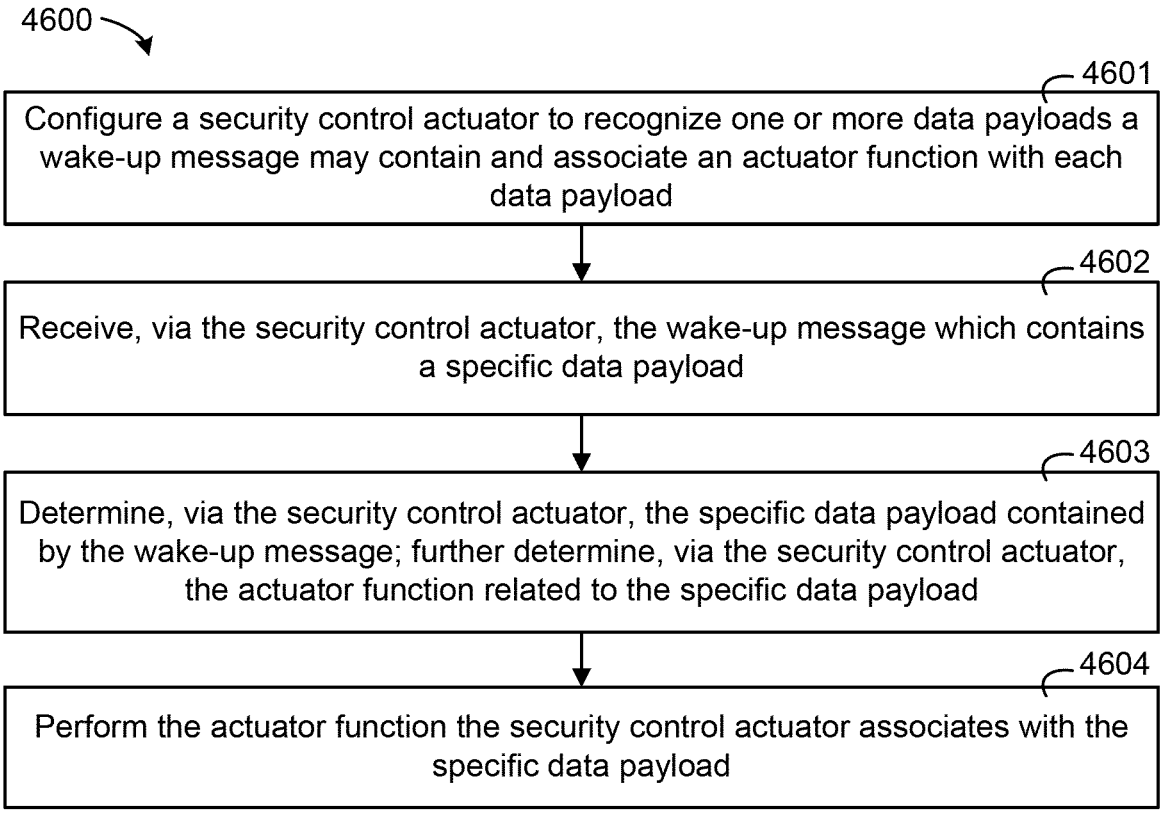
FIG. 46 is a flow diagram of a process where a security control actuator may perform a certain operation of a control apparatus based on a data payload of a recovery message communicated by a security controller that can be performed by the security controller and one of the one or more security control actuators of FIG. 38, according to an exemplary embodiment.

Referring now to FIG. 46, a process 4600 for performing a particular control operation based on information contained in a data payload of a wake-up message communicated by a security controller is shown, according to some embodiments. In some embodiments, the security control actuator 3805 and the security controller 3801 described with reference to FIG. 38 may be configured to perform some and/or all of the steps of process 4600.

In step 4601, a security control actuator may be configured to recognize one or more data payloads, wherein each data payload indicates a particular control operation to be performed by the security control actuator, according to some embodiments. For example, the data payload may contain a binary field wherein binary number 00 indicates first control operation (e.g., a gate opening partway, certain locks on a door unlocking, etc.) and binary number 01 indicates a second control operation (e.g., a gate opening fully, all locks on a door unlocking, etc.).

In step 4602, the security control actuator may receive the wake-up message via a wake-up radio where the wake-up message contains a data payload indicating a control operation. In some embodiments, the security control actuator can receive the wake-up message via the wake-up radio where the wake-up radio may be similar to and/or the same as the wake-up radio 3928 described with reference to FIG. 39 and/or the wake-up radio 4020 described with reference to FIG. 40, according to some embodiments.

In step 4603, the security control actuator may determine what data payload is contained by the wake-up message. Based on what data payload is determined, the security control actuator may what associated control operation should be performed, according to some embodiments. In some embodiments, the determination of what control operation to perform may be made by an actuator controller similar to and/or the same as the actuator controller 3926 described with reference to FIG. 39 and/or an actuator interface circuit similar to and/or the same as the actuator interface circuit 4024 described with reference to FIG. 40, according to some embodiments.

In step 4604, the security control actuator may perform the security control actuator function determined in step 4603 based on the data payload of the wake-up message, according to some embodiments. In some embodiments, the security control actuator may repeatedly attempt to perform the control operation determined in step 4503 if the previous attempt was unsuccessful. In some embodiments, the security control actuator may only perform one attempt of the control operation.

Figure 47:
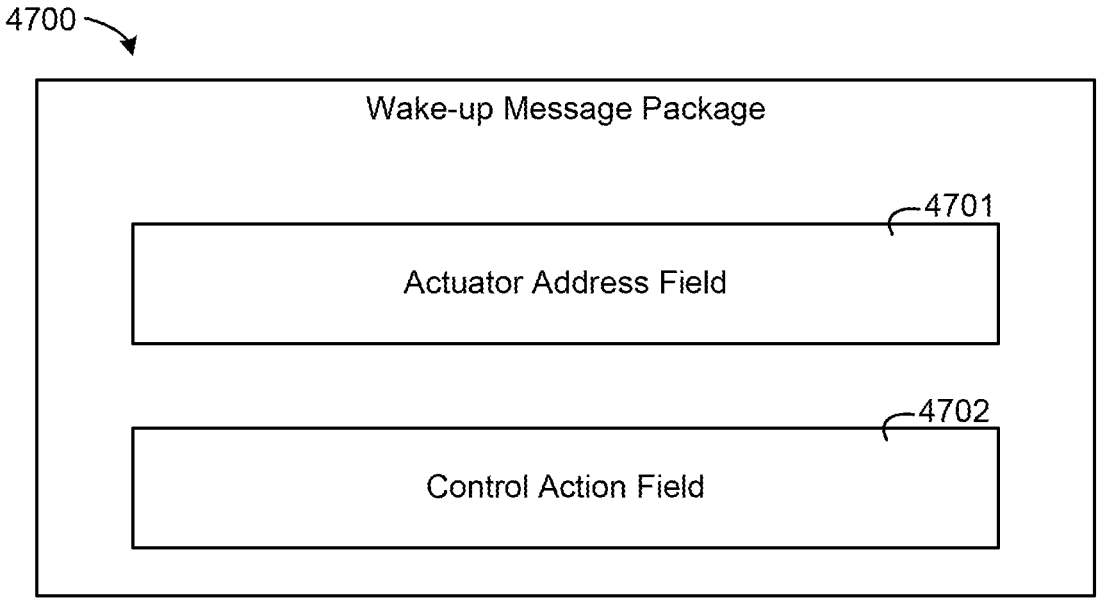
FIG. 47 is a block diagram of a wake-up message package that may be communicated by a security controller similar to the security controller of FIG. 38, according to an exemplary embodiment.

Referring now to FIG. 47, a block diagram of a wake-up message package 4700 detailing the contents of a wake-up message that may be communicated to a security control actuator is shown, according to some embodiments. Wake-up message package 4700 may be included in some and/or all of the wake-up messages described with reference to FIG. 38 through FIG. 46, according to some embodiments.

Wake-up message package 4700 may contain an actuator address field 4701 and/or a control action field 4702. The actuator address field 4701 may be configured to specify which security control actuator in a set of security control actuators the wake-up message should be sent to. The control action field 4702 may be configured to specify which security control actuator function should be performed by the security control actuator the wake-up message may be directed to. In some embodiments, the process shown in FIG. 45 may use the actuator address field 4701 to perform a control operation of a security control actuator. In some embodiments, the process shown in FIG. 46 may use the control action field 4702 to perform a control operation of a security control actuator.

Figure 48:
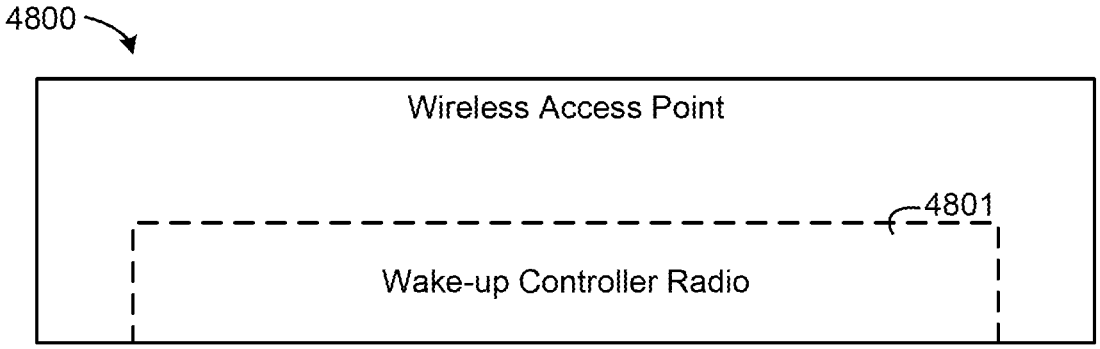
FIG. 48 is a block diagram of a wireless access point that can communicate a wake-up message and that may be similar to and/or the same as the wireless access point of FIG. 39 and/or the wireless access point of FIG. 40, according to an exemplary embodiment.

Referring now to FIG. 48, a block diagram of a wireless access point 4800 is shown, according to some embodiments. In some embodiments, wireless access point 4800 may be configured to communicate a wake-up message to a security control actuator at the direction of a message from a security controller. In some embodiments, wireless access point 4800 may be similar to and/or the same as the wireless access point 3914 described with reference to FIG. 39 and/or the wireless access point 4016 described with reference to FIG. 40.

According to some embodiments, wireless access point 4800 may contain a wake-up controller radio 4801 as shown. In some embodiments, the wake-up controller radio 4801 may be configured to communicate a wake-up message to a security control actuator. In some embodiments, the wake-up message communicated by the wireless access point 4800 may be similar and/or the same as the message communicated to the wireless access point 4800 by the security controller. In some embodiments, the wireless access point 4800 may be configured to add additional information to the message communicated to the wireless access point 4800 by the security controller in order to make the communication of the wake-up message possible and/or for the security control actuator to be able to perform the desired operation.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed:

1. A building system for a building, the system comprising:

an environmental controller comprising a controller radio, wherein the environmental controller is configured to communicate a wake-up message; and an environmental sensor comprising a sensing element, a wake-up radio, and a main radio, wherein the environmental sensor is configured to:

operate the main radio in a low power state;

receive the wake-up message from the controller radio via the wake-up radio;

operate the main radio in a high power state and cause the sensing element to gather environmental data in response to a reception of the wake-up message via the wake-up radio; and communicate the environmental data gathered by the sensing element to the controller radio via the main radio in response to the main radio operating in the high power state.

2. The system of claim 1, wherein the controller radio is a single radio configured to communicate the wake-up message to the environmental sensor and receive the environmental data from the main radio of the environmental sensor.

3. The system of claim 1, wherein the wake-up radio is only a receiver radio.

4. The system of claim 1, wherein the controller radio comprises a wake-up controller radio and a main controller radio, wherein the wake-up controller radio is configured to communicate the wake-up message to the wake-up radio and the main controller radio is configured to receive the environmental data from the main radio.

5. The system of claim 4, wherein the wake-up controller radio is only a transmitter radio.

6. The system of claim 1, wherein the wake-up radio is configured to operate in one of a low wake-up radio power state and a high wake-up radio power state, wherein the environmental sensor is configured to:

receive a time parameter indicating a future time at which to operate the wake-up radio in the high wake-up radio power state;

operate the wake-up radio in the low wake-up radio power state;

determine whether a current time is the future time; and operate the wake-up radio in the high wake-up radio power state in response to a determination that the current time is the future time.

7. The system of claim 6, wherein the time parameter indicating the future time comprises a low time interval indicating a first amount of time the wake-up radio should operate at the low wake-up radio power state and a high time interval indicating a second amount of time the wake-up radio should operate at the high wake-up radio power state, wherein the wake-up radio is configured to:

operate in the low wake-up radio power state for the first amount of time indicated by the low time interval;

operate in the high wake-up radio power state for the second amount of time indicated by the high time interval in response to the wake-up radio operating in the low wake-up radio power state for the first amount of time specified by the low time interval; and operate in the low wake-up radio power state in response to the wake-up radio operating in the high wake-up radio power state for the second amount of time specified by the high time interval.

8. The system of claim 7, wherein the high time interval and the low time interval is a single master time interval, wherein the single master time interval indicates the low time interval and the high time interval are the same.

9. The system of claim 1, wherein the environmental data gathered by the sensing element comprises a current value of one or more environmental conditions in the building, the one or more environmental conditions comprising at least one of light intensity, temperature, humidity, and air quality.

10. An environmental sensor of a building, the environmental sensor configured to:

operate in a low power state;

receive a wake-up message indicating the environmental sensor should operate in a high power state;

operate in the high power state and cause a sensing element to gather environmental data in response to a reception of the wake-up message; and communicate the environmental data gathered by the sensing element in response to operating in the high power state.

11. The environmental sensor of claim 10, wherein the environmental data gathered by the sensing element comprises a current value of one or more environmental conditions in the building, the one or more environmental conditions comprising at least one of light intensity, temperature, humidity, and air quality.

12. The environmental sensor of claim 10, further configured to:

receive a time parameter indicating a future time at which to operate in the high power state;

operate in the low power state;

determine whether a current time is the future time; and operate in the high power state in response to a determination that the current time is the future time.

13. The environmental sensor of claim 12, wherein the time parameter indicating the future time comprises a low time interval indicating a first amount of time the environmental sensor should operate at the low power state and a high time interval indicating a second amount of time the environmental sensor should operate at the high power state, the environmental sensor further configured to:

operate in the low power state for the first amount of time indicated by the low time interval;

operate in the high power state for the second amount of time indicated by the high time interval in response to the environmental sensor operating in the low power state for the first amount of time specified by the low time interval; and operate in the low power state in response to the environmental sensor operating in the high power state for the second amount of time specified by the high time interval.

14. The environmental sensor of claim 13, wherein the high time interval and the low time interval is a single master time interval, wherein the single master time interval indicates the low time interval and the high time interval are the same.

15. A method for operating an environmental sensor of a building, the method comprising:

receiving a wake-up message at the environmental sensor indicating the environmental sensor should operate in a high power state, wherein the environmental sensor comprises a sensing element;

operating the environmental sensor in the high power state and causing the sensing element to gather environmental data in response to receiving the wake-up message; and communicating the environmental data gathered by the sensing element in response to operating in the high power state.

16. The method of claim 15, wherein the environmental data gathered by the sensing element comprises a current value of one or more environmental conditions in the building, the one or more environmental conditions comprising at least one of light intensity, temperature, humidity, and air quality.

17. The method of claim 15, further comprising:

receiving a time parameter indicating a future time at which to operate the environmental sensor in the high power state;

operating the environmental sensor in a low power state;

determining whether a current time is the future time; and operating the environmental sensor in the high power state in response to a determination that the current time is the future time.

18. The method of claim 17, wherein the time parameter indicating the future time comprises a low time interval indicating a first amount of time the environmental sensor should operate at the low power state and a high time interval indicating a second amount of time the environmental sensor should operate at the high power state, the method further comprising:

operating the environmental sensor in the low power state for the first amount of time indicated by the low time interval;

operating the environmental sensor in the high power state for the second amount of time indicated by the high time interval in response to the environmental sensor operating in the low power state for the first amount of time specified by the low time interval; and operating the environmental sensor in the low power state in response to the environmental sensor operating in the high power state for the second amount of time specified by the high time interval.

19. The method of claim 18, wherein the high time interval and the low time interval is a single master time interval, wherein the single master time interval indicates the low time interval and the high time interval are the same.

20. The method of claim 15, wherein the wake-up message and the environmental data gathered by the sensing element are communicated wirelessly.

* * * * *